US008129606B2

(12) United States Patent
Sato et al.

(10) Patent No.: US 8,129,606 B2
(45) Date of Patent: Mar. 6, 2012

(54) MUSICAL TONE SIGNAL-PROCESSING APPARATUS

(75) Inventors: Kenji Sato, Hamamatsu (JP); Takaaki Hagino, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 0 days.

(21) Appl. No.: 12/947,671

(22) Filed: Nov. 16, 2010

(65) Prior Publication Data

US 2011/0132178 A1 Jun. 9, 2011

(30) Foreign Application Priority Data

Dec. 4, 2009 (JP) ..... 2009-277054
Jan. 15, 2010 (JP) ..... 2010-007376
Jan. 29, 2010 (JP) ..... 2010-019771

(51) Int. Cl.
*G10H 1/08* (2006.01)

(52) U.S. Cl. ..... 84/625; 381/119

(58) Field of Classification Search ..... 84/622, 84/625, 631, 659, 660, 664; 381/119, 1, 381/2, 19, 20
See application file for complete search history.

(56) References Cited

U.S. PATENT DOCUMENTS

| | | | | |
|---|---|---|---|---|
| 5,426,702 | A | 6/1995 | Aarts | |
| 6,084,970 | A | 7/2000 | Aarts et al. | |
| 7,162,045 | B1 | 1/2007 | Fujii | |
| 7,492,915 | B2 * | 2/2009 | Jahnke | 381/119 |
| 7,548,791 | B1 | 6/2009 | Johnston | |
| 2005/0179701 | A1 * | 8/2005 | Jahnke | 345/619 |
| 2006/0067541 | A1 | 3/2006 | Yamada et al. | |
| 2007/0110258 | A1 | 5/2007 | Kimijima | |
| 2008/0019531 | A1 * | 1/2008 | Kimijima | 381/1 |
| 2009/0285409 | A1 * | 11/2009 | Yoshizawa et al. | 381/92 |
| 2010/0232635 | A1 * | 9/2010 | Miyazaki et al. | 381/336 |

FOREIGN PATENT DOCUMENTS

| | | | |
|---|---|---|---|
| JP | 58-203483 | | 11/1983 |
| JP | 58-203484 | | 11/1983 |
| JP | 02-108500 | A | 4/1990 |
| JP | 04-296200 | A | 10/1992 |
| JP | 06-205500 | A | 7/1994 |
| JP | 08-123410 | A | 5/1996 |
| JP | 08-256400 | A | 10/1996 |

(Continued)

OTHER PUBLICATIONS

Jam VOX (software on Windows PC) URL: http://www.voxamps.com/downloads/PDF/JamVOX_OM_E1.pdf Owner's Manual p. 27 GXT(Guiter XTraction) function.

(Continued)

*Primary Examiner* — Jeffrey Donels
(74) *Attorney, Agent, or Firm* — Foley & Lardner LLP

(57) ABSTRACT

A musical tone signal processing apparatus configured to freely expand or contract an acoustic image. A setting means may set a second reference localization, a first function that stipulates expansion of the boundary of one end of a direction range, and a second function that stipulates expansion of the boundary of an other end of said direction range. In addition, an output direction indicated by localization information of an extraction signal that exists in the direction range in which the conditions have been set in this manner is shifted by an acoustic image scaling means. The acoustic image in said direction range is expanded or contracted accordingly. In other words, the acoustic image formed by the extraction signal is expanded or contracted by shifting the output direction for each extraction signal extracted from within the direction range.

26 Claims, 17 Drawing Sheets

FOREIGN PATENT DOCUMENTS

| | | | |
|---|---|---|---|
| JP | 08-298700 | A | 11/1996 |
| JP | 09-160546 | | 6/1997 |
| JP | 2000-504526 | T | 11/2000 |
| JP | 2001-069597 | A | 3/2001 |
| JP | 2002-078100 | A | 3/2002 |
| JP | 2002-247699 | A | 8/2002 |
| JP | 2005-150993 | | 6/2005 |
| JP | 2005-244293 | | 9/2005 |
| JP | 2006-100869 | A | 4/2006 |
| JP | 2007-135046 | A | 5/2007 |
| JP | 2008-072600 | A | 3/2008 |
| JP | 2009-010992 | A | 1/2009 |
| JP | 2009-188971 | A | 8/2009 |

OTHER PUBLICATIONS

Machine English Translation for Japanese Patent Application No. 08-123410.
Machine English Translation for Japanese Patent Application No. 08-256400.
Machine English Translation for Japanese Patent Application No. 2002-078100.
Machine English Translation for Japanese Patent Application No. 2002-247699.
Machine English Translation for Japanese Patent Application No. 2008-072600.
Machine English Translation for Japanese Patent Application No. 2009-010992.
Machine English Translation for Japanese Patent Application No. 2009-188971.
Machine English Translation for Japanese Patent Application No. 08-298700.
Machine English Translation for Japanese Patent Application No. 2000-504526.
Machine Translation for Japanese Patent Application No. 09-160546.
Machine Translation for Japanese Patent Application No. 2005-150993.
Machine Translation for Japanese Patent Application No. 2005-244293.
Extra Boy Pro (software on Windows PC) URL: http://www.elevayta.net/product13.htm Manual: Extra_Boy_Pro_IFU.pdf.
Otokirisu (free software on Windows PC) URL: http://www.forest.impress.co.jp/docs/serial/okiniiri/20100125_343650.html Home Page Copy: 20100125_3.pdf README: readme.txt Manual: OtokirisHelp.pdf File List: OTOKIRISU.bmp.

* cited by examiner

MUSICAL TONE SIGNAL-PROCESSING APPARATUS

CROSS-REFERENCE TO RELATED PATENT APPLICATIONS

Japan Priority Application 2009-277054, filed Dec. 4, 2009 including the specification, drawings, claims and abstract, is incorporated herein by reference in its entirety. Japan Priority Application 2010-007376, filed Jan. 15, 2010 including the specification, drawings, claims and abstract, is incorporated herein by reference in its entirety. Japan Priority Application 2010-019771, filed Jan. 29, 2010 including the specification, drawings, claims and abstract, is incorporated herein by reference in its entirety.

BACKGROUND

1. Field of the Invention

Embodiments of the present invention generally relate to musical tone signal processing systems and methods, and, in specific embodiments, to musical tone signal processing systems and methods for expanding and contracting an acoustic image.

2. Related Art

According to the apparatus cited in Japanese Laid-Open Patent Application Publication (Kokai) Number 2000-504526), sorts a monaural signal to the left and the right in accordance with frequency bands. This apparatus allows the output to have a simulated stereo sound.

According to the sound effect imparting apparatus cited in Japanese Laid-Open Patent Application Publication (Kokai) Number 08-123410) can provide an expansive feeling to the sound of each sound source that is configured by left and right channels. With that kind of sound effect imparting apparatus, specifically, the sound is made to have an expansive feeling by blurring the discrimination of the localization of the sound by adjusting the localization and inverting the phase of the timbre data of each frequency band by time division to each of the left and right channels in each of the frequency bands. However, for both apparatuses, it is difficult to expand the acoustic image of the input sound source freely in conformance with one's desires.

SUMMARY OF THE DISCLOSURE

A musical tone signal processing apparatus may include (but is not limited to) input means, dividing means, level calculation means, localization information calculation means, first setting means, judgment means, extractions means, output signal generation means, output means, second setting means, and acoustic image scaling means. The input means may be for inputting a musical tone signal. The musical tone signal may comprise a signal for each of a plurality of input channels.

The dividing means may be for dividing the signals into a plurality of frequency bands. The level calculation means may be for calculating a level for each of the input channels for each of the frequency bands. The localization information calculation means may be for calculating localization information, which indicates an output direction of the musical tone signal with respect to a first reference localization that has been set in advance, for each of the frequency bands based on the level.

The first setting means may be for setting at least one direction range of the output direction. The judgment means may be for judging whether the output direction of the musical tone signal is within the direction range. The extraction means may be for extracting an extraction signal. The extraction signal may comprise the signal of each of the input channels in the frequency band corresponding to the localization information having the output direction that is judged to be within the direction range. The output signal generation means for generating an output signal in the time domain for each output channel that has been set in advance. The output signal in the time domain may be generated by signal processing and converting the extraction signal.

The output means may be for outputting the output signal in the time domain to each of the output channels. The second setting means may be for setting for the direction range: a second reference localization, a first function that stipulates the degree of expansion of a boundary of a first end of the direction range, and a second function that stipulates the degree of expansion of a boundary of a second end of the direction range. The acoustic image scaling means may be for expanding or contracting an acoustic image by shifting the output direction of an extraction signal, that has localization information located closer to the boundary of the first end of the direction range than the second reference localization, based on mapping of the first function, and shifting the output direction of an extraction signal, that has localization information located closer to the boundary of the second end of the direction range than the second reference localization, based on mapping of the second function.

With the second setting means, the first reference localization, the first function that stipulates the degree of expansion of the boundary of one end of said direction range and the second function that stipulates the degree of expansion of the boundary of the other end of said direction range are set. In addition, the output direction that is indicated by the localization information of the extraction signal that exists in the direction range in which the conditions have been set in this manner is shifted by the acoustic image scaling means. The acoustic image in said direction range is expanded or contracted accordingly.

Specifically, for the direction range that has been set by the second reference localization, the first function, and the second function, the extraction signals are extracted by the extraction means from within that direction range. The output direction, which is indicated by the localization information of extraction signal, that is located more toward one end of said direction range than the second reference localization is shifted by the acoustic image scaling means via linear mapping in conformance with the first function in which said second reference localization is made the reference. In addition, the output direction, which is indicated by the localization information of the extraction signal, that is located more toward the other end of said direction range than the second reference localization is shifted in the same manner by the acoustic image scaling means via linear mapping in conformance with the second function in which said second reference localization is made the reference.

In other words, by shifting the localization of each extraction signal (the output direction that is indicated by the localization information of each extraction signal extracted from within the direction range in which each of the conditions that have been set by the second setting means), the acoustic image, which is formed by the extraction signal extracted from the direction range set, is expanded or contracted. Accordingly, each acoustic image that is indicated by the stereo sound source can be freely expanded or contracted. Incidentally, the setting of each of the conditions (the second reference localization, the first function, and the second function) by the second setting means may be preset or varied. In addition, "degree of expansion" includes expansion and contraction.

In various embodiments, the first setting means may be configured to set a plurality of direction ranges for the output direction. The judgment means may judge whether the output direction of the musical tone signal is within each of the direction ranges. The extraction means may extract the extraction signal. The extraction signal may comprise the signal of each of the input channels in the frequency band corresponding to the localization information having the output direction that is judged to be in each of the direction ranges. The second setting means may be configured to set for each of the direction ranges: a second reference localization, a first function that stipulates the degree of expansion of a boundary of a first end of each direction range, and a second function that stipulates the degree of expansion of a boundary of a second end of each direction range.

The output signal generation means may include signal processing means, synthesis means, and conversion means. The signal processing means may be for processing the extraction signal into a post-processed extraction signal for each of the direction ranges. The synthesis means may be for synthesizing the post-processed extraction signal into a synthesized signal for each output channel that has been set in advance for each of the direction ranges. Each output channel may correspond to one of the plurality of input channels. The conversion means may be for converting each of the synthesized signals into a respective one of the output signal in the time domain.

In this manner, it is possible for the extraction means to extract the extraction signals from the signals of each input channel in each direction range that has been set, in other words, in each desired localization. The second setting means here is able to set the second reference localization, the first function, and the second function in each direction range that has been set by the first setting means. Therefore, the independent expansion or contraction of the acoustic image in each direction range that has been set by the first setting means is possible. In addition, the extraction means carries out the extraction of the signals in each direction range that has been set from the signals of each input channel. Therefore, after signal processing has been carried out for each signal that has been extracted (the extraction signal), the extraction signals can be synthesized again.

In some embodiments, the second setting means may be configured to set the second reference localization, the first function, and the second function to be the same for at least some of the direction ranges. In some of the embodiments, the signal processing means may distribute the signal of each input channel in conformance with the output channels. The signal processing means may process each of the distributed signals. The output means may comprise a plurality of output means each of which corresponds to one of the distributed signals. The second setting means may set for the direction range of the distributed signals: a second reference localization, a first function that stipulates the degree of expansion of a boundary of a first end of the direction range, and a second function that stipulates the degree of expansion of a boundary of a second end of the direction range. The acoustic image scaling means may shift the output direction for each of the distributed signals.

Therefore, after the extraction signals have been extracted for each desired localization, the extraction signals of the desired localization (i.e., one localization) are distributed; and after performing independent signal processing respectively for each signal that has been distributed, it is possible to output those from separate output means. At this time, the second setting means can set the second reference localization, the first function, and the second function for each signal that is distributed in conformance with the output channels. In addition, the acoustic image scaling means carries out mapping independently for each signal that has been distributed using the second reference localization, the first function, and the second function that has been set for each signal that is distributed in conformance with the output channels. Therefore, it is possible to appropriately expand or contract the acoustic image in conformance with the arrangement of the output means.

In various embodiments, the first setting means may be configured to set a plurality of direction ranges for the output direction. The judgment means may judge whether the output direction of the musical tone signal is within each of the direction ranges. The extraction means may extract the extraction signal. The extraction signal may comprise the signal of each of the input channels in the frequency band corresponding to the localization information having the output direction that is judged to be in each of the direction ranges. The second setting means may be configured to set for each of the direction ranges: a second reference localization, a first function that stipulates the degree of expansion of a boundary of a first end of each direction range, and a second function that stipulates the degree of expansion of a boundary of a second end of each direction range.

The output signal generation means may include signal processing means, synthesis means, and conversion means. The signal processing means may be for processing the extraction signal into a post-processed extraction signal for each of the direction ranges. The conversion means may be for converting the post-processed extraction signal into a time domain extraction signal for each of the direction ranges. The synthesis means may be for synthesizing each of the time domain extraction signals for each output channel that has been set in advance for each of the direction ranges into a respective one of the output signal in the time domain. Each output channel may correspond to one of the plurality of input channels.

In this manner, it is possible for the extraction means to extract the extraction signals from the signals of each input channel in each direction range that has been set, in other words, in each desired localization. The second setting means here is able to set the second reference localization, the first function, and the second function in each direction range that has been set by the first setting means. Therefore, the independent expansion or contraction of the acoustic image in each direction range that has been set by the first setting means is possible. In addition, the extraction means carries out the extraction of the signals in each direction range that has been set from the signals of each input channel. Therefore, after signal processing has been carried out for each signal that has been extracted (the extraction signal), the extraction signals can be synthesized again.

In some embodiments, the second setting means may be configured to set the second reference localization, the first function, and the second function to be the same for at least some of the direction ranges. In some of the embodiments, the signal processing means may distribute the signal of each input channel in conformance with the output channels. The signal processing means may process each of the distributed signals. The output means may comprise a plurality of output means each of which corresponds to one of the distributed signals. The second setting means may set for the direction range of the distributed signals: a second reference localization, a first function that stipulates the degree of expansion of a boundary of a first end of the direction range, and a second function that stipulates the degree of expansion of a boundary of a second end of the direction range. The acoustic image scaling means may shift the output direction for each of the distributed signals.

Therefore, after the extraction signals have been extracted for each desired localization, the extraction signals of the desired localization (i.e., one localization) are distributed; and after performing independent signal processing respectively for each signal that has been distributed, it is possible to output those from separate output means. At this time, the second setting means can set the second reference localization, the first function, and the second function for each signal that is distributed in conformance with the output channels. In addition, the acoustic image scaling means carries out mapping independently for each signal that has been distributed using the second reference localization, the first function, and the second function that has been set for each signal that is distributed in conformance with the output channels. Therefore, it is possible to appropriately expand or contract the acoustic image in conformance with the arrangement of the output means.

In various embodiments, the first setting means may be configured to set a plurality of direction ranges for the output direction. The judgment means may judge whether the output direction of the musical tone signal is within each of the direction ranges. The extraction means may extract the extraction signal. The extraction signal may comprise the signal of each of the input channels in the frequency band corresponding to the localization information having the output direction that is judged to be in each of the direction ranges. The second setting means may be configured to set for each of the direction ranges: a second reference localization, a first function that stipulates the degree of expansion of a boundary of a first end of each direction range, and a second function that stipulates the degree of expansion of a boundary of a second end of each direction range.

The output signal generation means may include signal processing means, synthesis means, and conversion means. The conversion means may be for converting the extraction signal into a time domain extraction signal for each of the direction ranges. The signal processing means may be for processing each of the time domain extraction signals into a respective time domain post-processed extraction signal. The synthesis means may be for synthesizing the time domain post-processed extraction signals for each output channel that has been set in advance for each of the direction ranges into a respective one of the output signal in the time domain. Each output channel may correspond to one of the plurality of input channels.

In this manner, it is possible for the extraction means to extract the extraction signals from the signals of each input channel in each direction range that has been set, in other words, in each desired localization. The second setting means here is able to set the second reference localization, the first function, and the second function in each direction range that has been set by the first setting means. Therefore, the independent expansion or contraction of the acoustic image in each direction range that has been set by the first setting means is possible. In addition, the extraction means carries out the extraction of the signals in each direction range that has been set from the signals of each input channel. Therefore, after signal processing has been carried out for each signal that has been extracted (the extraction signal), the extraction signals can be synthesized again.

In some embodiments, the second setting means may be configured to set the second reference localization, the first function, and the second function to be the same for at least some of the direction ranges. In some of the embodiments, the signal processing means may distribute the signal of each input channel in conformance with the output channels. The signal processing means may process each of the distributed signals. The output means may comprise a plurality of output means each of which corresponds to one of the distributed signals. The second setting means may set for the direction range of the distributed signals: a second reference localization, a first function that stipulates the degree of expansion of a boundary of a first end of the direction range, and a second function that stipulates the degree of expansion of a boundary of a second end of the direction range. The acoustic image scaling means may shift the output direction for each of the distributed signals.

Therefore, after the extraction signals have been extracted for each desired localization, the extraction signals of the desired localization (i.e., one localization) are distributed; and after performing independent signal processing respectively for each signal that has been distributed, it is possible to output those from separate output means. At this time, the second setting means can set the second reference localization, the first function, and the second function for each signal that is distributed in conformance with the output channels. In addition, the acoustic image scaling means carries out mapping independently for each signal that has been distributed using the second reference localization, the first function, and the second function that has been set for each signal that is distributed in conformance with the output channels. Therefore, it is possible to appropriately expand or contract the acoustic image in conformance with the arrangement of the output means.

In various embodiments, the acoustic image scaling means may include sorting means for sorting the output directions such that the output directions alternate in each of the consecutive frequency ranges to the first end and the second end of the direction range.

In those cases where the extraction signal is a monaural signal, the output directions that are indicated by the localization information of said extraction signals are automatically sorted by the sorting means such that the signals alternate in the output direction of one end or the other end of the direction range that includes said extraction signal for each of the consecutive frequency bands that have been set in advance. In addition, for the extraction signals sorted by the sorting means, mapping is carried out by the acoustic image scaling means using the second reference localization, the first function, and the second function that have been set for the direction range that includes said extraction signals.

In other words, in those cases where the extraction signal is a monaural signal, the output directions (the localizations) of each of the extraction signals are automatically sorted in advance by the sorting means to one of the boundaries of the direction range. Accordingly, even if the extraction signal is a monaural signal, it becomes possible for the localization to be shifted in accordance with the mapping using the second reference localization, the first function, and the second function. As a result, the acoustic image can be made to have a feeling of expanse. In addition, in the sorting of the localizations by the sorting means, the sorting can alternate by the group units of each specified frequency. Therefore, a feeling of expanse having good balance can be obtained. Incidentally, monaural signal includes an input musical tone signal that is a monaural signal (i.e., the signal of one input channel) and an input musical tone signal that is the signal of a plurality of input channels but are synthesized and made into a monaural signal.

A musical tone signal processing apparatus may include (but is not limited to) input means, dividing means, level calculation means, first setting means, extraction means, output signal generation means, signal processing means, conversion means, output means, second setting means, sorting means, and acoustic image scaling means. The input means may be for inputting a monaural musical tone signal. The dividing means may be for dividing the monaural musical tone signal into a plurality of frequency bands.

The level calculation means may be for calculating a level for each of the frequency bands. The first setting means may be for setting at least one set of a direction range that includes the output direction of the monaural musical tone signal and a bandwidth of the frequency bands. The output direction may be equal to a first reference localization that has been stipulated in advance. The extraction means may be for extracting, for the at least one set, the monaural signal of the frequency bands that are within each bandwidth.

The output signal generation means may be for generating an output signal in the time domain for each output channel that has been set in advance. The output means may be for outputting the output signal to each of the output channels. The second setting means may be for setting, for each of the at least one set, a second reference localization, a first function that stipulates the degree of expansion of a boundary of a first end of the direction range, and a second function that stipulates the degree of expansion of a boundary of a second end of the direction range.

The sorting means may be for sorting the output directions such that the output directions alternate in each of the consecutive frequency ranges to the first end and the second end of the direction range. The acoustic image scaling means may be for expanding or contracting an acoustic image by shifting the output direction of an extraction signal, that has localization information located closer to the boundary of the first end of the direction range than the second reference localization, based on mapping of the first function, and shifting the output direction of an extraction signal, that has localization information located closer to the boundary of the second end of the direction range than the second reference localization, based on mapping of the second function.

In other words, in those cases where the extraction signal is a monaural signal, the output directions (the localizations) of each of the extraction signals are automatically sorted in advance by the sorting means to one of the boundaries of the direction range. Accordingly, even if the extraction signal is a monaural signal, it becomes possible for the localization to be shifted in accordance with the mapping using the second reference localization, the first function, and the second function. As a result, the acoustic image can be made to have a feeling of expanse. In addition, in the sorting of the localizations by the sorting means, the sorting can alternate by the group units of each specified frequency. Therefore, a feeling of expanse having good balance can be obtained.

A signal processing system may include (but is not limited) an input terminal, a first operator device, a second operator device, a processor, an output signal generator, and an output terminal. The input terminal may be configured to input an audio signal. The audio signal may comprise a signal for each of a plurality of input channels. Each of the signals may have a plurality of frequency bands. The first operator device may be configured to set at least one direction range of the output direction. The second operator device may be configured to set for the direction range: a second reference point, a first function establishing expansion of a boundary of a first end of the direction range, and a second function establishing expansion of a boundary of a second end of the direction range.

The processor may be configured to calculate a signal level for each of the input channels for each of the frequency bands. The processor may be configured to calculate localization information, which indicates an output direction of the audio signal with respect to a predefined first reference point, for each of the frequency bands based on the signal level. The processor may be configured to determine whether the output direction of the audio signal is within the direction range. The processor may be configured to extract as an extraction signal, the signal of each of input channel in the frequency band corresponding to the localization information having the output direction that is determined to be within the direction range. The processor may be configured to expand or contract an acoustic image by shifting the output direction of an extraction signal, that has localization information located closer to the boundary of the first end of the direction range than the second reference point, based on mapping of the first function, and shifting the output direction of an extraction signal, that has localization information located closer to the boundary of the second end of the direction range than the second reference point, based on mapping of the second function.

The output signal generator may be configured to generate an output time domain signal for each preset output channel, the output time domain signal generated by signal processing and converting the extraction signal. The output terminal may be configured to output the output time domain signal to each of the output channels.

In various embodiments, the first operator device may be configured to set a plurality of direction ranges for the output direction. The processor may be configured to determine whether the output direction of the audio signal is within each of the direction ranges. The processor may be configured to extract the extraction signal. The extraction signal may comprise the signal of each of the input channels in the frequency band corresponding to the localization information having the output direction that is judged to be in each of the direction ranges. The second operator device may be configured to set for each of the direction ranges: a second reference point for each direction range, a first function establishing expansion of a boundary of a first end of each direction range, and a second function establishing expansion of a boundary of a second end of each direction range. The signal processor may be configured to process the extraction signal into a post-processed extraction signal for each of the direction ranges.

The output signal generator may include a signal processor, a synthesizer, and a converter. The signal processor may be configured to process the extraction signal into a post-processed extraction signal for each of the direction ranges. The synthesizer may be configured to synthesize the post-processed extraction signal into a synthesized signal for each predefined output channel for each of the direction ranges. The converter may be configured to convert the each of the synthesized signals into a respective one of the output time domain signal.

In some embodiments, the second operator device may be configured to set the second reference point, the first function, and the second function to be the same for at least some of the direction ranges. In some embodiments, the signal processor may be configured to distribute the signal of each input channel in conformance with the output channels. The signal processor may be configured to process each of the distributed signals. The output terminal may comprise a plurality of output terminals each of which corresponds to one of the distributed signals. The second operator device may be configured to set for the direction range of the distributed signals: a second reference point, a first function establishing expansion of a boundary of a first end of the direction range, and a second function establishing expansion of a boundary of a second end of the direction range. The processor may be configured to shift the output direction for each of the distributed signals.

In various embodiments, the first operator device may be configured to set a plurality of direction ranges for the output direction. The processor may be configured to determine whether the output direction of the audio signal is within each of the direction ranges. The processor may be configured to extract the extraction signal. The extraction signal may comprise the signal of each of the input channels in the frequency band corresponding to the localization information having the output direction that is judged to be in each of the direction ranges. The second operator device may be configured to set for each of the direction ranges: a second reference point for each direction range, a first function establishing expansion of a boundary of a first end of each direction range, and a second function establishing expansion of a boundary of a second end of each direction range. The signal processor may be configured to process the extraction signal into a post-processed extraction signal for each of the direction ranges.

The output signal generator may include a signal processor, a synthesizer, and a converter. The signal processor may be configured to process the extraction signal into a post-processed extraction signal for each of the direction ranges. The converter may be configured to convert the post-processed extraction signal into a time domain extraction signal for each of the direction ranges. The synthesizer may be configured to synthesize each of the time domain extraction signals for each predefined output channel for each of the direction ranges into a respective one of the output time domain signal.

In some embodiments, the second operator device may be configured to set the second reference point, the first function, and the second function to be the same for at least some of the direction ranges. In some embodiments, the signal processor may be configured to distribute the signal of each input channel in conformance with the output channels. The signal processor may be configured to process each of the distributed signals. The output terminal may comprise a plurality of output terminals each of which corresponds to one of the distributed signals. The second operator device may be configured to set for the direction range of the distributed signals: a second reference point, a first function establishing expansion of a boundary of a first end of the direction range, and a second function establishing expansion of a boundary of a second end of the direction range. The processor may be configured to shift the output direction for each of the distributed signals.

In various embodiments, the first operator device may be configured to set a plurality of direction ranges for the output direction. The processor may be configured to determine whether the output direction of the audio signal is within each of the direction ranges. The processor may be configured to extract the extraction signal. The extraction signal may comprise the signal of each of the input channels in the frequency band corresponding to the localization information having the output direction that is judged to be in each of the direction ranges. The second operator device may be configured to set for each of the direction ranges: a second reference point for each direction range, a first function establishing expansion of a boundary of a first end of each direction range, and a second function establishing expansion of a boundary of a second end of each direction range. The signal processor may be configured to process the extraction signal into a post-processed extraction signal for each of the direction ranges.

The output signal generator may include a signal processor, a synthesizer, and a converter. The converter may be configured to convert the post-processed extraction signal into a time domain extraction signal for each of the direction ranges. The signal processor configured to process the time domain extraction signal into a respective time domain post-processed extraction signal. The synthesizer may be configured to synthesize the time domain post-processed extraction signal for each predefined output channel for each of the direction ranges into a respective one of the output time domain signal.

In some embodiments, the second operator device may be configured to set the second reference point, the first function, and the second function to be the same for at least some of the direction ranges. In some embodiments, the signal processor may be configured to distribute the signal of each input channel in conformance with the output channels. The signal processor may be configured to process each of the distributed signals. The output terminal may comprise a plurality of output terminals each of which corresponds to one of the distributed signals. The second operator device may be configured to set for the direction range of the distributed signals: a second reference point, a first function establishing expansion of a boundary of a first end of the direction range, and a second function establishing expansion of a boundary of a second end of the direction range. The processor may be configured to shift the output direction for each of the distributed signals.

In various embodiments, the processor may be configured to sort the output directions of consecutive frequency ranges to alternate between the first end and the second end of the direction range.

A musical tone signal processing system may include (but is not limited to) an input terminal, a first operator device, a second operator device, a processor, an output signal generator, and an output terminal. The input terminal may be configured to input a monaural audio signal. The monaural audio signal may have a plurality of frequency bands. The first operator device may be configured to set at least one of a set of a direction range that includes an output direction of the monaural audio signal and a bandwidth of the frequency bands. The output direction may be equal to a first reference point that is preset. The second operator device may be configured to set, for each of the at least one set, a second reference point, a first function establishing expansion of a boundary of a first end of the direction range, and a second function establishing expansion of a boundary of a second end of the direction range.

The processor may be configured to calculate a signal level for each of the frequency bands. The processor may be configured to extract, for the at least one set, the monaural audio signal of the frequency bands that are within each bandwidth. The processor may be configured to sort the output directions such that the output directions alternate in each of the consecutive frequency ranges to the first end and the second end of the direction range. The processor may be configured to expand or contract an acoustic image by shifting the output direction of an extraction signal, that has localization information located closer to the boundary of the first end of the direction range than the second reference point, based on mapping of the first function, and shifting the output direction of an extraction signal, that has localization information located closer to the boundary of the second end of the direction range than the second reference point, based on mapping of the second function.

The output signal generator may be configured to generate an output time domain signal for each preset output channel.

The output terminal may be configured to output the output time domain signal to each of the output channels.

In various embodiments, the monaural audio signal may comprise a signal of a single input channel. In various embodiments, the monaural audio signal may be provided by a signal of a plurality of input channels that are synthesized into the monaural audio signal.

BRIEF DESCRIPTION OF THE DRAWINGS

FIG. 15(*b*) is a flowchart of a domain setting processing according to an embodiment of the present invention;

DETAILED DESCRIPTION

Figure 1:
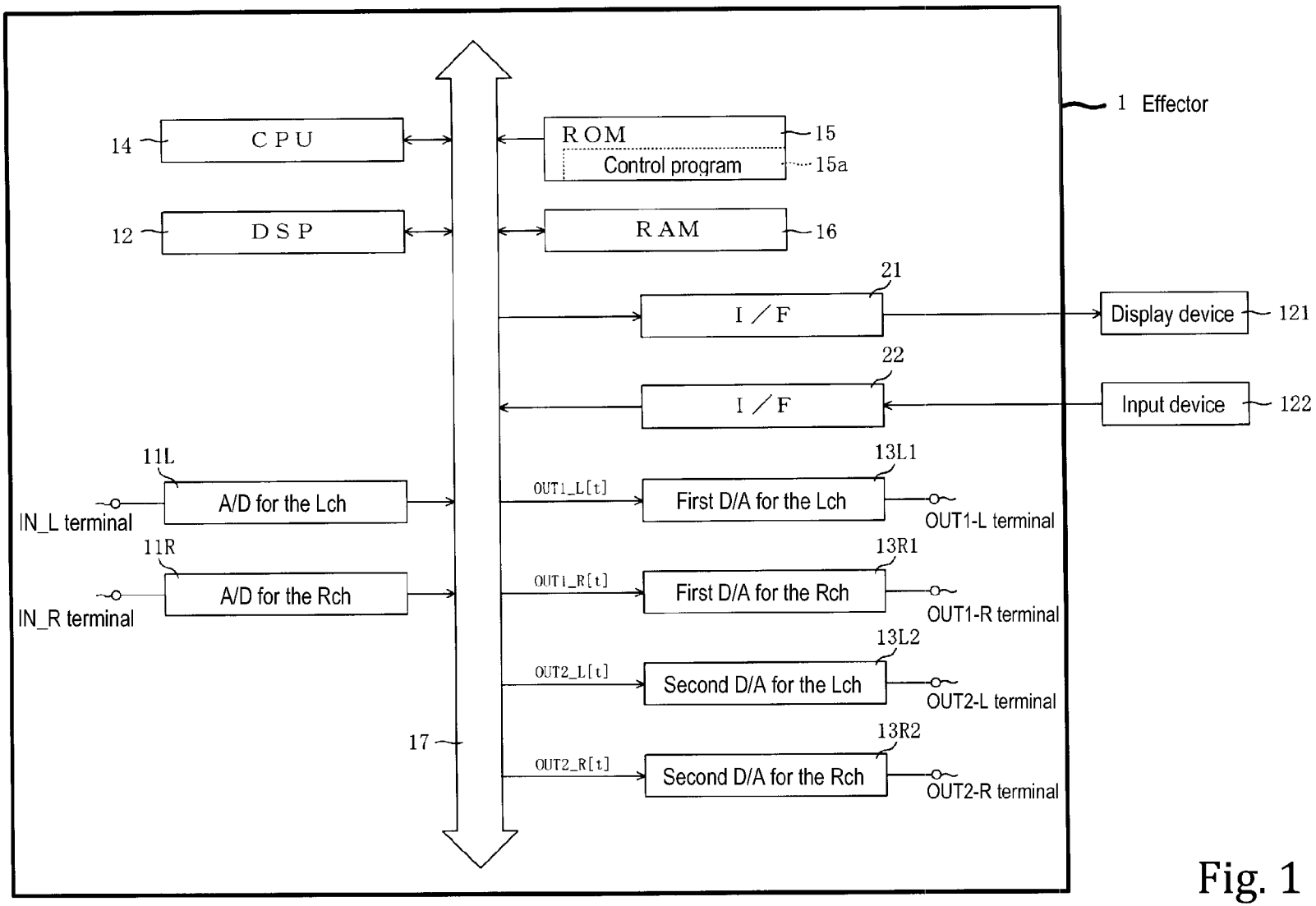
FIG. 1 is a block diagram of a musical tone signal processing system according to an embodiment of the present invention.

FIG. 1 is a block diagram of a musical tone signal processing system, such as an effector 1, according to an embodiment of the present invention. The effector 1 may be configured to extract a musical tone signal that is signal processed (hereinafter, referred to as the "extraction signal") for each of the plurality of conditions.

The effector 1 may include (but is not limited to) an analog to digital converter ("A/D converter") for a Lch 11L, an A/D converter for a Rch 11R, a digital signal processor ("DSP") 12, a first digital to analog converter ("D/A converter") for the Lch 13L1, a first D/A converter for a Rch 13R1, a second D/A converter for a Lch 13L2, a second D/A converter for a Rch 13R2, a CPU 14, a ROM 15, a RAM 16, an I/F 21, an I/F 22, and a bus line 17. The I/F 21 is an interface for operation with a display device 121. In addition, the I/F 22 is an interface for operation with an input device 122. The components 11 through 16, 21, and 22 are electrically connected via the bus line 17.

The A/D converter for the Lch 11L converts the left channel signal (a portion of the musical tone signal) that has been input in an IN_L terminal from an analog signal to a digital signal. Then, the A/D converter for the Lch 11L outputs the left channel signal that has been digitized to the DSP 12 via the bus line 17. The A/D converter for the Rch 11R converts the right channel signal (a portion of the musical tone signal) that has been input in an IN_R terminal from an analog signal to a digital signal. Then, the A/D converter for the Rch 11R outputs the right channel signal that has been digitized to the DSP 12 via the bus line 17.

The DSP 12 is a processor. When the left channel signal that has been output from the A/D converter for the Lch 11L and the right channel signal that has been output from the A/D converter for the Rch 11R are input to the DSP 12, the DSP 12 performs signal processing on the left channel signal and the right channel signal. In addition, the left channel signal and the right channel signal on which the signal processing has been performed are output to the first D/A converter for the Lch 13L1, the first D/A converter for the Rch 13R1, the second D/A converter for the Lch 13L2, and the second D/A converter for the Rch 13R2.

The first D/A converter for the Lch 13L1 and the second D/A converter for the Lch 13L2 convert the left channel signal on which signal processing has been performed by the DSP 12 from a digital signal to an analog signal. In addition, the analog signal is output to output terminals (OUT 1_L terminal and OUT 2_L terminal) that are connected to the L channel side of the speakers (not shown). Incidentally, the left channel signals upon which the signal processing has been performed independently by the DSP 12 are respectively output to the first D/A converter for the Lch 13L1 and the second D/A converter for the Lch 13L2.

The first D/A converter for the Rch 13R1 and the second D/A converter for the Rch 13R2 convert the right channel signal on which signal processing has been performed by the DSP 12 from a digital signal to an analog signal. In addition, the analog signal is output to output terminals (the OUT 1_R terminal and the OUT 2_R terminal) that are connected to the R channel side of the speakers (not shown). Incidentally, the right channel signals on which the signal processing has been done independently by the DSP 12 are respectively output to the first D/A converter for the Rch 13R1 and the second D/A converter for the Rch 13R2.

The CPU 14 is a central control unit (e.g., a computer processor) that controls the operation of the effector 1. The ROM 15 is a write only memory in which the control programs 15*a* (e.g., FIGS. 2-6), which is executed by the effector 1, are stored. The RAM 16 is a memory for the temporary storage of various kinds of data.

The display device 121 that is connected to the I/F 21 is a device that has a display screen that is configured by a LCD, LED, and/or the like. The display device 121 displays the musical tone signals that have been input to the effector 1 via the A/D converters 11L and 11R and the post-processed musical tone signals in which signal processing has been done on the musical tone signals that are input to the effector 1.

The input device 122 that is connected to the I/F 22 is a device for the input of each type of execution instruction that is supplied to the effector 1. The input device 122 is configured by, for example, a mouse, or a tablet, or a keyboard, or the like. In addition, the input device 122 may also be configured as a touch panel that senses operations that are made on the display screen of the display device 121.

Figure 2:
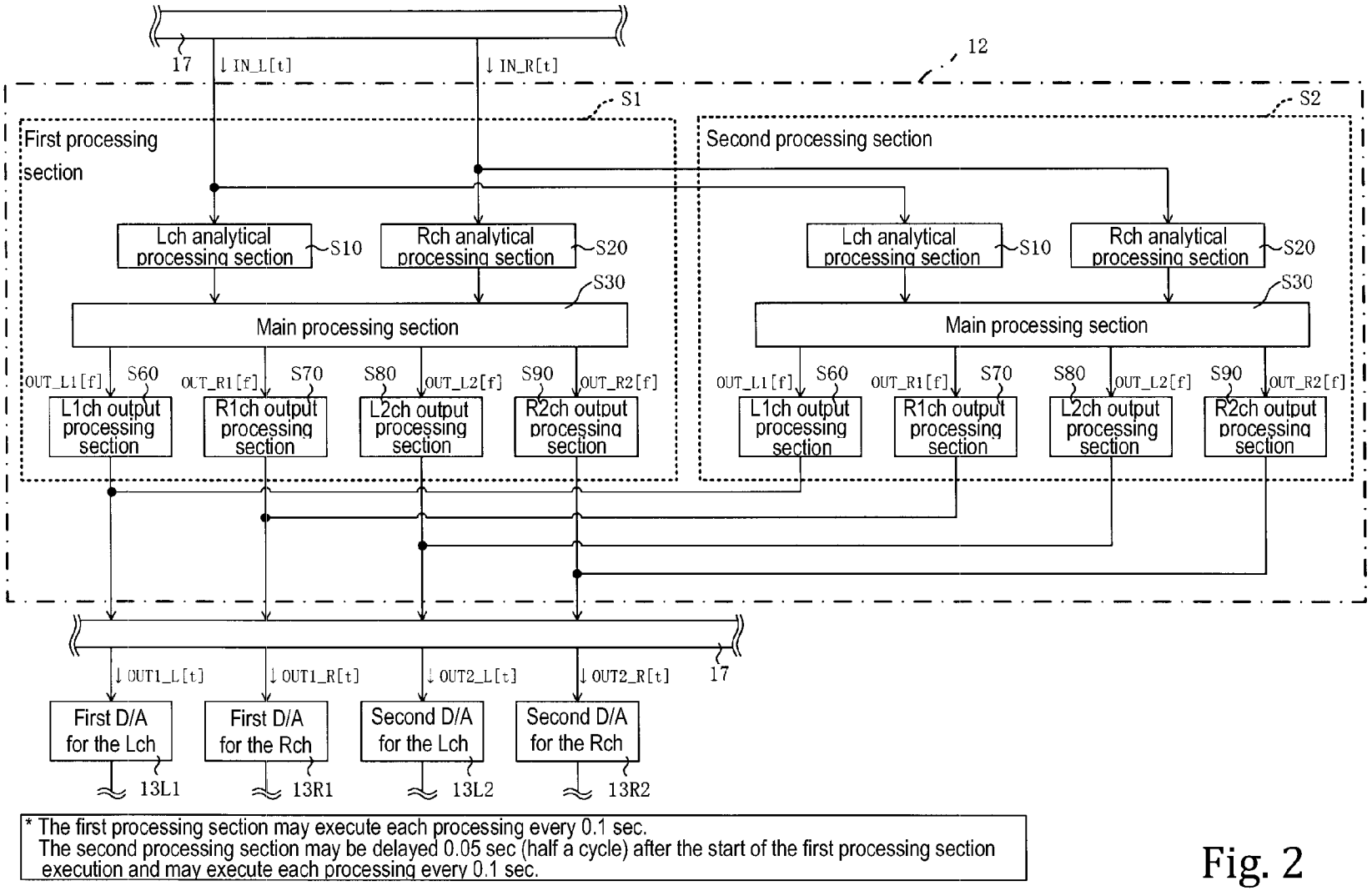
FIG. 2 is a schematic drawing of a process executed by a processor according to an embodiment of the present invention.

The DSP 12 repeatedly executes the processes shown in FIG. 2 during the time that the power to the effector 1 is provided. With reference to FIGS. 1 and 2, the DSP 12 includes a first processing section S1 and a second processing section S2.

The DSP 12 inputs an IN_L[t] signal and an IN_R[t] signal and executes the processing in the first processing section S1 and the second processing section S2. The IN_L[t] signal is a left channel signal in the time domain that has been input from the IN_L terminal. The IN_R[t] signal is a right channel signal in the time domain that has been input from the IN_R terminal. The [t] expresses the fact that the signal is denoted in the time domain.

The processing in the first processing section S1 and the second processing section S2 here are identical processing and are executed at each prescribed interval. However, it should be noted that the execution of the processing in the second processing section S2 is delayed a prescribed period from the start of the execution of the processing in the first processing section S1. Accordingly, the processing in the second processing section S2 allows the end of the execution of the processing in the second processing section S2 to overlap with the start of the execution of the processing in the first processing section S1. Likewise, the processing in the first processing section S1 allows the end of the execution of the processing in the first processing section S1 to overlap with the start of the execution of the processing in the second processing section S2. Therefore, the signal, in which the signal that has been produced by the first processing section S1 and the signal that has been produced by the second processing section S2 have been synthesized, is prevented from becoming discontinuous. The signals that have been synthesized are output from the DSP 12. The signals include the first left channel signal in the time domain (hereinafter, referred to as the "OUT1_L[t] signal") and the first right channel signal in the time domain (hereinafter, referred to as the "OUT1_R[t] signal"). In addition the signals include the second left channel signal in the time domain (hereinafter, referred to as the "OUT2_L[t] signal") and the second right channel signal in the time domain (hereinafter, referred to as the "OUT2_R[t] signal").

In some embodiments, the first processing section S1 and the second processing section S2 are set to be executed every 0.1 seconds. In addition, the processing in the second processing section S2 is set to have the execution started 0.05 seconds after the start of the execution of the processing in the first processing section S1. However, the execution interval for the first processing section S1 and the second processing section S2 is not limited to 0.1 seconds. In addition, the delay time from the start of the execution of the processing in the first processing section S1 to the start of the execution of the processing in the second processing section S2 is not limited to 0.05 seconds. Thus, in other embodiments, other values in conformance with the sampling frequency and the number of musical tone signals as the occasion demands may be used.

Each of the first processing section S1 and the second processing section S2 have a Lch analytical processing section S10, a Rch analytical processing section S20, a main processing section S30, a L1ch output processing section S60, a R1ch output processing section S70, a L2ch output processing section S80, and a R2ch output processing section S90.

The Lch analytical processing section S10 converts and outputs the IN_L[t] signal to an IN_L[f] signal. The Rch analytical processing section S20 converts and outputs the IN_R[t] signal to an IN_R[f] signal. The IN_L[f] signal is a left channel signal that is denoted in the frequency domain. The IN_R[f] signal is a right channel signal that is denoted in the frequency domain. The [f] expresses the fact that the signal is denoted in the frequency domain. Incidentally, the details of the Lch analytical processing section S10 and the Rch analytical processing section S20 will be discussed later while referring to FIG. 3.

Returning to FIG. 2, the main processing section S30 performs the first signal processing, the second signal processing, and the other retrieving processing (i.e., processing of the unspecified signal) (discussed later) on the IN_L[f] signal that has been input from the Lch analytical processing section S10 and the IN_R[f] signal that has been input from the Rch analytical processing section S20. In addition, the main processing section S30 outputs the left channel signal and the right channel signal that are denoted in the frequency domain based on output results from each process. Incidentally, the details of the processing of the main processing section S30 will be discussed later while referring to FIGS. 4 through 6.

Returning to FIG. 2, the L1ch output processing section S60 converts the OUT_L1[f] signal to the OUT1_L[t] signal in those cases where the OUT_L1[f] signal has been input. The OUT_L1[f] signal here is one of the left channel signals that are denoted in the frequency domain that have been output by the main processing section S30. In addition, the OUT1_L[t] signal is a left channel signal that is denoted in the time domain.

The R1ch output processing section S70 converts the OUT_R1[f] signal to the OUT1_R[t] signal in those cases where the OUT_R1[f] signal has been input. The OUT_R1[f] signal here is one of the right channel signals that are denoted in the frequency domain that have been output by the main processing section S30. In addition, the OUT1_R[t] signal is a right channel signal that is denoted in the time domain.

The L2ch output processing section S80 converts the OUT_L2[f] signal to the OUT2_L[t] signal in those cases where the OUT_L2[f] signal has been input. The OUT_L2[f] signal here is one of the left channel signals that are denoted in the frequency domain that have been output by the main processing section S30. In addition, the OUT2_L[t] signal is a left channel signal that is denoted in the time domain.

The R2ch output processing section S90 converts the OUT_R2[f] signal to the OUT2_R[t] signal in those cases where the OUT_R2[f] signal has been input. The OUT_R2[f] signal here is one of the right channel signals that are denoted in the frequency domain that have been output by the main processing section S30. In addition, the OUT2_R[t] signal is a right channel signal that is denoted in the time domain. The details of the Lich output processing section S60, the R1ch output processing section S70, the L2ch output processing section S80, and the R2ch output processing section S90 will be discussed later while referring to FIG. 3.

The OUT1_L[t] signal, OUT1_R[t] signal, OUT2_L[t] signal, and OUT2_R[t] signal that are output from the first processing section S1, and the OUT1_L[t] signal, OUT1_R[t] signal, OUT2_L[t] signal, and OUT2_R[t] signal that are output from the second processing section S2 are synthesized by cross fading.

Figure 3:
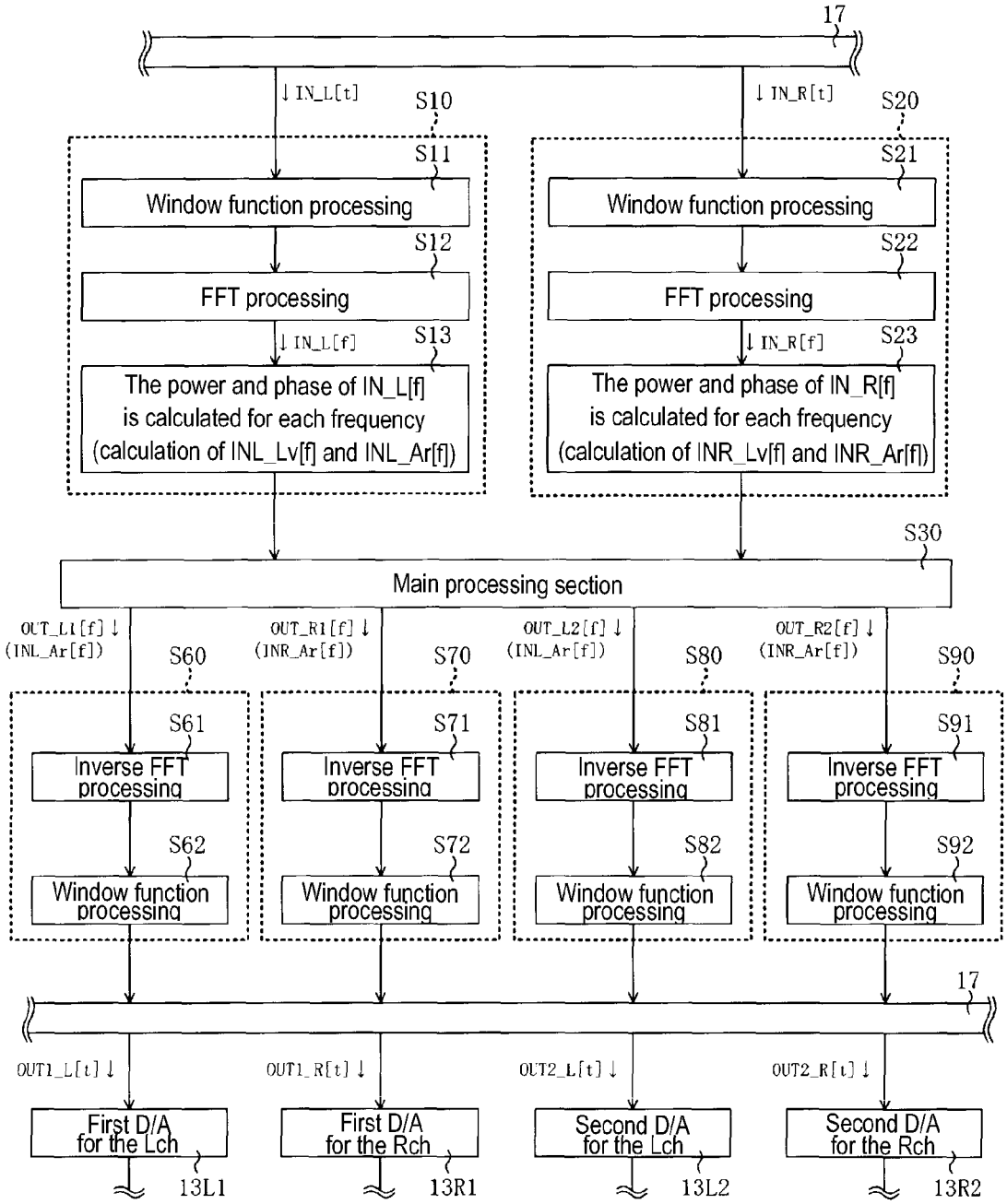
FIG. 3 is a drawing of a process executed at various stages according to an embodiment of the present invention.

Next, an explanation will be given regarding the details of the processing (excluding the main processing section 30) that is executed by the Lch analytical processing section S10, the Rch analytical processing section S20, the L1ch output processing section S60, the R1ch output processing section S70, the L2ch output processing section S80, and the R2ch output processing section S90. FIG. 3 is a drawing that shows the processing that is executed by each section S10, S20, and S60 through S90.

First of all, an explanation will be given regarding the Lch analytical processing section S10 and the Rch analytical processing section S10. First, window function processing, which is processing that applies a Hanning window, is executed for the IN_L[t] signal (S11). After that, a fast Fourier transform (FFT) is carried out for the IN_L[t] signal (S12). Using the FFT, the IN_L[t] signal is converted into an IN_L[f] signal. (For this spectral signal, each frequency f that has been Fourier transformed is on a horizontal axis.) Incidentally, the IN_L[f] signal is expressed by a formula that has a real part and an imaginary part (hereinafter, referred to as a "complex expression"). In the processing of S11, the application of the Hanning window for the IN_L[t] signal is in order to mitigate the effect that the starting point and the end point of the IN_L[t] signal that has been input has on the fast Fourier transform.

After the processing of S12, the level of the IN_L[f] signal (hereinafter, referred to as "INL_Lv[f]") and the phase of the IN_L[f] signal (hereinafter, referred to as "INL_Ar[f]") are calculated by the Lch analytical processing section S10 (S13). Specifically, INL_Lv[f] is derived by adding together the value in which the real part of the complex expression of the IN_L[f] signal has been squared and the value in which the imaginary part of the complex expression of the IN_L[f] signal has been squared and calculating the square root of the addition value. In addition, INL_Ar[f] is derived by calculating the arc tangent (tan ^(−1)) of the value in which the imaginary part of the complex expression of the IN_L[f] signal has been divided by the real part. After the processing of S13, the routine shifts to the processing of the main processing section S30.

The processing of S21 through S23 is carried out for the IN_R[t] signal by the Rch analytical processing section S20. Incidentally, the processing of S21 through S23 is processing that is the same as the processing of S11 through S13. Therefore, a detailed explanation of the processing of S21 through S23 will be omitted. However, it should be noted that the processing of S21 through S23 differs from the processing of S11 through S13 in that the IN_R[t] signal and the IN_R[f] signal differ. Incidentally, after the processing of S23, the routine shifts to the processing of the main processing section S30.

Next, an explanation will be given regarding the L1ch output processing section S60, the R1ch output processing section S70, the L2ch output processing section S80, and the R2ch output processing section S90.

In the L1ch output processing section S60, first, an inverse fast Fourier transform (inverse FFT) is executed (S61). In this processing, specifically, the OUT_L1[f] signal that has been calculated by the main processing section S30 and the INL_Ar[f] that has been calculated by the processing of S13 of the Lch analytical processing section S10 are used, the complex expression is derived, and an inverse fast Fourier transform is carried out on the complex expression.

After that, window function processing, in which a window that is identical to the Hanning window that was used by the Lch analytical processing section S10 and the Rch analytical processing section S20 is applied, is executed (S62). For example, if the window function used by the Lch analytical processing section S10 and the Rch analytical processing section S20 is a Hanning window, the Hanning window is applied to the value that has been calculated by the inverse Fourier transform in the processing of S62 also. As a result, the OUT1_L[t] signal is generated. Incidentally, in the processing of S62, the application of the Hanning window to the value that has been calculated with the inverse FFT is in order to synthesize while cross fading the signals that are output by each output processing section S60 through S90.

The R1ch output processing section S70 carries out the processing of S71 through S72. Incidentally, the processing of S71 through S72 is the same as the processing of S61 through S62. However, it should be noted that the values of the OUT_R1[f] signal (calculated by the main processing section S30) and of the INR_Ar[f] (calculated by the processing of S23) that are used at the time that the complex expression is derived with the inverse FFT differs from the processing of S61 through S62. Other than that, the processing is identical to the processing of S61 through S62. Therefore, a detailed explanation of the processing of S71 through S72 will be omitted.

In addition, the processing of S81 through S82 is carried out by the L2ch output processing section S80. Incidentally, the processing of S81 through S82 is the same as the processing of S61 through S62. However, it should be noted that the value of the OUT_L2[f] signal that has been calculated by the main processing section 30 that is used at the time that the complex expression is derived with the inverse FFT differs from the processing of S61 through S62. Incidentally, INL_Ar[f] that has been calculated by the processing of S13 of the Lch analytical processing section S10 is the same as the processing of S61 through S62. Other than that, the processing is identical to the processing of S61 through S62. Therefore, a detailed explanation of the processing of S81 through S82 will be omitted.

In addition, the R2ch output processing section S90 carries out the processing of S91 through S92. Incidentally, the processing of S91 through S92 is the same as the processing of S61 through S62. However, it should be noted that the values of the OUT_R2[f] signal that has been calculated by the main processing section S30 and of INR_Ar[f] that has been calculated by the processing of S23 of the Rch analytical processing section S20 that are used at the time that the complex expression is derived with the inverse FFT differs from the processing of S61 through S62. Other than that, the processing is identical to the processing of S61 through S62. Therefore, a detailed explanation of the processing of S91 through S92 will be omitted.

Figure 4:
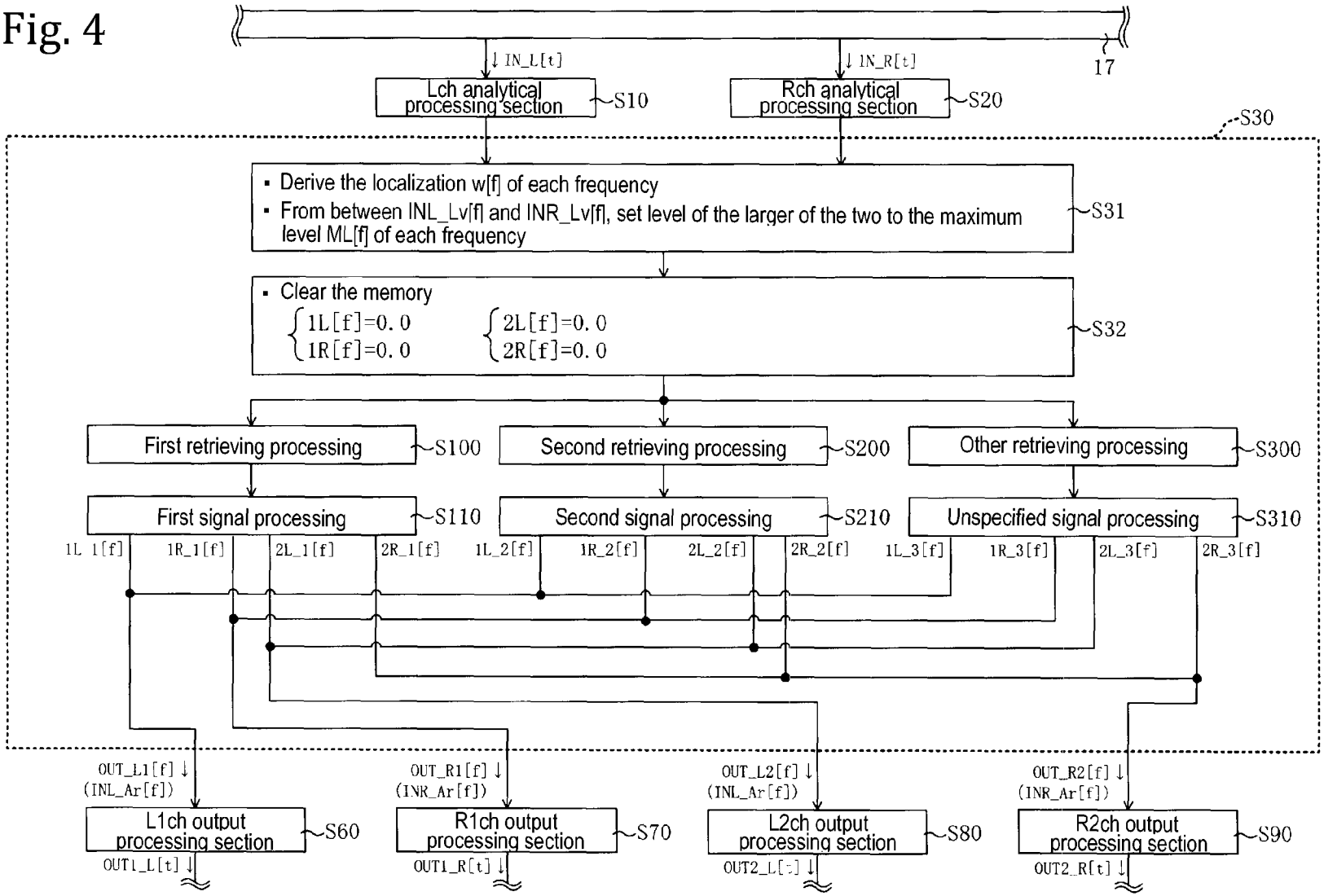
FIG. 4 is a drawing of a process executed during a main process according to an embodiment of the present invention.

Next, an explanation will be given regarding the details of the processing that is executed by the main processing section S30 while referring to FIG. 4. FIG. 4 is a drawing that shows the processing that is executed by the main processing section S30.

First, the main processing section 30 derives the localization w[f] for each of the frequencies that have been obtained by the Fourier transforms (S12 and S22 in FIG. 3) that have been carried out for the IN_L[t] signal and the IN_R[t] signal. In addition, the larger of the levels between INL_Lv[f] and INR_Lv[f] is set as the maximum level ML[f] for each frequency (S31). The localization w[f] that has been derived and the maximum level ML[f] that has been set by S31 are stored in a specified region of the RAM 16 (FIG. 1). Incidentally, in S31, the localization w[f] is derived by $(1/\pi)\times(\arctan(INR_Lv[f]/INL_Lv[f])+0.25$. Therefore, in a case where the musical tone has been received at any arbitrary reference point (i.e., in a case where IN_L[t] and IN_R[t] have been input at any arbitrary reference point), if INR_Lv[f] is sufficiently great with respect to INL_Lv[f], the localization w[f] becomes 0.75. On the other hand, if INL_Lv[f] is sufficiently great with respect to INR_Lv[f], the localization w[f] becomes 0.25.

Next, the memory is cleared (S32). Specifically, 1L[f] memory, 1R[f] memory, 2L[f] memory, and 2R[f] memory, which have been disposed inside the RAM 16 (FIG. 1), are zeroed. Incidentally, the 1L[f] memory and the 1R[f] memory are memories that are used in those cases where the localization that is formed by the OUT_L1[f] signal and the OUT_R1[f] signal, which are output by the main processing section S30, is changed. In addition, the 2L[f] memory and the 2R[f] memory are memories that are used in those cases where the localization that is formed by the OUT_L2[f] signal and the OUT_R2[f] signal, which are output by the main processing section S30, is changed.

After the execution of S32, first retrieving processing (S100), second retrieving processing (S200), and other retrieving processing (S300) are each executed. The first retrieving processing (S100) is processing that extracts the signal that becomes the object of the performance of the signal processing (i.e., the extraction signal) under the first condition that has been set in advance. The second retrieving processing (S200) is processing that extracts the extraction signal under the second condition that has been set in advance.

In addition, the other retrieving processing (S300) is processing that extracts the signals except for the extraction signals under the first condition and the extraction signals under the second condition. Incidentally, the other retrieving processing (S300) uses the processing results of the first retrieving processing (S100) and the second retrieving processing (S200). Therefore, this is executed after the completion of the first retrieving processing (S100) and the second retrieving processing (S200).

After the execution of the first retrieving processing (S100), the first signal processing, which performs signal processing on the extraction signal, which has been extracted by the first retrieving processing (S100), is executed (S110). In addition, after the execution of the second retrieving processing (S200), the second signal processing, which performs signal processing on the extraction signal (extracted by the second retrieving processing (S200)), is executed (S210). Furthermore, after the execution of the other retrieving processing (S300), the unspecified signal processing, which performs signal processing on the extraction signal that has been extracted by that processing (S300), is executed (S310).

An explanation will be given here regarding the first retrieving processing (S100), the first signal processing (S110), the second retrieving processing (S200), and the second signal processing (S210) while referring to FIG. 5. In addition, an explanation will be given regarding the other retrieving processing (S300) and the unspecified signal processing (S310) while referring to FIG. 6.

First, with reference to FIG. 5, an explanation will be given regarding the first retrieving processing (S100), the first signal processing (S110), the second retrieving processing (S200), and the second signal processing (S210). FIG. 5 is a drawing that shows the details of the processing that is carried out by the first retrieving processing (S100), the first signal processing (S110), the second retrieving processing (S200), and the second signal processing (S210).

In the first retrieving processing (S100), a judgment is made as to whether the musical tone signal satisfies the first condition (S101). Specifically, the first condition is, whether the frequency f is within the first frequency range that has been set in advance and, moreover, whether or not the localization w[f] and the maximum level ML[f] of the frequency that is within the first frequency range are respectively within the first setting range that has been set in advance.

In those cases where the musical tone signal satisfies the first condition (S101: yes), the musical tone of the frequency f (the left channel signal and the right channel signal) is judged to be the extraction signal. Then, 1.0 is assigned to the array rel[f][1] (S102). (Incidentally, in the drawing, the "1(L)" portion of the "array rel" is shown as a cursive L.) The frequency at the point in time when a judgment of "yes" has been made by S101 is assigned to the "f" of the array rel[f][1]. In addition, the [1] of the array rel [f][1] indicates the fact that the array rel[f][1] is the extraction signal of the first retrieving processing (S100).

In those cases where the musical tone signal does not satisfy the first condition (S101: no), the musical tone of that frequency f (the left channel signal and the right channel signal) is judged to not be the extraction signal. Then, 0.0 is assigned to the array rel[f][1] (S103).

After the processing of S102 or S103, a judgment is made as to whether the processing of S101 has completed for all of the frequencies that have been Fourier transformed (S104). In those cases where the judgment of S104 is negative (S104: no), the routine returns to the processing of S101. On the other hand, in those cases where the judgment of S104 is affirmative (S104: yes), the routine shifts to the first signal processing (S110).

In the first signal processing (S110), the level of the 1L[f] signal that becomes a portion of the OUT_L1[f] signal is adjusted and together with this, the level of the 1R[f] signal that becomes a portion of the OUT_R1[f] signal is adjusted. With the first signal processing (S110), the processing of S111 that adjusts the localization, which is formed by the extraction signal in the first retrieving processing (S100), of the portion that is output from the main speakers is carried out.

In addition, in parallel with the processing of S111, the level of the 2L[f] signal that becomes a portion of the OUT_L2[f] signal is adjusted and together with this, the level of the 2R[f] signal that becomes a portion of the OUT_R2[f] signal is adjusted in the first signal processing (S110). With the first signal processing (S110), the processing of S114 that adjusts the localization, which is formed by the extraction signal in the first retrieving processing (S100), of the portion that is output from the sub-speakers is carried out.

In the processing of S111, the 1L[f] signal that becomes a portion of the OUT_L1[f] signal is calculated. Specifically, the following computation is carried out for all of the frequencies that have been obtained by the Fourier transforms that have been done to the IN_L[t] signal and the IN_R[t] signal (S12 and S22 in FIG. 3): $(INL_Lv[f]\times ll+INR_Lv[f]\times lr)\times rel[f][1]\times a$.

In the same manner, the 1R [f] signal that becomes a portion of the OUT_R1[f] signal is calculated in the processing of S111. Specifically, the following computation is carried out for all of the frequencies that have been Fourier transformed in S12 and S22 (FIG. 3): $(INL_Lv[f]\times rl+INR_Lv[f]\times rr)\times rel[f][1]\times a$.

In the above computations, a is a coefficient that has been specified in advance for the first signal processing. In addition, ll, lr, rl, and rr are coefficients that are determined in conformance with the localization w[f], which is derived from the musical tone signal (the left channel signal and the right channel signal), and the localization that is the target (e.g., a value in the range of 0.25 through 0.75), which has been specified in advance for the first signal processing. (Incidentally, l is written as a cursive l in FIG. 5.)

Figure 7A:
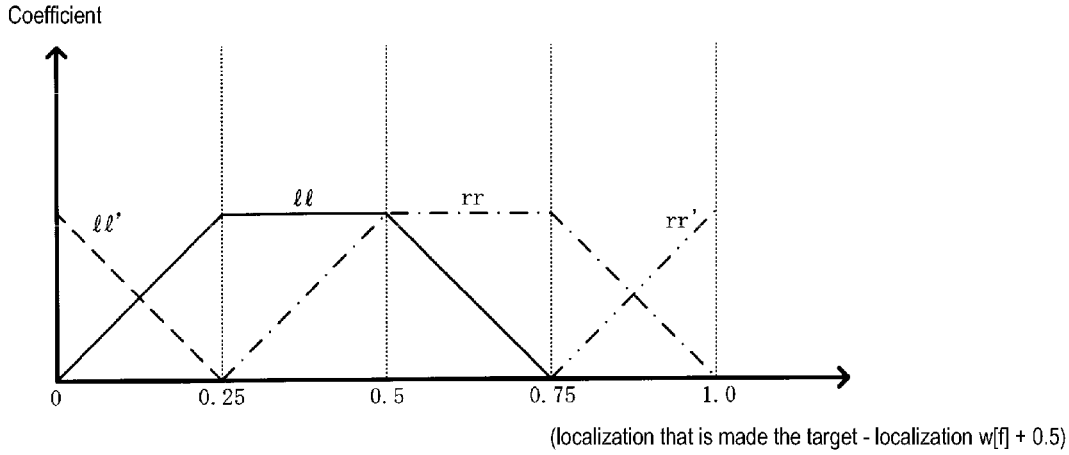
FIGS. 7(*a*) and (*b*) are graphs illustrating coefficients determined in accordance with the localization w[f] and the localization that is the target according to an embodiment of the present invention.
Figure 7B:
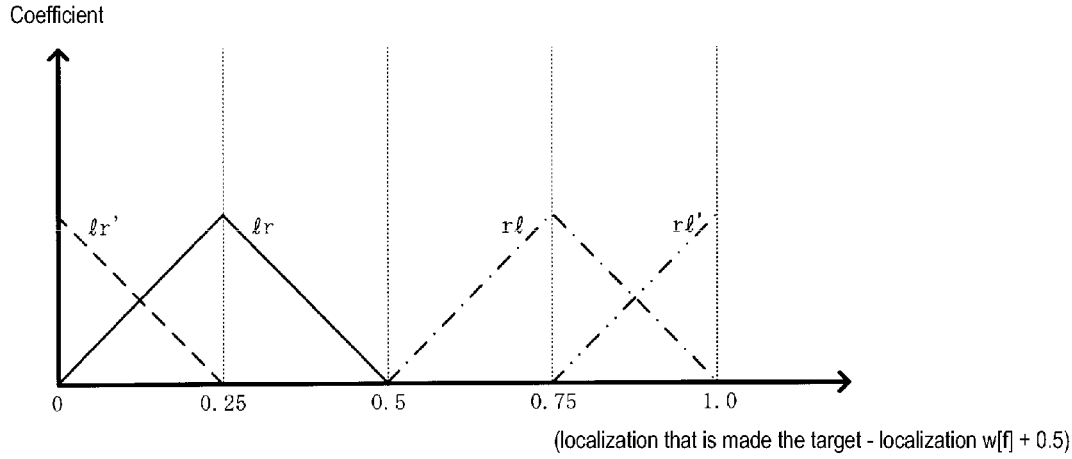

An explanation will be given regarding ll, lr, rl, and rr while referring to FIGS. 7(*a*) and 7(*b*). FIGS. 7(*a*) and 7(*b*) are graphs that help explain each coefficient that is determined in conformance with the localization w[f] and the localization that is the target. In the graphs of FIGS. 7(*a*) and 7(*b*), the horizontal axis is the value of (the localization that is the target−the localization w[f]+0.5) and the vertical axis is each coefficient (ll, lr, rl, rr, ll', lr', rl', and rr').

The coefficients of ll and rr are shown in FIG. 7(*a*). Therefore, in those cases where the value of "the localization that is the target−the localization w[f]+0.5" is 0.5, ll and rr become coefficients that are both their maximums. Conversely, the coefficients of lr and rl are shown in FIG. 7(*b*). In those cases where the value of "the localization that is the target−the localization w[f]+0.5" is 0.5, lr and rl become coefficients that are both their minimums (zero).

Returning to FIG. 5, after the processing of S111, finishing processing that changes the pitch, changes the level, or imparts reverb is carried out for the 1L[f] signal (S112). Incidentally, with regard to pitch changing, level changing, and imparting reverb (so-called convolution reverb) these are all commonly known technologies. Therefore, concrete explanations of these will be omitted.

When the processing of S112 is carried out for the 1L[f] signal, the 1L_1[f] signal that configures the OUT_L1[f] signal is produced. In the same manner, after the processing of S111, processing that changes the pitch, changes the level, or imparts reverb is carried out for the 1R[f] signal (S113). When the finishing processing of S113 is carried out for the 1R[f] signal, the 1R_1[f] signal that configures the OUT_R1[f] signal is produced.

In addition, in the processing of S114, the 2L[f] signal that becomes a portion of the OUT_L2[f] signal is calculated. Specifically, the following computation is carried out for all of the frequencies that have been obtained by the Fourier transforms that have been done to the IN_L[t] signal and the IN_R[t] signal (S12 and S22 in FIG. 3): (INL_Lv[f]×ll'+INR_Lv[f]×lr')×rel[f][1]×b.

In the same manner, the 2R [f] signal that becomes a portion of the OUT_R2[f] signal is calculated in the processing of S114. Specifically, the following computation is carried out for all of the frequencies that have been Fourier transformed in S12 and S22 (FIG. 3): (INL_Lv[f]×rl'+INR_Lv[f]×rr')×rel[f][1]×b.

Incidentally, b is a coefficient that has been specified in advance for the first signal processing. The coefficient b may be the same as the coefficient a. In other embodiments, the coefficient b may be different from the coefficient a. In addition, ll', lr', rl', and rr' are coefficients that are determined in conformance with the localization w[f], which is derived from the musical tone signal, and the localization that is the target (e.g., a value in the range of 0.25 through 0.75), which has been specified in advance for the first signal processing.

An explanation will be given regarding ll', lr,' rl', and rr' while referring to FIGS. 7(*a*) and 7(*b*). The relationship between ll' and rr' is as shown in FIG. 7(*a*). In those cases where the value of "the localization that is the target−the localization w[f]+0.5" is 0.0, ll' becomes a maximum coefficient while on the other hand, rr' becomes a minimum (zero) coefficient. Conversely, in those cases where the value of "the localization that is the target−the localization w[f]+0.5" is 1.0, ll' becomes a minimum (zero) coefficient while on the other hand, rr' becomes a maximum coefficient.

The relationship between lr' and rl' is shown in FIG. 7(*b*). In those cases where the value of "the localization that is the target−the localization w[f]+0.5" is 0.0, lr' becomes a maximum coefficient while on the other hand, rl' becomes a minimum (zero) coefficient. Conversely, in those cases where the value of "the localization that is the target−the localization w[f]+0.5" is 1.0, lr' becomes a minimum (zero) coefficient while on the other hand, rl' becomes a maximum coefficient.

Returning to FIG. 5, after the processing of S114, finishing processing that changes the pitch, changes the level, or imparts reverb is carried out for the 2L[f] signal (S115). When the processing of S115 is carried out for the 2L[f] signal, the 2L_1[f] signal that configures the OUT_L2[f] signal is produced. In the same manner, after the processing of S114, finishing processing that changes the pitch, changes the level, or imparts reverb is carried out for the 2R[f] signal (S116). When the processing of S116 is carried out for the 2R[f] signal, the 2R_1[f] signal that configures the OUT_R2[f] signal is produced.

In the second retrieving processing 200 that is executed in parallel with the first retrieving processing S100, a judgment is made as to whether the musical tone signal satisfies the second condition (S201). The second condition is whether the frequency f is within the second frequency range that has been set in advance and, moreover, whether or not the localization w[f] and the maximum level ML[f] of the frequency that is within the second frequency range are respectively within the second setting range that has been set in advance.

In some embodiments, the second frequency range is a range that differs from the first frequency range (i.e., a range in which the start of the range and the end of the range are not in complete agreement). In addition, the second setting range is a range that differs from the first setting range (i.e., a range in which the start of the range and the end of the range are not in complete agreement). In particular embodiments, the second frequency range may be a range that partially overlaps the first frequency range. In other embodiments, the second frequency range may be a range that completely matches the first frequency range. In some embodiments, the second setting range may be a range that partially overlaps the first setting range. In other embodiments, the second setting range may be a range that completely matches the first setting range.

In those cases where the musical tone signal satisfies the second condition (S201: yes), the musical tone of the frequency f (the left channel signal and the right channel signal) is judged to be the extraction signal. Then, 1.0 is assigned to the array rel[f][2] (S202). Incidentally, the "2" that is entered in the array rel [f][2] indicates the fact that the array rel[f][2] is the extraction signal of the second retrieving processing S200.

In those cases where the musical tone signal does not satisfy the second condition (S201: no), the musical tone of that frequency f (the left channel signal and the right channel signal) is judged to not be the extraction signal. Then, 0.0 is assigned to the array rel[f][2] (S203).

After the processing of S202 or S203, a judgment is made as to whether the processing of S201 has completed for all of the frequencies that have been Fourier transformed (S204). In those cases where the judgment of S204 is negative (S204: no), the routine returns to the processing of S201. On the other hand, in those cases where the judgment of S204 is affirmative (S204: yes), the routine shifts to the second signal processing (S210).

In the second signal processing (S210), the level of the 1L[f] signal that becomes a portion of the OUT_L1[f] signal is adjusted and together with this, the level of the 1R[f] signal that becomes a portion of the OUT_R1[f] signal is adjusted. With the second signal processing, the processing of S211 that adjusts the localization, which is formed by the extraction signal in the second retrieving processing (S200), of the portion that is output from the main speakers is carried out.

In addition, in parallel with the processing of S211, the level of the 2L[f] signal that becomes a portion of the OUT_L2[f] signal is adjusted and together with this, the level of the 2R[f] signal that becomes a portion of the OUT_R2[f] signal is adjusted in the second signal processing (S210). With the second signal processing, the processing of S214 that adjusts the localization, which is formed by the extraction signal in the second retrieving processing (S200), of the portion that is output from the sub-speakers is carried out.

Other than the areas of difference that are explained below, each of the processes of S211 through S216 of the second signal processing (S210) is carried out in the same manner as each of the processes of S111 through S116 of the first signal processing (S110). Therefore, their explanations will be omitted. One difference between the second signal processing (S210) and the first signal processing (S110) is that the signal that is input to the second signal processing is the extraction signal from the second retrieving processing (S200). Another difference is that the array rel[f][2] is used in the second signal processing. Yet another difference is that the signals that are output from the second signal processing are 2L__1[f], 2R__1[f], 2L__2[f], and 2R__2[f].

In some embodiments, the localization that is the target in the first signal processing (S110) and the localization that is the target in the second signal processing (S210) may be the same. In other embodiments, however, they may be different. In other words, when the localizations that are the targets in the first signal processing and the second signal processing are different, the coefficients ll, lr, rl, rr, ll', lr', rl', and rr' that are used in the first signal processing are different from the coefficients ll, lr, rl, rr, ll', lr', rl', and rr' that are used in the second signal processing.

In some embodiments, the coefficients a and b that are used in the first signal processing and the coefficients a and b that are used in the second signal processing may be the same. In other embodiments, however, they may be different.

In some embodiments, the contents of the finishing processes S112, S113, S115, and S116 that are executed during the first signal processing and the contents of the finishing processes S212, S213, S215, and S216 that are executed during the second signal processing (S210) may be the same. In other embodiments, they may be different.

Figure 6:
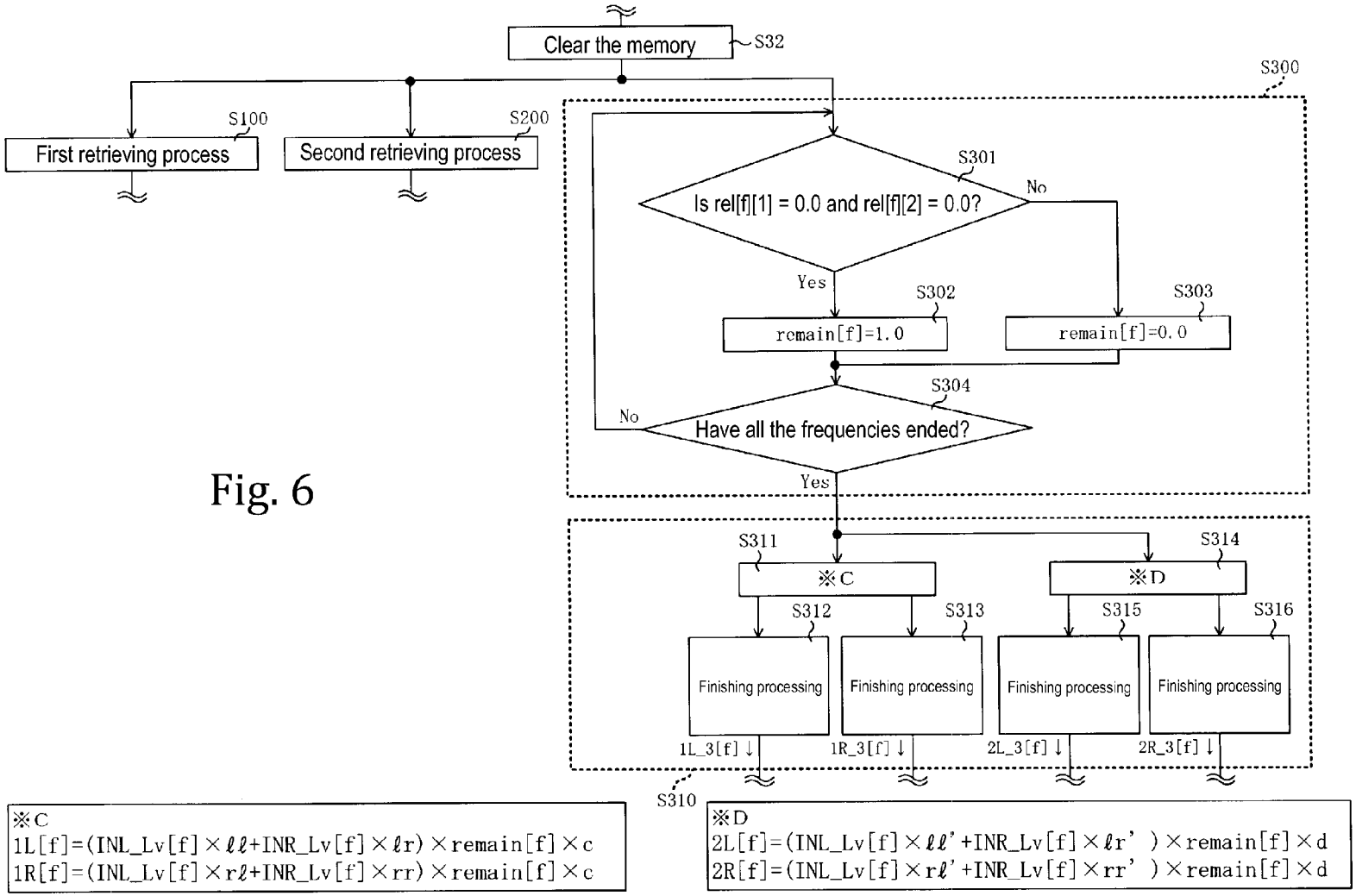
FIG. 6 is a drawing of a process carried out by various processes according to an embodiment of the present invention.

Next, an explanation will be given regarding the other retrieving processing (S300) and the unspecified signal processing (S310). FIG. 6 is a drawing that shows the details of the other retrieving processing (S300) and the unspecified signal processing (S310).

In the other retrieving processing (S300), first, a judgment is made as to whether rel[f][1] of the lowest frequency from among the frequencies that have been Fourier transformed in S12 and S22 (FIG. 3) is 0.0 and, moreover, whether rel[f][2] of the lowest frequency is 0.0 (S301). In other words, a judgment is made as to whether the musical tone signal (the left channel signal and the right channel signal) of the lowest frequency has not been extracted by the first retrieving processing (S100) or the second retrieving processing (S200) as the extraction signal. Incidentally, the judgment of S301 is carried out using the value of rel[f][1] that has been set by S102 and S103 (FIG. 5) in the first retrieving processing (S100) and the value of rel[f][2] that has been set by S202 and S203 (FIG. 5) in the second retrieving processing (S200). In addition, processing that is the same as the first and second retrieving processing (S100 and S200) may be executed separately prior to carrying out the processing of S301 and the judgment of S301 carried out using the value of rel[f][1] and the value of rel[f][2] that are obtained at that time.

In those cases where rel[f][1] and rel[f][2] of the lowest frequency are both 0.0 (S301: yes), a judgment is made that the musical tone signal of the lowest frequency has not yet been extracted as the extraction signal by the first retrieving processing (S100) or the second retrieving processing (S200). In addition, 1.0 is assigned to the array remain[f] (S302). The assignment of 1.0 to remain[f] here indicates that the musical tone signal of the lowest frequency is the extraction signal in the other retrieving processing (S300). Incidentally, the frequency at the point in time a judgment of "yes" has been made in S301 is assigned to the f that is entered in remain[f].

In those cases where at least one of rel[f][1] and rel[f][2] of the lowest frequency is 1.0 (S301: no), a judgment is made that the musical tone signal of the lowest frequency has already been extracted as the extraction signal by the first retrieving processing S100 or the second retrieving processing S200. Then, 0.0 is assigned to the array remain[f]. The assignment of 0.0 to remain[f] here indicates that the musical tone signal of the lowest frequency does not become the extraction signal in the other retrieving processing (S300).

After the processing of S302 or S303, a judgment is made as to whether the processing of S301 has completed for all of the frequencies that have been Fourier transformed in S12 and S22 (FIG. 3) (S304). In those cases where the judgment of S304 is negative (S304: no), the routine returns to the processing of S301 and the judgment of S301 is carried out for the lowest frequency among the frequencies for which the judgment of S301 has not yet been performed. On the other hand, in those cases where the judgment of S304 is affirmative (S304: yes), the routine shifts to the unspecified signal processing (S310).

In the unspecified signal processing (S310), the level of the 1L[f] signal that becomes a portion of the OUT_L1[f] signal is adjusted along with the level of the 1R[f] signal that becomes a portion of the OUT_R1[f] signal (S311). As such, the processing of S311 that adjusts the localization, which is formed by the extraction signal in the other retrieving processing (S300), of the portion that is output from the main speakers is carried out.

In addition, in parallel with the processing of S311, the level of the 2L[f] signal that becomes a portion of the OUT_L2[f] signal is adjusted along with the level of the 2R[f] signal that becomes a portion of the OUT_R2[f] signal (S314). As such, the processing of S314 that adjusts the localization, which is formed by the extraction signal in the other retrieving processing (S300), of the portion that is output from the sub-speakers is carried out.

In the processing of S311, the 1L[f] signal that becomes a portion of the OUT_L1[f] signal is calculated. Specifically, the following computation is carried out for all of the frequencies that have been the Fourier transformed in S12 and S22 (FIG. 3): (INL_Lv[f]×ll+INR_Lv[f]×lr)×remain[f]×c. In addition, the 1L[f] signal is calculated.

In the same manner, the 1R [f] signal that becomes a portion of the OUT_R1[f] signal is calculated in the processing of S311. Specifically, the following computation is carried out for all of the frequencies that have been the Fourier transformed in S12 and S22 (FIG. 3): (INL_Lv[f]×rl+INR_Lv[f]×rr)×remain[f]×c. In addition, the 1R[f] signal is calculated. Incidentally, c is a coefficient that has been specified in advance for the calculation of 1L[f] and 1R[f] in the unspecified signal processing (S310). The coefficient c may be the same as or may be different from the coefficients a and b discussed above.

After the processing of S311, finishing processing that changes the pitch, changes the level, or imparts reverb is carried out for the 1L[f] signal (S312). When the processing of S312 is carried out for the 1L[f] signal, the 1L_3[f] signal that configures the OUT_L1[f] signal is produced. In the same manner, after the processing of S311, finishing processing that changes the pitch, changes the level, or imparts reverb is carried out for the 1R[f] signal (S313). When the processing of S313 is carried out for the 1R[f] signal, the 1R_3[f] signal that configures the OUT_R1[f] signal is produced.

In addition, in the processing of S314, the 2L[f] signal that becomes a portion of the OUT_L2[f] signal is calculated. Specifically, the following computation is carried out for all of the frequencies that have been the Fourier transformed in S12 and S22 (FIG. 3): (INL_Lv[f]×ll'+INR_Lv[f]×lr')×remain[f]×d. In addition, the 2L[f] signal is calculated.

In the same manner, the 2R [f] signal that becomes a portion of the OUT_R2[f] signal is calculated in the processing of S314. Specifically, the following computation is carried out for all of the frequencies that have been the Fourier transformed in S12 and S22 (FIG. 3): (INL_Lv[f]×rl'+INR_Lv[f]×rr')×remain[f]×d. In addition, the 2R[f] signal is calculated. Incidentally, d is a coefficient that has been specified in advance for the calculation of 2L[f] and 2R[f] in the unspecified signal processing (S310). The coefficient d may be the same as or may be different from the coefficients a, b, and c discussed above.

After the processing of S314, finishing processing that changes the pitch, changes the level, or imparts reverb is carried out for the 2L[f] signal (S315). When the processing of S315 is carried out for the 2L[f] signal, the 2L_3[f] signal that configures the OUT_L2[f] signal is produced. In the same manner, after the processing of S314, finishing processing that changes the pitch, changes the level, or imparts reverb is carried out for the 2R[f] signal (S316). When the processing of S316 is carried out for the 2R[f] signal, the 2R_3[f] signal that configures the OUT_R2[f] signal is produced.

Figure 5:
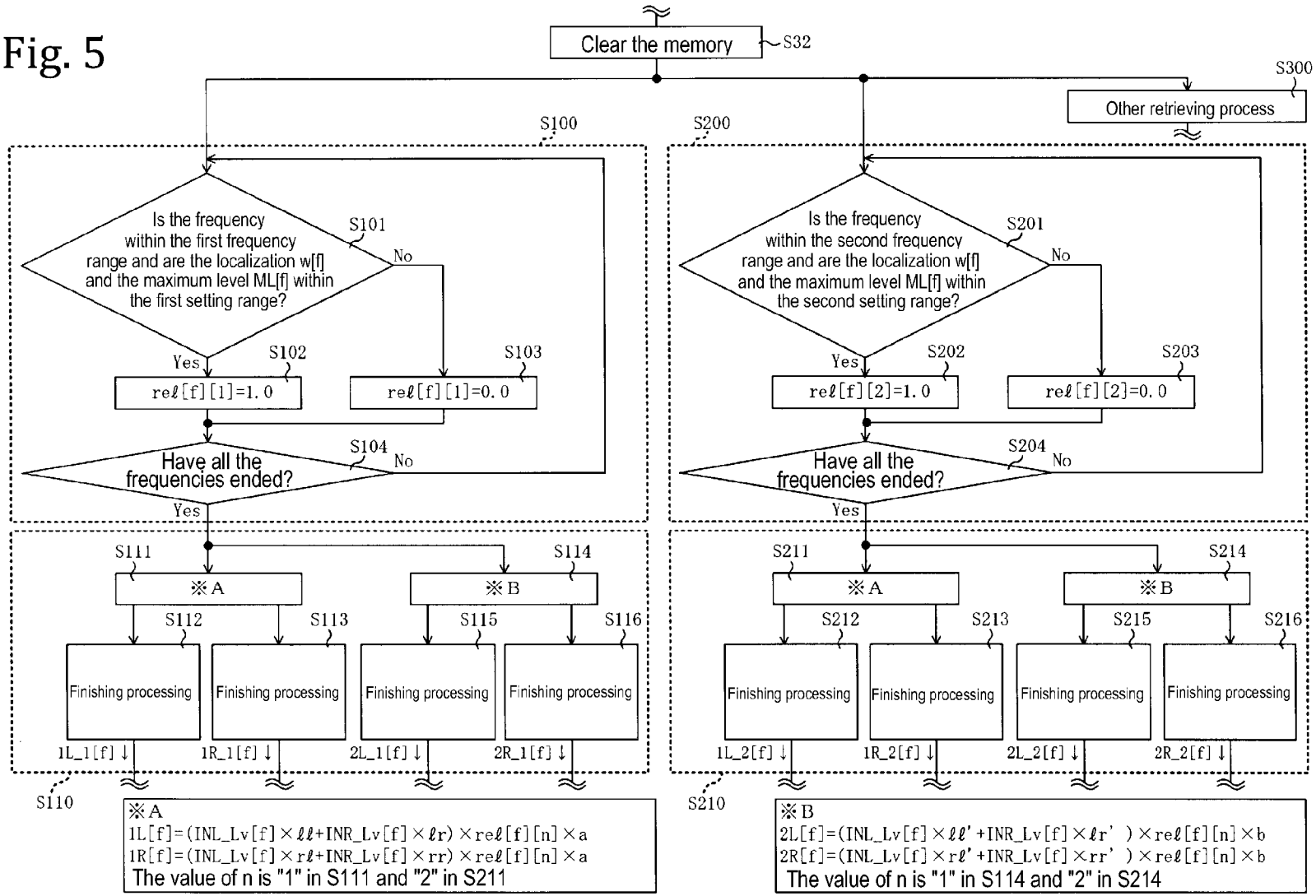
FIG. 5 is a drawing of a process carried out by various processes according to an embodiment of the present invention.

As discussed above, in the main processing section S30, as shown in FIG. 5 and FIG. 6, the processing of S114, S214, and S314 are executed in addition to the processing of S111, S211, and S311. Accordingly, the left channel signal that is the extraction signals is distributed and together with this, the right channel signal that is the extraction signals is distributed. Therefore, each of the distributing signals of the left channel and the right channel may be processed independently. Because of this, different signal processing (processing that changes the localization) can be performed for each of the left and right channel signals that have been distributed from the extraction signals.

It may also be possible to perform the identical signal processing for each of the left and right channel signals that have been distributed from the extraction signals. The signals that have been produced by the processing of S111, S211, and S311 here are output from the OUT1_L terminal and the OUT1_R terminal, which are terminals for the main speakers, after finishing processing. On the other hand, the signals that have been produced by the processing of S114, S214, and S314 are output from the OUT2_L terminal and the OUT2_R terminal, which are terminals for the sub-speakers, after finishing processing. Therefore, the extraction signals are extracted for each condition desired; one certain extraction signal in the extraction signals is distributed to a plurality of distributed signals; a signal processing is performed for one certain distributed signal in the distributed signals; the signal processing can be different from other signal processing which is performed for other distributed signal. In that case, each of the extraction signals for which the different signal processing or finishing processing has been performed can be separately output respectively from the OUT1 terminal and the OUT2 terminal.

Returning to FIG. 4, when the execution of the first signal processing (S110), the second signal processing (S210), and the unspecified signal processing (S310) has completed, the 1L_1[f] signal (produced by the first signal processing (S110)), the 1L_2[f] signal (produced by the second signal processing (S210)), and the 1L_3[f] signal (produced by the unspecified signal processing (S310)) are synthesized. Accordingly, the OUT_L1[f] signal is produced. Then, when the OUT_L1[f] signal is input to the L1ch output processing section S60 (refer to FIG. 3), the L1ch output processing section S60 converts the OUT_L1[f] signal that has been input into the OUT1_L[t] signal. Then, the OUT1_L[t] signal that has been converted is output to the first D/A converter 13L1 for the Lch (refer to FIG. 1) via the bus line 17 (FIG. 1).

In the same manner, the 1R_1[f] signal (produced by the first signal processing (S110)), the 1R_2[f] signal (produced by the second signal processing (S210)), and the 1R_3[f] signal (produced by the unspecified signal processing (S310)) are synthesized. Accordingly, the OUT_R1[f] signal is produced. Then, when the OUT_R1[f] signal is input to the R1ch output processing section S70 (refer to FIG. 3), the R1ch output processing section S70 converts the OUT_R1[f] signal that has been input into the OUT1_R[t] signal. Then, the OUT1_R[t] signal that has been converted is output to the first D/A converter 13R1 for the Rch (refer to FIG. 1) via the bus line 17 (FIG. 1). Incidentally, both the production of the OUT_L2[f] signal and the OUT_R2[f] signal and the conversion of the OUT2_L[t] signal and the OUT2_R[t] signal are carried out in the same manner discussed above.

Thus, it is possible to synthesize signals that have not been extracted by the first signal processing (S110) and the second signal processing (S210) for the extraction signals that have been extracted for each desired condition. Accordingly, the OUT_L1[f] signal and the OUT_R1[f] signal can be made a signal that is the same as the musical tone signal that has been input (i.e., a natural musical tone having a broad ambiance).

As discussed above, signal processing (S110 and S210) is carried out for the extraction signals that have been extracted by the first retrieving processing (S100) or the second retrieving processing (S200). The first retrieving processing (S100) and the second retrieving processing (S200) here extracts a musical tone signal (the left channel signal and the right channel signal) that satisfies the respective conditions for each of the conditions that has been set (each of the conditions in which the frequency, localization, and maximum level are one set) as the extraction signal. Therefore, it is possible to extract an extraction signal that becomes the object of the performance of the signal processing for each of a plurality of conditions (e.g., the respective conditions in which the frequency, localization, and maximum level are one set).

Figure 8:
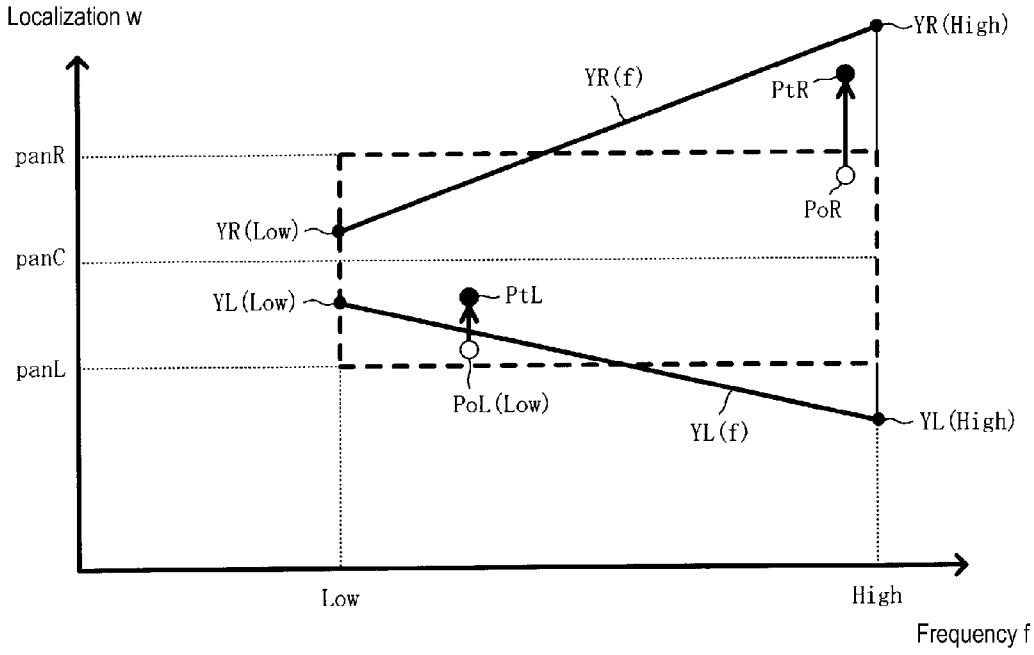
FIG. 8 is a schematic diagram that shows the condition in which the acoustic image is expanded or contracted by the acoustic image scaling processing according to an embodiment of the present invention.
Figure 9:
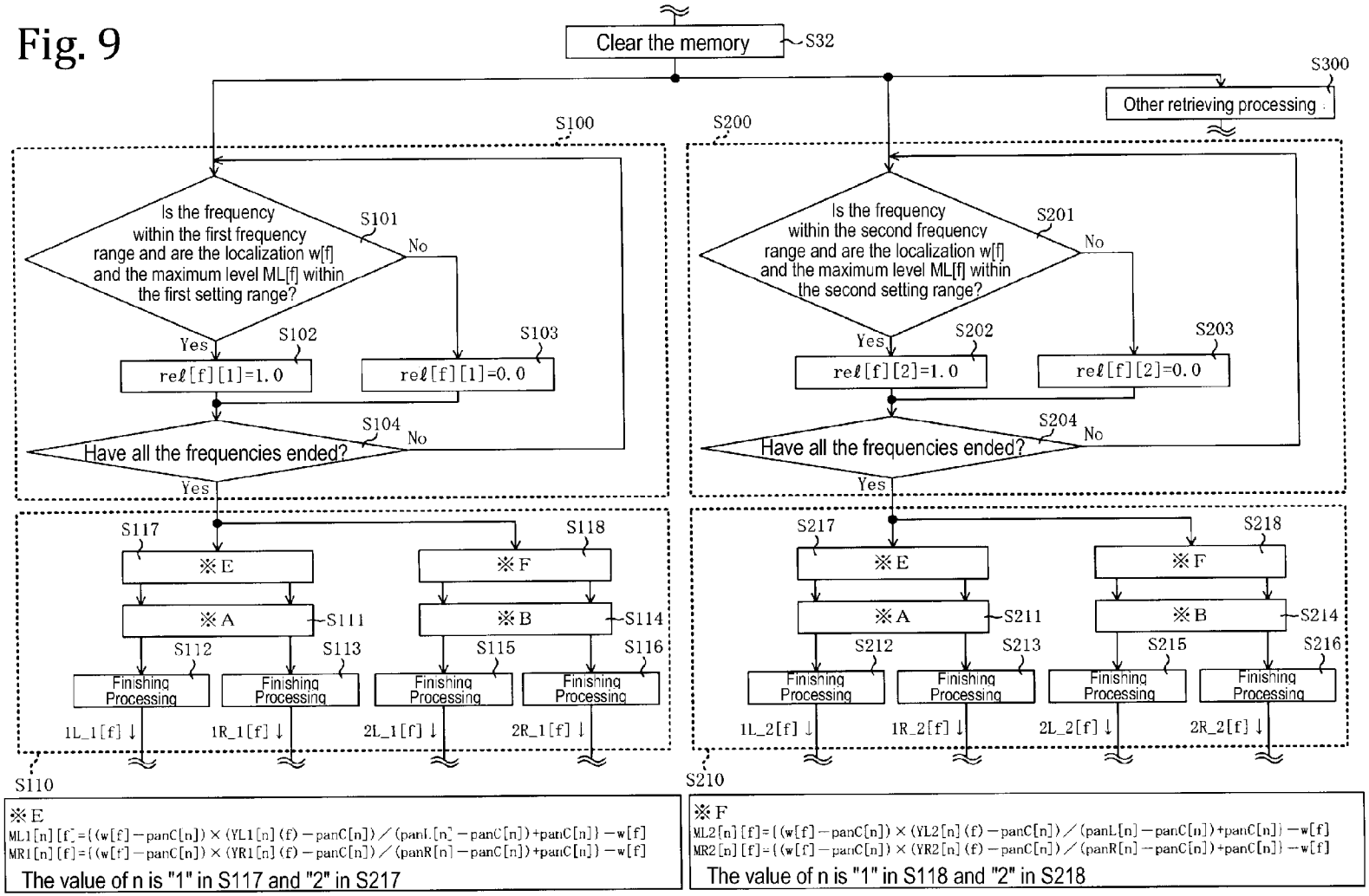
FIG. 9 is a drawing of a process carried out by various processes according to an embodiment of the present invention.

FIGS. 8 and 9 relate to a musical tone signal processing system, such as an effector 1 (FIG. 1), according to an embodiment of the present invention. Incidentally, those reference numbers that have been assigned to those portions that are the same as those in FIGS. 1-7 are omitted.

With reference to FIGS. 8 and 9, the effector 1 (as above) extracts a musical tone signal based on the conditions set by the first or the second retrieving processing (S100 and S200). In addition, for the musical tone signal that has been extracted (i.e., the extraction signal), it is possible to perform the first or the second signal processing (S110 and S210) independent of each of the set conditions. In addition, acoustic image scaling processing is carried out in the first and second signal processing. In other words, the configuration is such that expansion (expansion at an expansion rate greater than one) or contraction (expansion at an expansion rate greater than zero and smaller than one) is possible.

First, an explanation will be given regarding the essentials of the acoustic image scaling processing that is carried out by the effector while referring to FIG. 8. FIG. 8 is a schematic diagram that shows the condition in which the acoustic image is expanded or contracted by the acoustic image scaling processing.

The conditions for the extraction of the extraction signal (i.e., the conditions in which the frequency, localization, and maximum level are one set) by the first or the second retrieving processing (S100 and S200) are displayed as an area by a coordinate plane that is formed with the frequency and the localization as the two axes. In other words, the area is a rectangular area in which the frequency range that is made a condition (the first frequency range and the second frequency range) and the localization range that is made a condition (the first setting range and the second setting range) are two adjacent sides. This rectangular area will be referred to as the "retrieving area" below. The extraction signal exists within that rectangular area. Incidentally, in FIG. 8, the frequency range is made Low≦frequency f≦High and the localization range is made panL≦localization w[f]≦panR. In addition, the retrieving area is expressed as the rectangular area with the four points of frequency f=Low, localization w[f]=panL; frequency f=Low, localization w[f]=panR; frequency f=High, localization w[f]=panR; and frequency f=High, localization w[f]=panL as the vertices.

The acoustic image scaling processing is processing in which the localization w[f] of the extraction signal that is within the retrieving region is shifted by the mapping (e.g., linear mapping) in the area that is the target of the expansion or contraction of the acoustic image (hereinafter, referred to as the "target area"). The target area is an area that is enclosed by the acoustic image expansion function YL(f), the acoustic image expansion function YR(f), and frequency range. The acoustic image expansion function YL(f) is a function in which the boundary localization of one edge of the target area is stipulated in conformance with the frequency. The acoustic image expansion function YR(f) is a function in which the boundary localization of the other edge of the target area is stipulated in conformance with the frequency. The frequency range is a range that satisfies Low≦frequency f≦High.

In the acoustic image scaling processing, the center (panC) of the localization range (the range of panL≦localization w[f]≦panR in FIG. 8) is made the reference localization. In addition, the localization of the extraction signal from among the extraction signals within the retrieving area that is localized toward the panL side from panC, uses the acoustic image expansion function YL(f) and shifts in accordance with the continuous linear mapping in which panC is made the reference. On the other hand, the localization of the extraction signal that is localized toward the panR side from panC, uses the acoustic image expansion function YR(f) and shifts in accordance with the continuous linear mapping in which panC is made the reference.

Incidentally, the case in which the extraction signal that is localized toward the panL side from panC shifts to the pan L side or in which the extraction signal that is localized toward the panR side from panC shifts to the panR side is expansion. In addition, the case in which the extraction signal shifts toward the reference localization panC side is contraction. In other words, in the frequency area in which the acoustic image expansion function YL(f) is localized outside the retrieving area, the acoustic image that is formed by the extraction signal that is localized toward the panL side from panC is expanded. On the other hand, in the frequency area in which the acoustic image expansion function YL(f) is localized inside the retrieving area, the acoustic image that is formed by the extraction signal that is localized toward the panL side from panC is contracted. In the same manner, in the frequency area in which the acoustic image expansion function YR(f) is localized outside the retrieving area, the acoustic image that is formed by the extraction signal that is localized toward the panR side from panC is expanded. On the other hand, in the frequency area in which the acoustic image expansion function YR(f) is localized inside the retrieving area, the acoustic image that is formed by the extraction signal that is localized toward the panR side from panC is contracted.

Incidentally, as is shown in FIG. 8, the acoustic image expansion function YL(f) and the acoustic image expansion function YR(f) are set up as functions that draw a straight line in conformance with the frequency f. However, the acoustic image expansion function YL(F) and the acoustic image expansion function YR(f) are not limited to drawing a straight line in conformance with the value of the frequency, and it is possible to utilize functions that exhibit various forms. For example, a function that draws a broken line in conformance with the range of the frequency f may be used. As another example, a function that draws a parabola (i.e., a quadratic curve) in conformance with the value of the frequency f may be used. In addition, a cubic function that corresponds to the value of the frequency f, or a function that expresses an ellipse, circular arc, index, or logarithmic function, and/or the like may be utilized.

The acoustic image expansion functions YL(f) and YR(f) may be determined in advance or may be set by the user. For example, the configuration may be such that the acoustic image expansion functions YL(f) and YR(f) that are used are set in advance in conformance with the frequency region and the localization range. In addition, the acoustic image expansion functions YL(f) and YR(f) that conform to the retrieving area position (the frequency region and the localization range) may be selected.

In addition, the configuration may be such the user may, as desired, set two or more coordinates (i.e., the set of the frequency and the localization) in the coordinate plane that includes the retrieving area and in which the acoustic image expansion functions YL(f) or YR(f) are set based on the set of the frequency and the localization. For example, the setup may be such that the setting by the user is the point in which the localization is YL(Low) for the frequency f=Low and the point in which the localization is YL(High) for the frequency f=High. Accordingly, the acoustic image expansion function YL(f), which is a function in which the localization changes linearly with respect to the changes in the frequency f, may be set.

On the other hand, the setup may also be such that the setting by the user is the point in which the localization is YR(Low) for the frequency f=Low and the point in which the localization is YR(High) for the frequency f=High. Accordingly, the acoustic image expansion function YR(f), which is a function in which the localization changes linearly with respect to the changes in the frequency f, may be set. Alternatively, the configuration may be such that the user sets each respective acoustic image expansion function YL(f) and acoustic image expansion function YR(f) change pattern (linear, parabolic, arc, and the like). Incidentally, the frequency range of the acoustic image expansion functions YL(f) and YR(f) (e.g., FIG. 8) may be a frequency range that extends beyond the frequency range of the retrieving area.

In those cases where the acoustic image expansion function YL(f) and the acoustic image expansion function YR(f) are functions that draw a straight line in conformance with the value of the frequency f, it is possible to derive the acoustic image expansion functions YL(f) and YR(f) in the following manner.

BtmL and BtmR are assumed to be the coefficients that determine the expansion condition of the Low side of the frequency f. TopL and TopR are assumed to be the coefficients that determine the expansion condition of the High side of the frequency f. Incidentally, BtmL and TopL determine the expansion condition in the left direction (the panL direction) from panC, which is the reference localization. In addition, BtmR and TopR determine the expansion condition in the right direction (the panR direction) from panC. These four coefficients BtmL, BtmR, TopL, and TopR are respectively set to be in the range of, for example, 0.5 to 10.0. As noted, in those cases where the coefficient exceeds 1.0, this is expansion; and in those cases where the coefficient is greater than 0 and smaller 1.0, this is contraction.

For the acoustic image expansion function YL(f), YL(Low)=panC+(panL−panC)×BtmL and YL(High)=panC+(panL−panC)×TopL. Therefore, if Wl=panL−panC, then YL(f)={Wl×(TopL−BtmL)/(High−Low)}×(f−Low)+panC+Wl×BtmL.

In the same manner for the acoustic image expansion function YR(f), YR(Low)=panC+(panR−panC)×BtmR and YR(High)=panC+(panR−panC)×TopR. Therefore, if Wr=panR−panC, then YR(f)={Wr×(TopR−BtmR)/(High−Low)}×(f−Low)+panC+Wr×BtmR.

In those cases where the acoustic image expansion function YL(f) is used and the shifting of the extraction signal PoL[f] that is localized in the left direction from the reference localization PanC is carried out, the destination localization of the shift PtL[f] can be calculated when panC is made the reference. This is because for a given frequency f, the ratio of the length from panC to PoL[f] and the length from panC to PtL[f] and the ratio of the length from panC to pan L and the length from panC to YL(f) are equal. In other words, the destination localization of the shift PtL[f] is (PtL[f]−panC):(PoL[f]−panC)=(YL(f)−panC):(panL−panC). From this, the calculation is PtL[f]=(PoL[f]−panC)×(YL(f)−panC)/(panL−panC)+panC.

In those cases where the acoustic image expansion function YR(f) is used and the shifting of the extraction signal PoR[f] that is localized in the right direction from the reference localization PanC is carried out, the destination localization of the shift PtR[f] is (PtR[f]−panC):(PoR[f]−panC)=(YR(f)−panC):(panR−panC). From this, the calculation is PtR[f]=(PoR[f]−panC)×(YR(f)−panC)/(panR−panC)+panC.

In the acoustic image scaling processing, the localization PtL[f] and the localization PtR[f], which are the destinations of the shift, are made the localizations that are the target. Accordingly, the coefficients ll, lr, rl, and rr and the coefficients ll', lr', rl', and rr' for making the shift of the localization are determined. Then, the localization of the extraction signal is shifted using these. As a result, the acoustic image of the retrieving area is expanded or contracted.

In other words, the localization of the extraction signal that is localized toward the panL side from panC from among the extraction signals in the retrieving area is shifted using continuous linear mapping that has panC as a reference using the acoustic image expansion function YL(f). On the other hand, the extraction signal that is localized toward the panR side from panC is shifted using continuous linear mapping that has panC as a reference using the acoustic image expansion function YR(f). As such, the acoustic image of the retrieving area is expanded or contracted.

Incidentally, in FIG. 8, the situation in which the acoustic image expansion functions YL(f) and YR(f) are set for one retrieving area is shown in the drawing as one example. However, the setup may be such that the acoustic image expansion functions YL(f) and YR(f) are respectively set for each of the retrieving areas.

For example, for a retrieving area in which the treble range is made the frequency range, a retrieving area in which the midrange is made the frequency range, and a retrieving area in which the bass range is made the frequency range, different acoustic image expansion function YL(f) and YR(f) settings may be made for each. Incidentally, in those cases where the acoustic image of a stereo signal is expanded as a whole, when the acoustic image expansion functions YL(f) and YR(f) are set so that the expansion condition that goes along with the increase in the frequency becomes smaller for the range of all of the localizations in the treble range, and the acoustic image expansion functions YL(f) and YR(f) are set so that the expansion condition that goes along with the increase in the frequency becomes greater for the range of all of the localizations in the midrange, it is possible to impart a desirable listening sensation. On the other hand, the setup may be such that signal extraction is not done for the bass range and the expansion (or contraction) of the acoustic image not carried out.

Incidentally, in those cases where a plurality of retrieving areas are present, the setup may be such that the expansion or contraction of the acoustic image is carried out for a only portion of the retrieving areas rather than for all of the retrieving areas. In other words, the setup may be such that the reference localization, the acoustic image expansion function YL(f), and the acoustic image expansion function YR(f) are set for only a portion of the retrieving areas.

In addition, the setup may be such that by setting the BtmL, BtmR, TopL, and TopR in common for all of the retrieving areas, the acoustic image expansion functions YL(f) and YR(f) are set such that the expansion (or contraction) condition becomes the same for all of the retrieving areas.

In addition, the BtmL, BtmR, TopL, and TopR may be set as the function for the position of the area that is extracted and/or the size of said area. In other words, the setup may be such that the expansion conditions (or the contraction conditions) change in conformance with the retrieving area based on specified rules. For example, the BtmL, BtmR, TopL, and TopR may be set such that the expansion condition increases together with the increase in the frequency. Or, the BtmL, BtmR, TopL, and TopR may be set such that the expansion conditions become smaller as the localization of the extraction signal becomes more distant for the reference localization (for example, panC, which is the center).

In addition, the reference localization, the acoustic image expansion function YL(f), and the acoustic image expansion function YR(f) may be set in common for all of the retrieving areas. In other words, the setup may be such that the extraction signals of all of the retrieving areas may be linearly mapped by the same reference localization as the reference and the same acoustic image expansion functions YL(f) and YR(f). Incidentally, the setup in that case may be such that, by the selection of the entire musical tone as a single retrieving area, the acoustic image of the entire musical tone may be expanded or contracted with one condition (i.e., a reference localization and acoustic image expansion functions YL(f) and YR(f) that are set in common).

In some embodiments, the center of the localization range of the retrieving area (in FIG. 8, the range of panL≦localization w[f]≦panR), i.e., panC, has been made the reference localization. However, it is possible for the reference localization to be set as a localization that is either within the retrieving area or outside the retrieving area. In those cases where there is a plurality of retrieving areas, a different reference localization may be set for each of the retrieving areas or the reference localization may be set in common for all of the retrieving areas. Incidentally, the reference localization may be set in advance for each of the retrieving areas or for all of the retrieving areas or may be set by the user each time.

Next, an explanation will be given regarding the acoustic image scaling processing that is carried out by the effector 1 (FIG. 1) while referring to FIG. 9. FIG. 9 is a drawing that shows the details of the processing that is carried out by the first signal processing S110 and the second signal processing S210 according to an embodiment of the present invention (e.g., FIG. 8).

As shown in FIG. 9, in the first retrieving processing (S100), the musical tone signal that satisfies the first condition is extracted as the extraction signal. After that, in the first signal processing (S110), processing is executed (S117) that calculates the amount that the localization of the extraction signal of the portion that is output from the main speakers is shifted in order to carry out the expansion or the contraction of the acoustic image that is formed from the extraction signal. In the same manner, processing is executed (S118) that calculates the amount that the localization of the extraction signal of the portion that is output from the sub-speakers is shifted in order to carry out the expansion or the contraction of the acoustic image that is formed from the extraction signal.

In the processing of S117, the amount of shift ML1[1][f] and the amount of shift MR1[1][f] are calculated. The amount of shift ML1[1][f] is the amount of shift when the extraction signal is shifted in the left direction from the reference localization in the retrieving area (i.e., the area that is determined in accordance with the first condition) from the first retrieving processing (S100) due to the acoustic image expansion function YL1[1](f). In the same manner, the amount of shift MR1[1][f] is the amount of shift when the extraction signal is shifted in the right direction from the reference localization due to the acoustic image expansion function YR1[1](f).

Incidentally, the acoustic image expansion function YL1[1](f) and the acoustic image expansion function YR1[1](f) are both acoustic image expansion functions for shifting the localization of the extraction signal of the portion that is output from the main speakers. The acoustic image expansion function YL1[1](f) is a function for shifting the extraction signal in the left direction from the reference localization. The acoustic image expansion function YR1[1](f) is a function for shifting the extraction signal in the right direction from the reference localization.

Specifically, in the processing of S117, the following computation is carried out for all of the frequencies that have been Fourier transformed in S12 and S22 (FIG. 3): {(w[f]−panC[1])×(YL1[1](f)−panC[1])/(panL[1]−panC[1])+panC[1]}−w[f]. From this, the amount of shift ML1[1][f] is calculated. In the same manner, the following computation is carried out for all of the frequencies that have been Fourier transformed in S12 and S22: {(w[f]−panC[1])×(YR1[1](f)−panC[1])/(panR[1]−panC[1])+panC[1]}−w[f]. From this, the amount of shift MR1[1][f] is calculated. Incidentally, panL[1] and panR[1] are the localizations of the left and right boundaries of the retrieving area from the first retrieving processing (S100). PanC[1] is the reference localization in the retrieving area from the first retrieving processing (S100), for example, the center of the localization range in said retrieving area.

After the processing of S117, the amount of shift ML1[1][f] and the amount of shift MR1[1][f] is used to adjust the localization, that is formed by the extraction signal that has been retrieved by the first retrieving processing (S100), of the portion that is output from the main speakers (S111). Specifically, the amount of shift ML1[1][f] and the amount of shift MR[1][f] are the difference of the localization w[f] of the extracted signal from the localization that is the target (i.e., the destination localization of the shift due to the expansion or contraction). Therefore, in the processing of S111, using the amount of shift ML1[1][f] and the amount of shift MR1[1][f], the determination of the coefficients ll, lr, rl, and rr for the shifting of the localization is carried out. Then, using the coefficients ll, lr, rl, and rr that have been determined, the adjustment of the localization is carried out in the same manner as in S111 in the embodiments discussed with respect to FIGS. 1-7 to obtain the 1L signal and 1R signal.

Returning to FIG. 9, incidentally, if the localization that has been adjusted is less than 0, the localization is made 0; and, on the other hand, in those cases where the localization that is adjusted exceeds 1, the localization is made 1. The calculation of the amount of shift ML1[1][f] and the amount of shift MR1[1][f] by the processing of S117 and the adjustment of the localization by the processing of S111 are equivalent to the acoustic image scaling processing.

After that, the 1L[f] signal has finishing processing applied in S112 and is made into the 1L_1[f] signal. In addition, the 1R[f] signal has finishing processing applied in S113 and is made into the 1R_1[f] signal.

On the other hand, in the processing of S118 (in which the amount of shift of the localization of the extraction signal of the portion that is output from the sub-speakers is calculated), the amount of shift ML2[1][f] and the amount of shift MR2[1][f] are calculated. The amount of shift ML2[1][f] is the amount of shift when the extraction signal is shifted in the left direction from the reference localization in the retrieving area from the first retrieving processing (S100) due to the acoustic image expansion function YL2[1](f). In the same manner, the amount of shift MR2[1][f] is the amount of shift when the extraction signal is shifted in the right direction from the reference localization due to the acoustic image expansion function YR2[1](f).

Incidentally, the acoustic image expansion function YL2[1](f) and the acoustic image expansion function YR2[1](f) are both acoustic image expansion functions for shifting the localization of the extraction signal of the portion that is output from the sub-speakers. The acoustic image expansion function YL2[1](f) is a function for shifting the extraction signal in the left direction from the reference localization. The acoustic image expansion function YR2[1](f) is a function for shifting the extraction signal in the right direction from the reference localization.

In some embodiments, the acoustic image expansion function YL2[1](f) may be the same as the acoustic image expansion function YL1[1](f). In the same manner, the acoustic image expansion function YR2[1](f) may be the same as the acoustic image expansion function YR1[1](f). In other embodiments, the acoustic image expansion function YL2[1](f) may be different from the acoustic image expansion function YL1[1](f). In the same manner, the acoustic image expansion function YR2[1](f) may be different from the acoustic image expansion function YR1[1](f).

For example, in those cases where the main speakers and the sub speakers are placed at equal distances, YL1[1](f) and YL2[1](f) are made the same and, together with this, YR1[1](f) and YR2[1](f) are made the same. In addition, in those cases where the distance of sub-speakers is larger than the distance of main speakers, the acoustic image expansion functions YL2[1](f) and YR2[1](f) are used so the amount of shift ML2[1][f] and the amount of shift MR2[1][f] become smaller than the amount of shift ML1[1][f] and the amount of shift MR1[1][f].

Specifically, in the processing of S118, the following computation is carried out for all of the frequencies that have been Fourier transformed in S12 and S22: {(w[f]−panC[1])×(YL2[1](f)−panC[1])/(panL[1]−panC[1])+panC[1]}−w[f]. From this, the amount of shift ML2[1][f] is calculated. In the same manner, the following computation is carried out for all of the frequencies that have been Fourier transformed in S12 and S22: {(w[f]−panC[1])×(YR2[1](f)−panC[1])/(panR[1]−panC[1])+panC[1]}−w[f]. From this, the amount of shift MR2[1][f] is calculated. The amount of shift ML2[1][f] and the amount of shift MR2[1][f] are made equivalent to the subtracted difference of the localization w[f] of the extraction signal from the localization that is the target (i.e., the destination localization of the shift that is due to the expansion or contraction).

After the processing of S118, the amount of shift ML2[1][f] and the amount of shift MR2[1][f] are used to adjust the localization, that is formed by the extraction signal that has been retrieved by the first retrieving processing (S100), of the portion that is output from the sub-speakers (S114). Specifically, in the processing of S114, using the amount of shift ML2[1][f] and the amount of shift MR2[1][f], the determination of the coefficients ll', lr', rl', and rr' for the shifting of the localization is carried out. Then, using the coefficients ll', lr', rl', and rr' that have been determined, the adjustment of the localization is carried out in the same manner as in S114 in the embodiments relating to FIGS. 1-7. Accordingly, the 2L signal and the 2R signal are obtained.

Incidentally, if the localization that has been adjusted is less than 0, the localization is made 0 and on the other hand, in those cases where the localization that is adjusted exceeds 1, the localization is made 1. In addition, the calculation of the amount of shift ML2[1][f] and the amount of shift MR2[1][f] by the processing of S118 and the adjustment of the localization by the processing of S114 are equivalent to the acoustic image scaling processing.

After that, the 2L[f] signal has finishing processing applied in S115 and is made into the 2L_1[f] signal. In addition, the 2R[f] signal has finishing processing applied in S116 and is made into the 2R_1[f] signal.

As is shown in FIG. 9, in the second retrieving processing (S200), the musical tone signal that satisfies the second condition is extracted as the extraction signal. After that, in the second signal processing (S210), processing is executed (S217) that calculates the amount of shift ML1[2][f] and the amount of shift MR1[2][f] that the localization of the extraction signal of the portion that is output from the main speakers is shifted in order to carry out the expansion or the contraction of the acoustic image that is formed from the extraction signal that has been extracted by the second retrieving processing (S200).

In the same manner, processing is executed (S218) that calculates the amount of shift ML2[2][f] and the amount of shift MR2[2][f] that the localization of the extraction signal of the portion that is output from the sub-speakers is shifted in order to carry out the expansion or the contraction of the acoustic image that is formed from the extraction signal that has been extracted by the second retrieving processing (S200).

In the processing of S217, other than the differences explained below, processing is carried out that is the same as the processing of S117, which is executed during the first signal processing (S110). Therefore, that explanation will be omitted. The processing of S217 and the processing of S117 differ in that instead of YL1[1](f) and YR1[1](f) as the acoustic image expansion functions for the shifting of the localization of the portion that is output from the main speakers, YL1[2](f) and YR1[2](f) are used. YL1[2](f) is a function for the shifting of the extraction signal in the left direction from the reference localization. In addition, YR1[2](f) is a function for the shifting of the extraction signal in the right direction from the reference localization. In addition, panL[2] and panR[2] (the localizations of the left and right boundaries of the retrieving area from the second retrieving processing (S200)) are used instead of panL[1] and panR[1]. Moreover, panC[2] (a localization in the retrieving area from the second retrieving processing (S200); e.g., the center of the localization range of said retrieving area) is used instead of panC[1] as the reference localization.

In addition, in the processing of S218, other than the differences explained below, processing is carried out that is the same as the processing of S118, which is executed during the first signal processing (S110). Therefore, that explanation will be omitted. The processing of S218 and the processing of S118 differ in that instead of YL2[1](f) and YR2[1](f) as the acoustic image expansion functions for the shifting of the localization of the portion that is output from the sub-speakers, YL2[2](f) and YR2[2](f) are used. YL2[2](f) is a function for the shifting of the extraction signal in the left direction from the reference localization. In addition, YR2[2](f) is a function for the shifting of the extraction signal in the right direction from the reference localization. In addition, panL[2] and panR[2] are used instead of panL[1] and panR[1]. Moreover, panC[2] is used instead of panC[1] as the reference localization.

Then, after the processing of S217, the amount of shift ML1[2][f] and the amount of shift MR1[2][f] that have been calculated are used and the coefficients ll, lr, rl, and rr are determined. With this, the adjustment of the localization, which is formed by the extraction signal that has been retrieved by the second retrieving processing (S200), of the portion that is output from the main speakers is carried out (S211). In the processing of S211, if the localization that has been adjusted is less than 0, the localization is made 0; and, on the other hand, in those cases where the localization that is adjusted exceeds 1, the localization is made 1. Incidentally, the calculation of the amount of shift ML1[2][f] and the amount of shift MR1[2][f] by the processing of S117 and the adjustment of the localization by the processing of S211 are equivalent to the acoustic image scaling processing. After that, finishing processing is applied to the 1L[f] signal and the 1R[f] signal that have been obtained by the processing S211 in S212 and S213 respectively. Accordingly, the 1L_2[f] signal and the 1R_2[f] signal are obtained.

On the other hand, after the processing of S218, the amount of shift ML2[2][f] and the amount of shift MR2[2][f] that have been calculated are used and the coefficients ll', lr', rl', and rr' are determined. With this, the adjustment of the localization, which is formed by the extraction signal that has been retrieved by the second retrieving processing (S200), of the portion that is output from the sub-speakers is carried out (S214). In the processing of S214, if the localization that has been adjusted is less than 0, the localization is made 0; and, on the other hand, in those cases where the localization that is adjusted exceeds 1, the localization is made 1. Incidentally, the calculation of the amount of shift ML2[2][f] and the amount of shift MR2[2][f] by the processing of S118 and the adjustment of the localization by the processing of S114 are equivalent to the acoustic image scaling processing. After that, finishing processing is applied to the 2L[f] signal and the 2R[f] signal that have been obtained by the processing S214 in S215 and S216 respectively. Accordingly, the 2L_2[f] signal and the 2R_2[f] signal are obtained.

As discussed above, according to various embodiments, the effector (e.g., as shown in FIG. 9), a signal is extracted from the retrieving area by the first retrieving processing (S100) or the second retrieving processing (S200). Then, the reference localization, the acoustic image expansion function YL(f) that stipulates the expansion condition (the degree of expansion) of the boundary in the left direction (which is one end of the localization range), and the acoustic image expansion function YR(f) that stipulates the expansion condition of the boundary in the right direction (which is the other end of said localization range) are set.

For the extraction signal that has been extracted, the extraction signal that is in the left direction from the reference localization is shifted by the linear mapping in accordance with the acoustic image expansion function YL(f) with said reference localization as the reference. In addition, for the extraction signal that has been extracted, the extraction signal that is in the right direction from the reference localization is shifted by the linear mapping in accordance with the acoustic image expansion function YR(f) with said reference localization as the reference. As such, the expansion or contraction of the acoustic image that is formed in the retrieving area can be done. Therefore, in accordance with various embodiments, an effector may be configured to freely expand or contract each acoustic image that is manifested by the stereo sound source.

Figure 10:
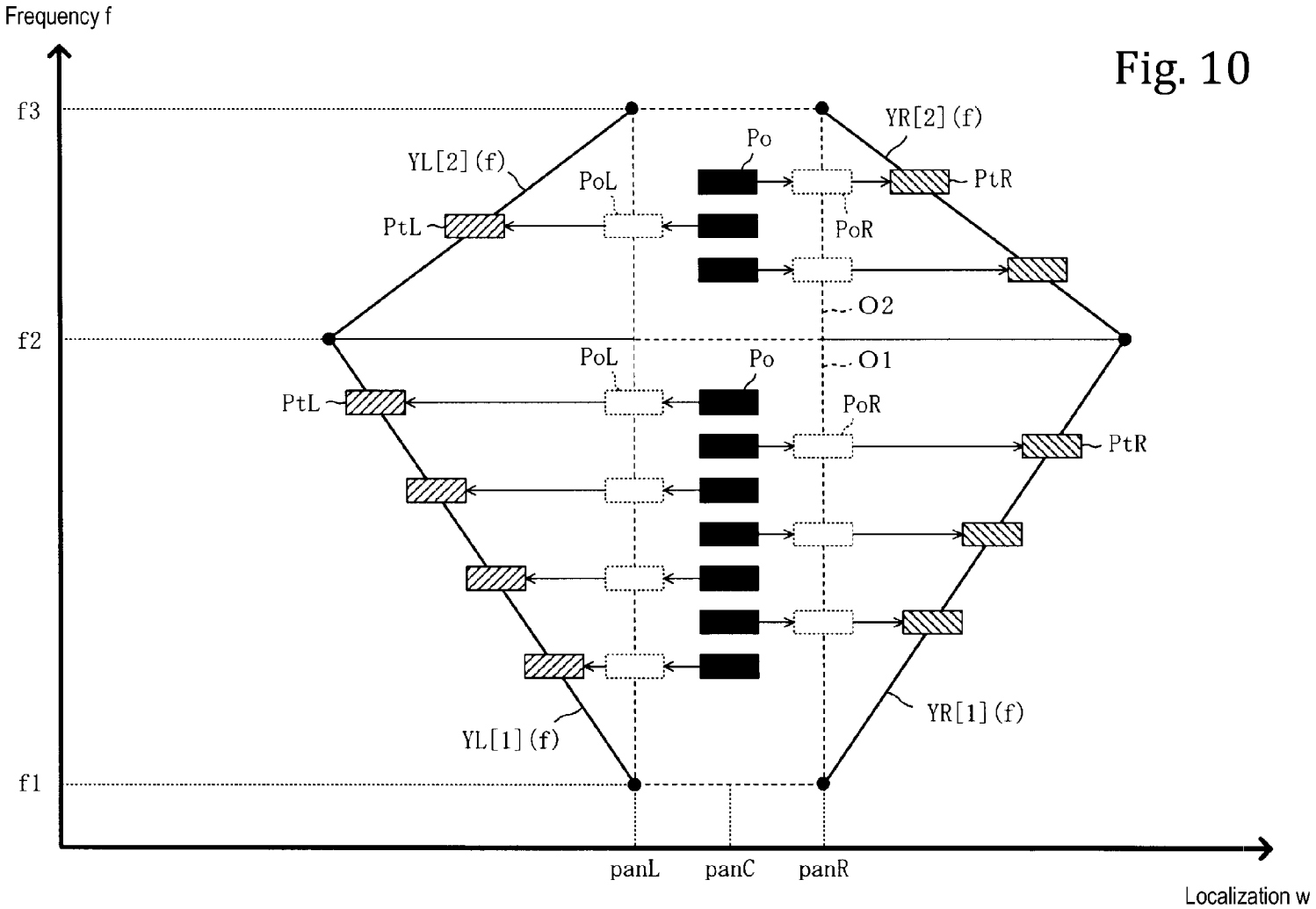
FIG. 10 is a schematic diagram of an acoustic image scaling process according to an embodiment of the present invention.
Figure 11:
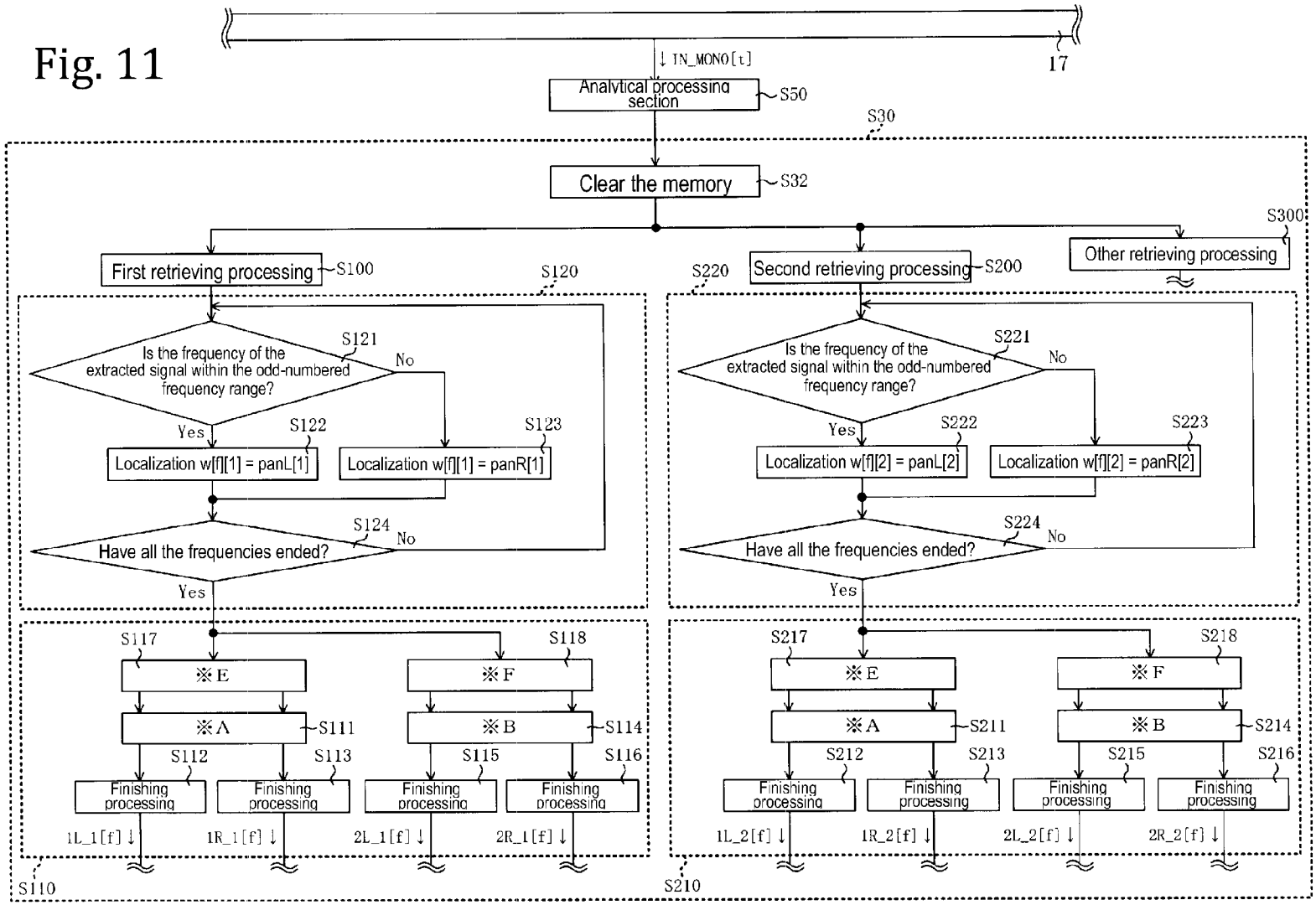
FIG. 11 is a drawing of a process executed by a musical tone signal processing system according to an embodiment of the present invention.

According to various embodiments, such as those shown in FIGS. 10 and 11, an effector may be configured to form the expansion or contraction of the acoustic image from the extraction signal that has been extracted from the musical tone signal of a single channel (i.e., a monaural signal) in conformance with set conditions. This may differ from an effector of FIGS. 8 and 9 in that such an effector may be configured to form the expansion or contraction of the acoustic image of an extraction signal that had been extracted from the musical tone signal of the left and right channels (i.e., a stereo signal) in conformance with set conditions. Incidentally, with respect to the embodiments relating to FIGS. 10 and 11, the same reference numbers have been assigned to those portions that have been previously discussed (e.g., for FIGS. 8 and 9) are the same and their explanation will be omitted.

Specifically for the monaural signal, the localization is positioned in the center (panC). Accordingly, because it is a monaural signal, the extraction signal is localized in the center (panC). In particular embodiments, prior to executing the acoustic image scaling processing, preparatory processing is carried out. The preparatory processing distributes (apportions) the extraction signal to either the boundary in the left direction (panL) or the boundary in the right direction (panR) of the localization in the retrieving area.

In FIG. 10, ten boxes Po (black boxes) are arranged to indicate one or a plurality of extraction signals from a monaural signal that are in one frequency range. Incidentally, gaps (blank spaces) between each of the boxes Po serve merely to distinguish each of the boxes Po. In actuality, all of the boxes Po are consecutive without a gap (i.e., the frequency ranges of all of the boxes Po are consecutive).

As is shown in FIG. 10, the boxes Po are distributed so that each box alternates between panL and panR. In other words, the box Po shifts to the box PoL or the box PoR. Here, panL and panR are respectively the boundary in the left direction and the boundary in the right direction of the localizations in each of the retrieving areas O1 and O2.

After that, in the same manner as discussed above (e.g., with respect to FIGS. 8 and 9), the extraction signal that is contained in the box PoL from among the extraction signals in the retrieving area (i.e., the localization of the extraction signal is toward the panL side from panC) is shifted by linear mapping to the area that is indicated by the box PtL. That is, it is shifted by linear mapping to the area in which the acoustic image expansion functions YL[1](f) and YL[2](f) that have been disposed for each of the retrieving areas O1 and O2 form the boundary of the localization in the left direction).

On the other hand, the extraction signal that is contained in the box PoR from among the extraction signals in the retrieving area (i.e., the localization of the extraction signal is toward the panR side from panC) is shifted by linear mapping to the area that is indicated by the box PtR. That is, it is shifted by linear mapping to the area in which the acoustic image expansion functions YR[1](f) and YR[2](f) that have been disposed for each of the retrieving areas O1 and O2 form the boundary of the localization in the right direction).

As a result, the extraction signals from the monaural signal (i.e., the signals that are contained in the boxes Po) that are in the first retrieving area O1 ($f1 \leqq$ frequency $f \leqq f2$) are alternated in each frequency range and shifted to the localization that conforms to each frequency based on the acoustic image expansion function YL[1](f) or the acoustic image expansion function YR[1](f) (i.e., the box PtL or the box PtR). In the same manner, the boxes Po that are in the second retrieving area O2 ($f2 \leqq$ frequency $f \leqq f3$) are alternated in each frequency range and shifted to the localization that conforms to each frequency based on the acoustic image expansion function YL[2](f) or the acoustic image expansion function YR[2](f) (i.e., the box PtL or the box PtR).

In this manner, after the localization of the monaural musical tone signal has been, for a time, distributed (apportioned) to panL or panR that alternate in each consecutive frequency range that has been stipulated in advance, expansion or contraction of the acoustic image is carried out in the same manner as above (e.g., with respect to FIGS. 8 and 9). As a result, it is possible to impart a broad ambiance for which the balance is satisfactory.

In the same manner (as in the example that has been shown in FIG. 10), in those cases where the first retrieving area O1 is an area in which the frequency range is the midrange, the acoustic image expansion functions YL[1](f) and YR[1](f) for the first retrieving area O1 are made to have a relationship such that the localization is expanded on the high frequency side. In addition, in those cases where the second retrieving area O2 is an area in which the frequency range is the high frequency range, the acoustic image expansion functions YL[2](f) and YR[2](f) for the second retrieving area O2 are made to have a relationship such that the localization is narrowed on the high frequency side. As a result, it is possible to impart a desirable listening feeling.

Incidentally, in FIG. 10, an example has been shown of the case in which the range of localizations of the first retrieving range O1 and the range of localizations of the second retrieving range O2 are equal. However, in other embodiments, the ranges of the localizations of each of the retrieving areas O1 and O2 may also be different.

Next, an explanation will be given regarding the acoustic image scaling processing of embodiments relating to FIG. 11. FIG. 11 is a drawing that shows the major processing that is executed by an effector. Incidentally, the effector has an A/D converter that converts the monaural musical tone signal that has been input from the IN_MONO terminal from an analog signal to a digital signal.

Here, a monaural signal is made the input signal. Therefore, the processing that was carried out respectively for the left channel signal and the right channel signal in the effector discussed above (e.g., with respect to FIGS. 8 and 9) is executed for the monaural signal. In other words, the effector converts the time domain IN_MONO[t] signal that has been input from the IN_MONO terminal to the frequency domain IN_MONO[f] signal with the analytical processing section S50, which is the same as S10 or S20, and supplies this to the main signal processing section S30 (refer to FIG. 2).

In the monaural signal state, the localizations w[f] of each signal all become 0.5 (the center) (i.e. panC). Therefore, it is possible to omit the processing of S31 that is executed in the main processing section S30. Accordingly, with the main processing section 30, first, clearing of the memory is executed (S32). After that, the first retrieving processing (S100) and the second retrieving processing (S200) are executed, the extraction of the signals for each condition that has been set in advance is carried out, and, together with this, the other retrieving processing is carried out (S300).

Incidentally, the localizations w[f] of each monaural signal is in the center (panC). Therefore, in S100 and S200 of the embodiments relating to FIG. 11, it is not necessary to make a judgment as to whether or not the localizations w[f] of each signal are within the first or second setting range. In addition, in S100 and S200 of the above embodiments (e.g., with respect to FIGS. 8 and 9), the maximum level ML[f] was used in order to carry out the signal extraction. However, in the embodiments relating to FIG. 11, the level of the IN_MONO [f] signal is used. In addition, as discussed above, in the embodiments relating to FIG. 11, because this is a monaural signal, the processing that derives the localization w[f] (i.e., the processing of S31 in the embodiments relating to FIGS. 8 and 9) is omitted. However, even in those cases where the signal is a monaural one, the processing of S31 (i.e., the processing that derives the localization w[f] for the IN_MONO [f] signal in each frequency range that has been obtained by a Fourier transform) may be executed.

After the execution of the first retrieving processing (S100), preparatory processing that produces a pseudo stereo signal by the distribution (apportioning) of the localizations of the monaural extraction signal to the left and right is executed (S120). In the preparatory processing (S120), first, a judgment is made as to whether or not the frequency f of the signal that has been extracted is within an odd numbered frequency range from among the consecutive frequency ranges that have been stipulated in advance (S121). The consecutive frequency ranges that have been stipulated in advance are ranges in which, for example, the entire frequency range has been divided into cent units (e.g., 50 cent units or 100 cent (chromatic scale) units) or frequency units (e.g., 100 Hz units).

If from the processing of S121, the frequency f of the signal that has been extracted is within an odd numbered frequency range (S121: yes), the localization w[f][1] is made panL[1] (S122). If, on the other hand, the frequency f of the signal that has been extracted is within an even numbered frequency range (S121: no), the localization w[f][1] is made panR[1] (S123). After the processing of S122 or S123, a judgment is made as to whether or not the processing of S121 has completed for all of the frequencies that have been Fourier transformed (S124). In those cases where the judgment of S124 is negative (S124: no), the routine returns to the processing of S121. On the other hand, in those cases where the judgment of S124 is affirmative (S124: yes), the routine shifts to the first signal processing S110.

Therefore, with the preparatory processing (S120), the localizations of the extraction signal that satisfy the first condition are distributed alternately for each consecutive frequency range that has been stipulated in advance so as to become the localizations of the left and right boundaries of the first setting range that has been set for the localization (panL[1] and panR[1]).

After that, in the same manner as above (e.g., with respect to FIGS. 8 and 9), the processing of S117 and the processing of S111 are executed. As a result, the localizations of the extraction signals of the portion that is output from the left and right main speakers are shifted. On the other hand, the localizations of the extraction signals of the portion that is output from the left and right sub-speakers are shifted by the execution of the processing of S118 and the processing of S114. Here, the preparatory processing (S120) and the processing of S117 and S111, or the processing of S118 and S114 are equivalent to the acoustic image scaling processing.

On the other hand, after the execution of the second retrieving processing (S200), the preparatory processing for the extraction signals that have been extracted by the second retrieving processing (S200) is executed (S220). With regard to this preparatory processing (S220), other than the fact that the extraction signals have been extracted by second retrieving processing (S200), this is carried out in the same manner as the preparatory processing discussed above (S110). Therefore, this explanation will be omitted. With the preparatory processing (S220), the localizations of the extraction signals that satisfy the second condition are distributed alternately for each consecutive frequency range that has been stipulated in advance so as to become the localizations of the left and right boundaries of the second setting range that has been set for the localization (panL[2] and panR[2]).

After that, in the same manner as above (e.g., with respect to FIGS. 8 and 9), the processing of S217 and the processing of S211 are executed. As a result, the localizations of the extraction signals of the portion that is output from the left and right main speakers are shifted. On the other hand, the localizations of the extraction signals of the portion that is output from the left and right sub-speakers are shifted by the execution of the processing of S218 and the processing of S214. Here, the preparatory processing (S220) and the processing of S217 and S211, or the processing of S218 and S214 are equivalent to the acoustic image scaling processing.

As discussed above, after the monaural musical tone signal has just been distributed alternately in the consecutive frequency ranges that have been stipulated in advance, the expansion or contraction of the acoustic image is carried out. As a result, it is possible to impart a suitable broad ambiance to the monaural signal.

Next, an explanation will be given regarding further embodiments while referring to FIG. 12 through FIG. 15. In these embodiments, an explanation will be given regarding the user interface device (hereinafter, referred to as the "UI device") that provides a user interface capability for the effector. Incidentally, in these embodiments, the same reference numbers have been assigned to those portions that are the same as in the previous embodiments discussed above and their explanation will be omitted.

With reference to FIG. 1, the UI device comprises a control section that controls the UI device, the display device 121, and the input device 122. In some embodiments, the control section that controls the UI device is used in common with the configuration of the effector 1 as the musical tone signal processing apparatus discussed above. The control section comprises the CPU 14, the ROM 15, the RAM 16, the I/F 21 that is connected to the display device 121, the I/F 22 that is connected to the input device 122, and the bus line 17.

In various embodiments, the UI device may be configured to make the musical tone signal visible by the representation of the level distribution on the localization-frequency plane. The localization-frequency plane here comprises the localization axis, which shows the localization, and the frequency axis, which shows the frequency. Incidentally, with regard to the level distribution, this is a distribution of the levels of the musical tone signal that is obtained using and expanding a specified distribution.

Figure 12A:
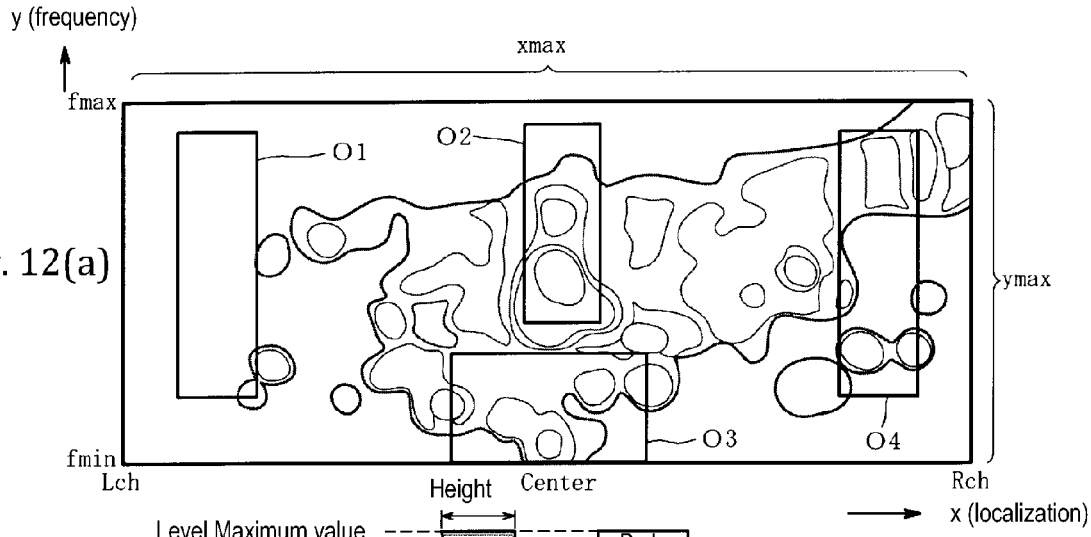
FIGS. 12(*a*)-12(*c*) are schematic diagrams of display contents displayed on a display device by a user interface apparatus according to an embodiment of the present invention.
Figure 12B:
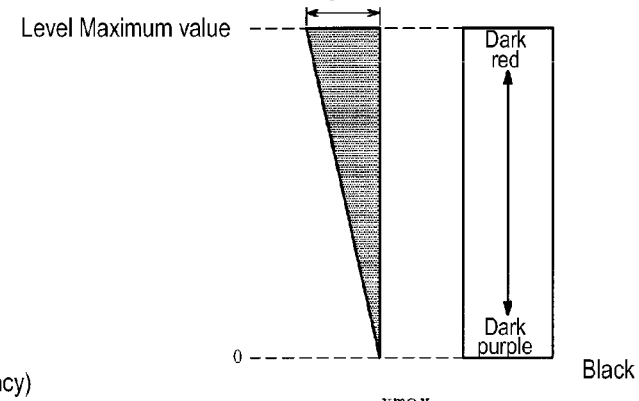
Figure 12C:
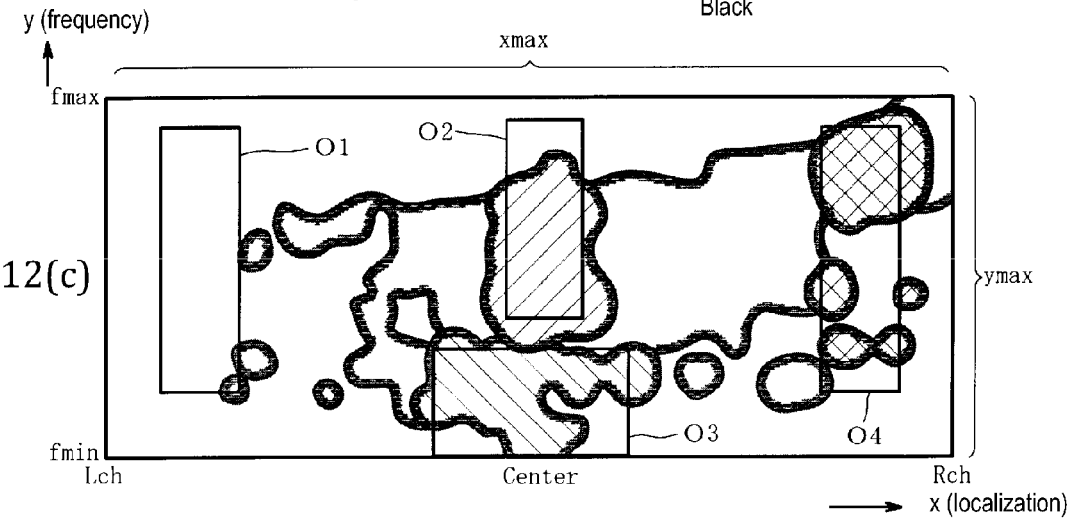

FIG. 12(*a*) is a schematic diagram of the levels of the input musical tone signal on the localization-frequency plane. The level distribution of the input musical tone signal is calculated using the signal at the stage after the processing of S31 that is executed in the main processing section S30 (refer to FIG. 4) discussed above (i.e., the processing that calculates the localization w[f] and the maximum level ML[f] of each frequency f) and before the execution of each retrieving processing (S100 and S200) and the other retrieving processing (S300). The calculation method will be below.

As shown in FIG. 12(*a*), the localization-frequency plan having a rectangular shape, in which the horizontal axis direction is made the localization axis and the vertical axis direction is made the frequency axis, is displayed in a specified area on the display screen (e.g., the entire or a portion of the display screen) of the display device 121 (refer to FIG. 1). In addition, the level distribution of the input musical tone signal is displayed on the localization-frequency plane. In other words, the levels for the level distribution of the input musical tone signal on the localization-frequency plane are displayed as heights with respect to the localization-frequency plane (i.e., the length of the extension in the front direction from the display screen).

Incidentally, FIG. 12(*a*) shows a case where one speaker is arranged on the left side and one speaker is arranged on the right side, and the range of the localization axis (the x-axis) of the localization-frequency plane is a range from the left end of the localization (Lch) to the right end of the localization (Rch). In addition, the center of the localization axis in the localization-frequency plane is the localization center (Center). On the display screen, an xmax number of pixels is allotted to the range of the localization axis (i.e., the localization range from Lch to Rch).

On the other hand, the range of the frequency axis (the y-axis) of the localization-frequency plane is the range from the lowest frequency fmin to the highest frequency fmax. The values of these frequencies fmin and fmax can be set appropriately. On the display screen, a ymax number of pixels is allotted to the range of the frequency axis (i.e., the range from fmin to fmax).

In various embodiments, the localization-frequency plane is displayed on the display screen (i.e., parallel to the display screen). Therefore, the height with respect to said plane is displayed by a change in the hue of the display color. Incidentally, in FIG. 12(*a*), which is a monochrome drawing, as a matter of convenience, the height is displayed by contour lines.

FIG. 12(*b*) is a schematic drawing that shows the relationship between the level (i.e., the height with respect to the localization-frequency plane) and the display color. With regard to the height with respect to the localization-frequency plane, in the case in which the level is "0," this is the minimum (height=0), and this gradually becomes higher as the level becomes higher. In the case in which the level is a "maximum value," this becomes a maximum. Incidentally, the "maximum value" here means the "maximum value" of the level used for the display. The "maximum value" of the level used for the display can be, for example, set as a value based on the maximum value of the level that is derived from the musical tone signal. Alternatively, the configuration may be such that the "maximum value" of the level used for the display may be a specified value or can be appropriately set by the user and the like.

As shown in FIG. 12(*b*), in conformance with the height (i.e., the level of the input musical tone signal) with respect to the localization-frequency plane, in the case where this is zero, the display color is made black (RGB (0, 0, 0)) and as the height (the level) becomes higher, the RGB value is successively changed in the order of dark purple→purple→indigo→blue→green→yellow→orange→red→dark red. In FIG. 12(*b*), which is a monochrome drawing, black corresponds to the case in which the level is "0" and the amount that the level moves toward the maximum value is expressed by text that corresponds to the color change from dark purple to dark red. In such embodiments, the display color table that maps the correspondence between the level and the display color is stored in the ROM 15 (e.g., FIG. 1). In addition, the display colors are set based on the level distribution that has been calculated.

The UI device, as shown in FIG. 12(*a*), expresses the input musical tone signal using the localization-frequency plane. Therefore, it is possible for the user to visually ascertain at which localization the signal of a specific frequency is positioned. In other words, the user can easily identify the vocal or instrumental signals that are contained in the input musical tone signal. In particular, the UI device displays the level distribution of the input musical tone signal on the localization-frequency plane. Therefore, the user is able to visually ascertain to what degree the signals of each frequency band are grouped together. Because of this, the user can easily identify the positions that the vocal or instrumental unit signal groups exist.

The UI may be configured such that the area that is stipulated by the localization range and the frequency range (the retrieving area) may be set as desired using the input device 122 (e.g. FIG. 1). By setting the retrieving area using the UI device, and the retrieving processing (S100 and S200), which has been discussed above, in the DSP 12 of the effector 1, it is possible to obtain an extraction signal with the localization range and frequency range of the retrieving area and the level made the conditions.

In FIG. 12(*c*), the display results are shown for the case in which the user has set the four retrieving areas O1 through O4 for the display of FIG. 12(*a*) using the input device 122 (e.g., FIG. 1). The settings of the retrieving areas are set using the input device 122 of the UI device. For example, the setting is done by placing the pointer on the desired location by operation of the mouse and drawing a rectangular area by dragging. Incidentally, the retrieving area may be set in a shape other than a rectangular area (e.g., a circle, a trapezoid, a closed loop having a complicated shape in which the periphery is irregular, and the like).

In addition, level distribution of the extraction signals that have been extracted in each retrieving area that has been set is calculated when the settings of the retrieving area have been confirmed. Then, as shown in FIG. 12(*c*), the level distribution that has been calculated is displayed with the display colors changed in each retrieving area. As a result, the level distribution of the extraction signals may be differentiated in each retrieving area. In FIG. 12(*c*), which is a monochrome drawing, as a matter of convenience, the differences in the display colors for each level distribution in each retrieving area O2, O3, and O4 are represented by differences in the hatching. Incidentally, because signals that have been extracted from the retrieving area O1 are not present, there are no changes by differences of the hatching in the retrieving area O1.

The level distribution of each extraction signal is calculated using the signals that have been extracted from each of the retrieving areas by each retrieving processing (S100 and S200) that is executed in the main processing section S30 (refer to FIG. 4) discussed above. In FIG. 4 discussed above, the first retrieving processing (S100) and the second retrieving processing (S200) here are executed for two retrieving areas. However, in those cases where four retrieving areas O1 through O4 have been set as in FIG. 12(*c*), retrieving processing is carried out respectively for the four retrieving areas.

In addition, the level distribution of the signals of the areas other than the retrieving areas is also calculated using the signals that have been retrieved by the other retrieving processing (S300). Then, they are displayed by a display color that differs from that of the level distribution of the extraction signals of each of the retrieving areas previously discussed. In FIG. 12(*c*), which is a monochrome drawing, as a matter of convenience, hatching has not been applied in the areas of the level distribution for the areas other than the retrieving areas. As a result, the fact that the display colors of the level distribution of the areas other than the retrieving areas are different from the retrieving areas discussed above is represented.

In addition, in those cases where the retrieving areas have been set, the levels of the extraction signals of each retrieving area (i.e., the height with respect to the localization-frequency plane) is expressed by the changes in the degree of brightness of each display color. Specifically, the higher the level of the extraction signal, the higher the degree of brightness of the display color. In the same manner, for the levels of the signals of the areas other than the retrieving areas, the higher the level of the signals of the areas other than the retrieving areas, the higher the degree of brightness of the display color. In FIG. 12(*c*), which is a monochrome drawing, the difference in the degree of brightness of the display color is simplified and represented by making the display of just the base areas of the level distribution (i.e., the portion that the level is low) dark.

Incidentally, in the example shown in FIG. 12(*c*), the level distributions of the extraction signals that have been calculated for each retrieving area are displayed with a change in the display color for each retrieving area. In addition, even when a plurality of retrieving areas has been set, for the display colors of the level distribution of the extraction signals in each retrieving area, colors that are different from those of level distribution of the signals of the areas other than the retrieving areas are required. However, these may also all be the same colors.

In this manner, when a retrieving area has been set, the UI device displays the level distribution of the extraction signals of each retrieving area in a state that differs from that of other areas. Therefore, the user can identify and recognize the extraction signals that have been extracted due to the setting of the retrieving areas from other signals. Accordingly, the user can easily confirm whether a signal group of vocal or instrumental units has been extracted.

An explanation will be given here regarding the method for the calculation of the level distribution of the input musical tone signal in the localization-frequency plane. For the calculation of the level distribution of the input musical tone signal, the signal at the stage after the processing of S31, which is executed in the main processing section S30 (refer to FIG. 4) discussed above, and before the execution of each retrieving processing (S100 and S200) and the other retrieving processing (S300) is used. The level distribution P(x, y) is calculated using the previously mentioned signal by expanding the levels for each frequency f as the normal distribution and combining the distributions obtained (i.e., the level distribution) for all of the frequencies. In other words, the calculation can be done using the following formula (1).

$$P(x, y) = \sum_{b=0}^{n} \left(\text{level}[b] \times e^{-((x-W(b))\wedge 2+(y-F(b))\wedge 2)\times coef}\right) \tag{1}$$

Incidentally, in the formula (1), b is the BIN number, i.e., a number that is applied as a serial number to each one of all of the frequencies f as a control number that manages each frequency f. In addition, level[b] is the level of the frequency that corresponds to the value of b. In some embodiments, the maximum level ML[f] of the frequency f is used.

W(b) is the pixel location in the localization axis direction in the case where the display range of the localization-frequency plane is the pixel number xmax (refer to FIG. 12(*a*)). In those cases where there are one left and one right output terminal, W(b) is calculated using the formula (2a) (below). For instance, w[b] indicates the localization (i.e., w[f]) that corresponds to the value of b and in those cases where there is one left and one right output terminal, the value w[f] is a value from 0 to 1. Therefore, W(b) is calculated using the formula (2a). In addition, in those cases where there are two left and two right output terminals, the value of w[f] is a value from 0.25 to 0.75. Therefore, W(b) is calculated using the formula (2b).

$$W(b)=w[b]\times x\text{max(one left and one right output terminal)} \tag{2a}$$

$$W(b)=(w[b]-0.25)\times 2\times x\text{max(two left and two right output terminals)} \tag{2b}$$

F(b) is the pixel location in the frequency axis direction in the case in which the display range of the localization-frequency plane is the pixel number ymax in the frequency axis direction (refer to FIG. 12(*a*)). F(b) can be calculated using the formula (3) (below). Incidentally, in the formula (3), fmin and fmax are, respectively, the lowest frequency and the highest frequency that are displayed in the frequency axis direction in the localization-frequency plane.

$$F(b)=(\log(f[b]/f\text{min})/\log(f\text{max}/f\text{min}))\times y\text{max} \tag{3}$$

Incidentally, the formula (3) is applied in the case in which the frequency axis is made a logarithmic axis. The frequency axis may also be made a linear axis with respect to the frequency. In that case, it is possible to calculate the pixel location using formula (3')

$$F(b)=((f[b]-f\text{min})/(f\text{max}-f\text{min}))\times y\text{max} \tag{3'}$$

In addition, the coef in the formula (1) is a variable that determines the base spread condition or the peak sharpness condition (degree of sharpness) of the level distribution that is a normal distribution. By suitably adjusting the value of the coef, it is possible to adjust the resolution of the peak in the level distribution that is displayed (i.e., the level distribution of the input musical tone signal). As a result, the signals can be grouped. Therefore, it is possible to easily discriminate the vocal and instrumental signal groups that are contained in the input musical tone signal.

Figure 13A:
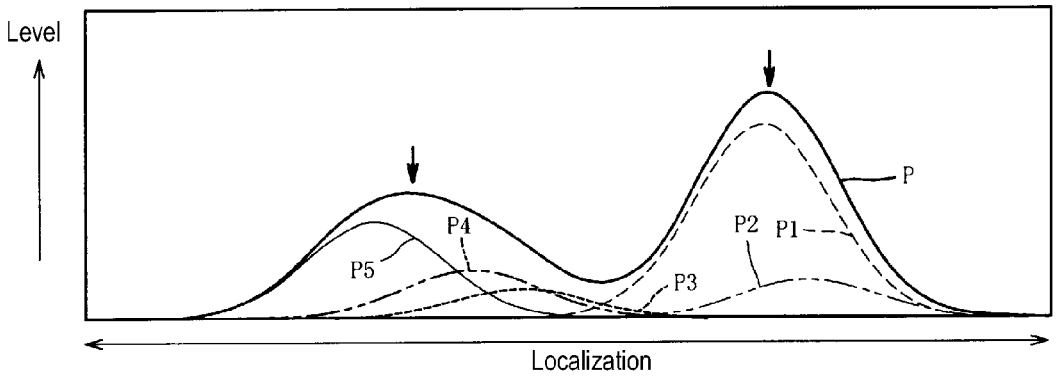
FIGS. 13(*a*)-13(*c*) are cross section drawings of level distributions of a musical tone signal on a localization-frequency plane for some frequency according to an embodiment of the present invention.
Figure 13B:
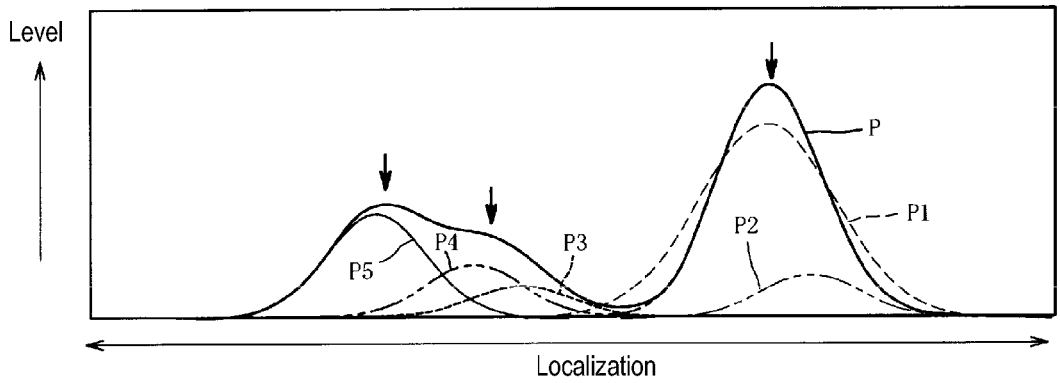
Figure 13C:
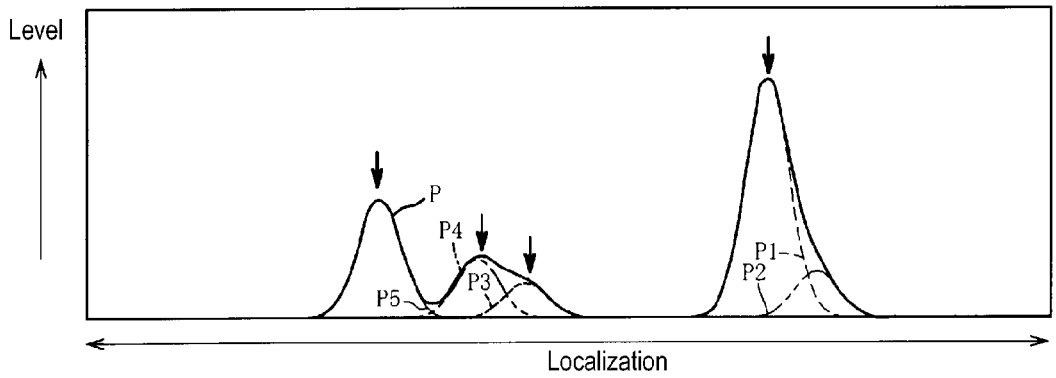

FIGS. 13(*a*)-13(*c*) are cross-section drawings for a certain frequency of the level distribution of a musical tone signal on the localization-frequency plane. In each of FIGS. 13(*a*)-13

(*c*), the direction of a horizontal axis shows localization and the direction of a vertical axis shows level. FIG. 13(*a*) through FIG. 13(*c*) show the level distribution P of the input musical tone signal in those cases where the setting of the base spread condition (i.e., the value of coef) of the level distributions P1 through P5 of each frequency have been changed.

Specifically, the spread condition of the level distributions P1 through P5 is set narrower in the order of FIG. 13(*a*), FIG. 13(*b*), and FIG. 13(*c*). As demonstrated in FIG. 13(*a*) through FIG. 13(*c*), the greater the base spread condition of the level distributions P1 through P5 of each frequency, the smoother the curve of the level distribution P becomes, and the lower the resolution of the peaks becomes.

In the example shown in FIG. 13(*a*), in which the base spread condition of the level distribution P1 through P5 of each frequency is greatest, there are two peaks of the level distribution P as indicated by the arrows. In the example that is shown in FIG. 13(*b*), in which the base spread condition of the level distribution P1 through P5 of each frequency is smaller than FIG. 13(*a*), a shoulder is formed near the peak of the level distribution P4. In the example that is shown in FIG. 13(*c*), in which the base spread condition of the level distribution P1 through P5 of each frequency is even smaller than FIG. 13(*b*), the portion that was a shoulder in the example shown in FIG. 13(*b*) has become a peak; and, in addition, a shoulder is formed in the vicinity of the peak of the level distribution P3. Therefore, by adjusting the value of coef in the formula (1), it is possible to freely represent the input musical tone signal, grouping the signals of each frequency, or making the location of the individual signals distinct.

Incidentally, an explanation was given of the calculation of the level distribution of the input musical tone signal using the formula (1). However, it should be noted that in those cases where the retrieving area is set and the level of the extracted signal is displayed (i.e., in the case of FIG. 12(*c*)), rather than using the BIN number as the value of b, the value in which the serial number has been applied to the extracted signal may be used for each retrieving area. By doing it in that manner, it is possible to do the calculation with a formula that is the same as the formula (1). In other words, it is possible to calculate the level distribution for each of the retrieving areas by combining all of the level distributions of the extraction signals in each retrieving area. The level distribution of each extraction signal is calculated using the signals that have been extracted from each retrieving area by each retrieving processing (S100 and S200) that is executed in the main processing section S30 (refer to FIG. 4) discussed above.

Figure 14A:
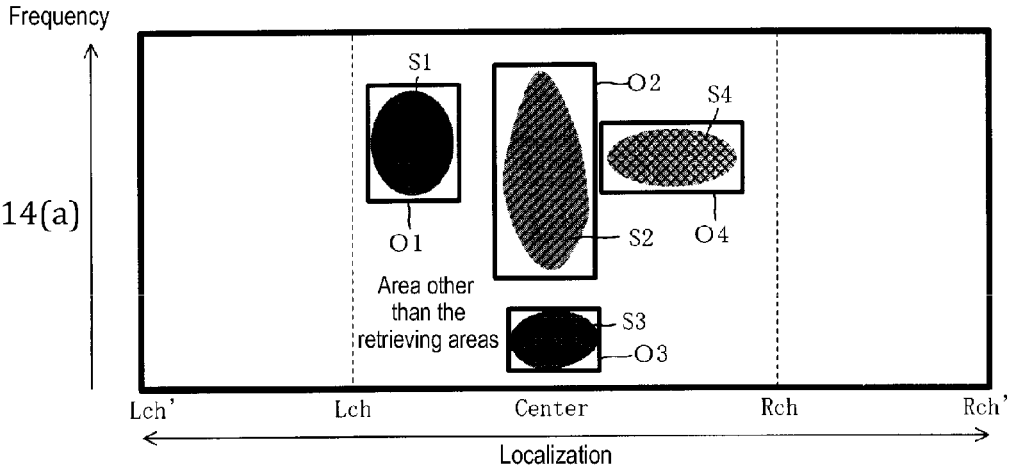
FIGS. 14(*a*)-14(*c*) are schematic diagrams of designated inputs to a musical tone signal processing system according to an embodiment of the present invention.
Figure 14B:
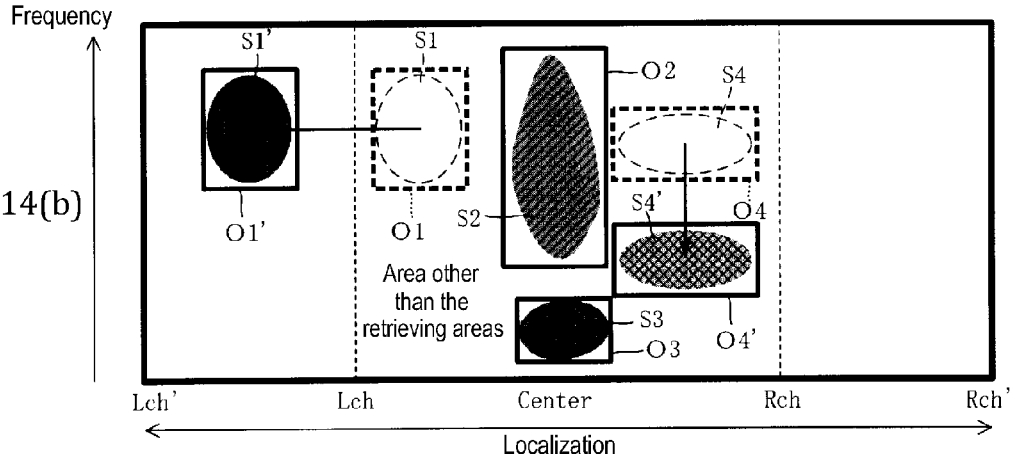
Figure 14C:
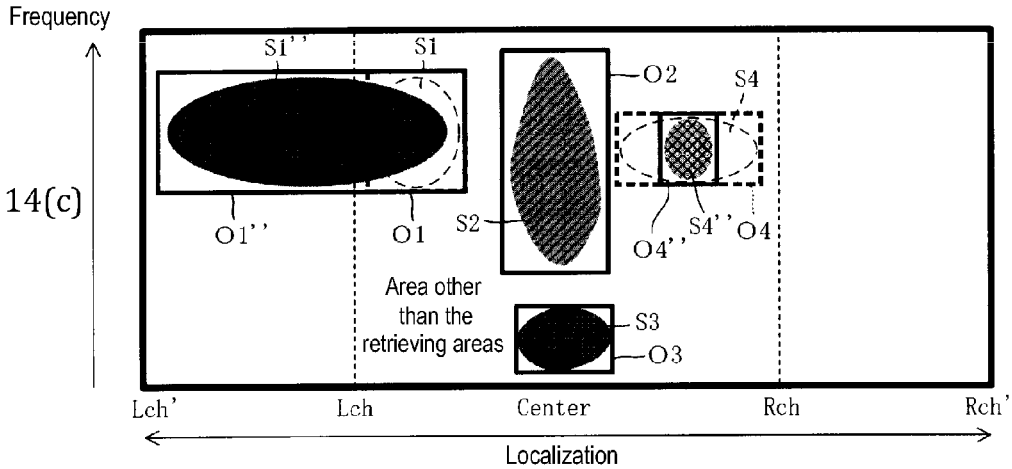

FIG. 14(*a*) is a drawing that shows the details of the distribution from the input musical tone signal in the localization-frequency plane for the case in which the four retrieving areas O1 through O4 have been set. However, it should be noted that the illustration of the areas other than the retrieving areas has been omitted from the drawing. In FIG. 14(*a*), the displayed screen in a case where there are two left and two right output terminals is shown in the drawing. Because of this, the signals in each of the retrieving areas O1 through O4 that have been extracted from the input musical tone signal are located between Lch and Rch (i.e., between 0.25 and 0.75).

When the four retrieving areas O1 through O4 have been set, the level distributions S1 through S4 of the extraction signals that have respectively been extracted from each of the retrieving areas O1 through O4 are calculated. In that calculation, the signals that have been extracted from each retrieving area by the retrieving processing in the same manner as the first or the second retrieving processing (S100, S200) that is executed in the main processing section S30 (refer to FIG. 4) discussed above are used. In addition, the level distributions S1 through S4 are displayed in different display states (i.e., the display colors are changed) for each of the retrieving areas O1 through O4. Incidentally, in FIG. 14(*a*), which is a monochrome drawing, the difference in the display colors for each of the level distributions of each of the retrieving areas O1 through O4 is represented by a difference in the hatching. Furthermore, in FIG. 14(*a*), the illustration of the signals other than those of the retrieving areas (i.e., the signals that have been retrieved by the other retrieving processing (S300)) is omitted as has been discussed above.

FIG. 14(*b*) is a drawing regarding the case in which the retrieving area O1 and the retrieving area O4 have been shifted in the localization-frequency plane from the state in which the four retrieving areas O1 through O4 have been set and the signals in each of the retrieving areas have been extracted from the input musical tone signal (the state shown in FIG. 14(*a*)). Incidentally, in this example, there is no change at all with regard to the retrieving area O2 and the retrieving area O3.

In some embodiments, the retrieving areas on the localization-frequency plane that are displayed on the display screen of the display device 121 are shifted using the input device 122 (e.g., FIG. 1). As a result, the change of the localization and/or the frequency of the extraction signals in the retrieving area of the source into the localization and/or the frequency that conforms to the area that is the destination of the shift of the retrieving area is directed to the musical tone signal processing apparatus (e.g., the effector 1). Incidentally, the shifting of the retrieving area is set using the input device 122 of the UI device. For example, the user may use a mouse or the like to operate a pointer to place the pointer, select the desired retrieving area, and then shift to the desired location by dragging the mouse.

In those cases where (e.g., the retrieving area O1) the retrieving area is shifted along the localization axis without changing the frequency, the UI device supplies the instruction that shifts the localization of the extraction signals that have been extracted within the retrieving area O1 to the corresponding location (the localization) of the retrieving area O1' to the effector. In other words, in some embodiments, shifting of the localization of the extraction signals that have been extracted from the retrieving area to the musical tone signal processing apparatus (the effector 1) is possible by shifting the retrieving area along the localization axis at a constant frequency.

When the effector receives this instruction, the effector may shift the localization of the extraction signals that have been extracted from the retrieving area O1 in the processing that adjusts the localization, which is executed in the signal processing that corresponds to the retrieving area. Here, for example, in those cases where it is the retrieving area that extracts the signals by the first retrieving processing (S100), the processing that adjusts the localization is the processing of S111, and S114 that are executed in the first signal processing (S110).

At this time, the localization that is made the target is the localization of the corresponding location in the retrieving area O1' of each extraction signal that has been extracted from the retrieving area O1. The corresponding location here is the location to which each extraction signal that has been extracted from the retrieving area O1 has been shifted by only the amount of shifting of the retrieving area (i.e., the amount of shifting from the retrieving area O1 to the retrieving area O1').

On the other hand, in those cases where (e.g., the retrieving area O4) the retrieving area has been shifted along the frequency axis without changing the localization, the UI device supplies the instruction to the effector that changes the frequency of the extraction signal that has been extracted from the retrieving area O4 to the corresponding location (the frequency) of the retrieving area O4'. In other words, in such embodiments, the instruction of the change of the frequency (i.e., the change of the pitch) of the extraction signals that have been extracted from the retrieving area to the effector is possible by shifting the retrieving area along the frequency axis at a constant localization.

When the effector receives the applicable instruction, the effector changes the pitch (the frequency) of the extraction signals that have been extracted from the retrieving area O4, using publicly known methods, to the pitch that conforms to the amount of the shift of the retrieving area in the finishing processing that is executed in the signal processing that corresponds to the retrieving area. The finishing processing here is, for example, in those cases where it is the retrieving area that extracts the signal by the first retrieving processing (S100), the processing of S112, S113, S115, and S116 that is executed in the first signal processing (S110).

Incidentally, in FIG. 14(*b*), the example has been shown of the case in which the retrieving area O1 is shifted in the direction along the localization axis without changing the frequency and the retrieving area O4 is shifted in the direction along the frequency axis without changing the localization. However, the retrieving area may also be shifted in a diagonal direction (i.e., in a direction that is not parallel to the localization axis and is not parallel to the frequency axis). In that case, each of the extraction signals that have been extracted from the source retrieving area is changed both in the localization and in the pitch.

In addition, in those cases where the retrieving area has been shifted on the localization-frequency plane, the UI device may be configured to perform the control such that the level distributions of the extraction signals that have been extracted from the source retrieving area are displayed in the shifting destination retrieving area.

Specifically, in the case where the retrieving area O1 has been shifted to the retrieving area O1', the display of the level distribution S1 of the extraction signals that have been extracted from the retrieving area O1 is switched to the display of the level distribution S1' of the extraction signals of the shifting destination. Incidentally, in the case where the localization has been shifted, the level distribution of the extraction signals of the shifting destination is calculated for the extraction signals that have been extracted from the source retrieving area applying the coefficients used for the adjustment of the localization ll, lr, rl, rr, ll', lr', rl', and rr' in the localization adjustment processing (the processing of S111, S114, S211, and S214). Alternatively, the level distribution of the extraction signals of the shifting destination may be calculated using the signals after the execution of the finishing processing (S112, S113, S115, S116, S212, S213, S215, and S216).

In the same manner, in the case where the retrieving area O4 has been shifted to the retrieving area O4', the display of the level distribution S4 of the extraction signals that have been extracted from the retrieving area O4 is switched to the display of the level distribution S4' of the extraction signals of the shifting destination. Incidentally, in the case where the frequency (pitch) has been shifted, the level distribution of the extraction signals of the shifting destination is calculated for the extraction signals that have been extracted from the source retrieving area, applying the numerical values that are applied for changing the pitch in the finishing processing (S112, S113, S115, S116, and the like).

FIG. 14(*c*) is a drawing for the explanation of the case in which the retrieving area O1 is expanded in the localization direction and the retrieving area O4 is contracted in the localization direction from the state of the signals in each of the retrieving areas that have been extracted from the input musical tone signal in which the four retrieving areas O1 through O4 have been set (the state shown in FIG. 14(*a*)). Incidentally, in this example, there have been no changes made to the retrieving areas O2 and O3.

In some embodiments, the UI changes the width in the localization direction of the retrieving area on the localization-frequency plane that is displayed on the display screen of the display device 121 using the input device 122 (e.g., FIG. 1). As a result, it is possible to expand or contract the acoustic image that is formed from the extraction signals of the retrieving area.

Incidentally, the change in the width of the retrieving area in the localization direction (the expansion or contraction in the localization direction) is set using the input device 122 of the UI device. For example, the pointer (e.g., mouse pointer) is placed on one side or peak of the retrieving area by (but not limited to) a mouse operation and dragged to the other side of the peak. In addition, it is also possible to select the respective side that becomes the localization boundary on the left or right of the retrieving area and (e.g., using a keyboard, mouse, or the like) set the acoustic image expansion functions YL(f) and YR(f) discussed above that are applied to each of the sides in order to carry out the expansion or the contraction of the retrieving area in the localization direction.

In those cases where the shape of the retrieving area O1 has been changed to that of the retrieving area O1", the UI device supplies an instruction that maps (e.g., linear mapping) each of the extraction signals that have been extracted from the retrieving area O1 to the musical tone signal processing apparatus (e.g., the effector 1).

When the effector 1 receives the instruction, the effector maps the extraction signals that have been extracted from the retrieving area O1 in the acoustic image scaling processing, which is executed in the signal processing that corresponds to the retrieving area, in the retrieving area O1". As a result, the expansion of the acoustic image that is formed from the extraction signals that have been extracted from the retrieving area O1 is provided. The acoustic image scaling processing is, for example, in those cases where the retrieving area extracts the signals by the first retrieving processing (S100), the processing of S117, and S111, or S118 and S112 that is executed in the first signal processing (S110).

On the other hand, in those cases where the shape of the retrieving area O4 has been changed into that of the retrieving area O4", the UI device supplies an instruction that maps each of the extraction signals that have been extracted from the retrieving area O4 in conformance with the shape of the retrieving area O4" to the effector. The effector, in the same manner as in the case of the retrieving area O1 discussed above, maps the extraction signals that have been extracted from the retrieving area O4 in the acoustic image scaling processing, which is executed in the signal processing that corresponds to the retrieving area, in the retrieving area O4". The acoustic image scaling processing is, for example, in those cases where the retrieving area extracts the signals by the second retrieving processing (S200), the processing of S217, and S211, or S218 and S212 that is executed in the second signal processing (S210).

Incidentally, in FIG. 14(*c*), the example has been shown of the case in which the retrieving areas O1 and O4 are expanded or contracted in the localization axis direction (i.e., the case in which there is a broadening or a narrowing in the x-axis direction). However, it is possible to expand the pitch scale or to expand the frequency band of the retrieving area by expanding the retrieving area in the frequency direction. In the same manner, it is possible to narrow the pitch scale or the frequency band of the retrieving area that is the target by contracting the retrieving area in the frequency direction.

In addition, in those cases where the width of the retrieving area has been changed in the localization direction on the localization-frequency plane, the UI device performs the control such that the level distributions of the extraction signals that have been extracted from the mapping source retrieving area are displayed in the mapping destination retrieving area.

Specifically, in those cases where the shape of the retrieving area O1 has been changed into the retrieving area O1", the display of the level distribution S1 of the extraction signals that have been extracted from the retrieving area O1 is switched to the display of the level distribution S1" of the extraction signals in the mapping destination (i.e., the retrieving area O1"). In the same manner, in those cases where the shape of the retrieving area O4 has been changed into the retrieving area O4", the display of the level distribution S4 of the extraction signals that have been extracted from the retrieving area O4 is switched to the display of the level distribution S4" of the extraction signals in the mapping destination (i.e., the retrieving area O4").

Incidentally, in this case, the level distribution of the extraction signals of the mapping destination is calculated for the extraction signals that have been extracted from the mapping source retrieving area applying the coefficients used for the adjustment of the localization ll, lr, rl, rr, ll', lr', rl', and rr' in the localization adjustment processing (the processing of S111, S114, S211, and S214) after the processing that calculates the amount of the shift of the localization of the extraction signals (the processing of S117, S118, S217, and S218).

Accordingly, in such embodiments, the user can freely set the retrieving area as desired while viewing the display (the level distribution on the localization-frequency plane) of the display screen. In addition, the user can, by the shifting or the expansion or contraction of the retrieving area that has been set, process the extraction signals of that retrieving area. In other words, it is possible to freely and easily carry out the localization shifting or the expansion or contraction of the vocal or instrumental musical tones by setting the retrieving area such that an area in which vocals or instruments are present is extracted.

Figure 15A:
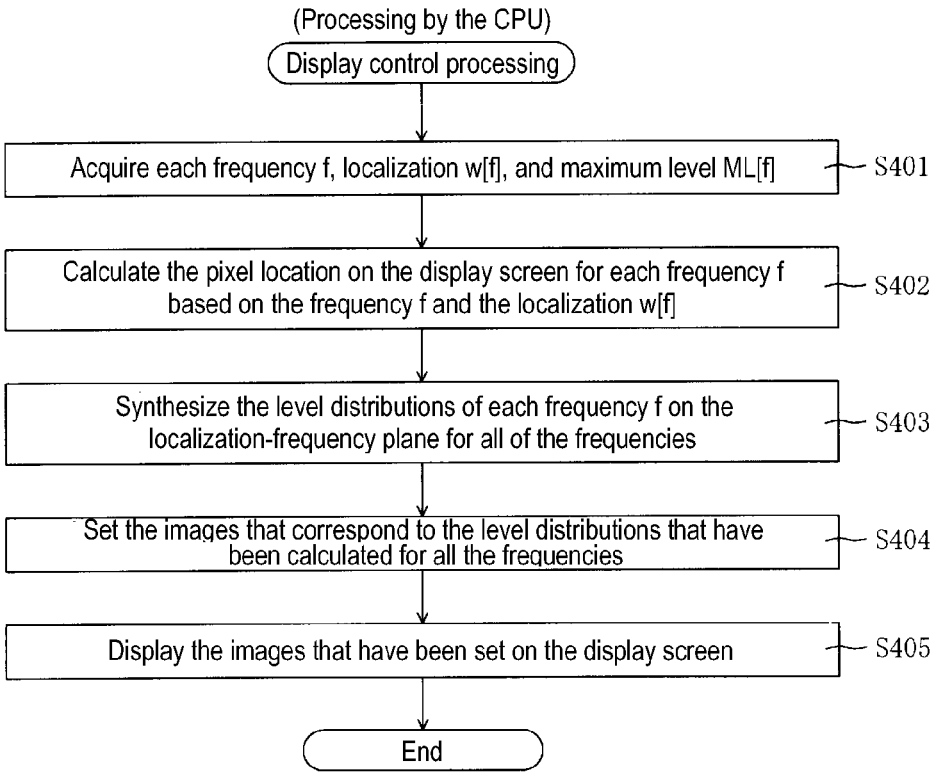
FIG. 15(*a*) is a flowchart of a display control process according to an embodiment of the present invention.
Figure 15B:
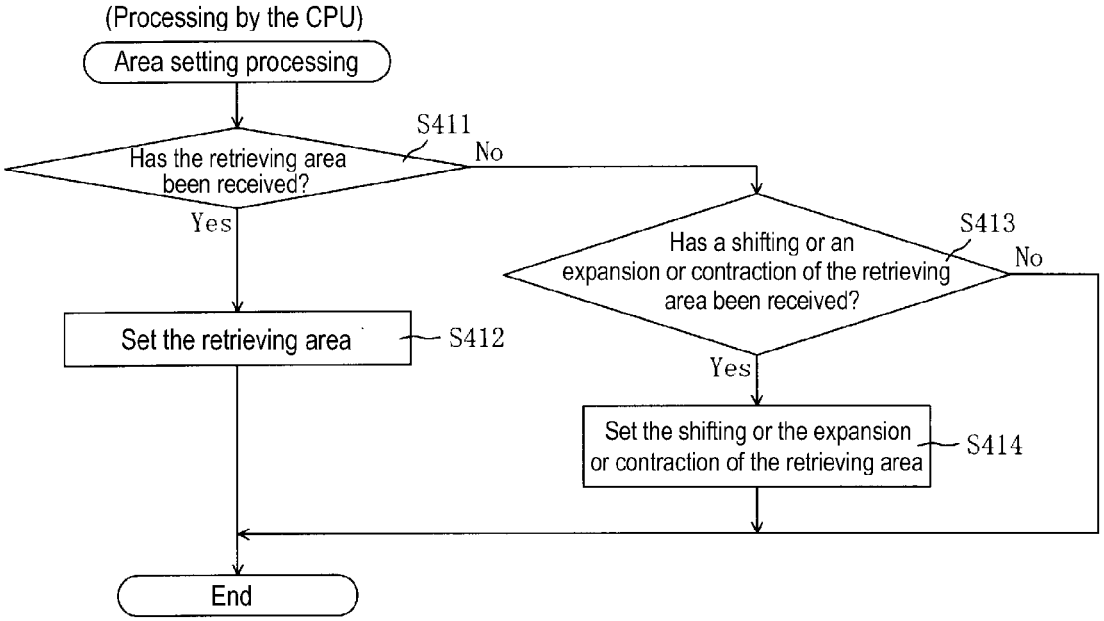

Next, an explanation will be given regarding the display control processing that is carried out by the UI device while referring to FIG. 15(*a*). FIG. 15(*a*) is a flowchart that shows the display control processing that is executed by the CPU 14 (refer to FIG. 1) of the UI device (e.g., as discussed in FIGS. 12(*a*)-14(*c*). Incidentally, this display control processing is executed by the control program 15*a* that is stored in the ROM 15 (refer to FIG. 1)

The display control processing is executed in those cases where an instruction that displays the level distribution of the input musical tone signal has been input by the input device 122 (refer to FIG. 1), those cases where the setting of the retrieving area has been input by the input device 122, those cases where the setting that shifts the retrieving area on the localization-frequency plane has been input by the input device 122, or those cases where the setting for the expansion or contraction of the acoustic image in the retrieving area has been input by the input device 122.

The display control processing first acquires each frequency f, localization w[f], and maximum level ML[f] for the signals that are the object of the processing (the input musical tone signal of the frequency domain, the extraction signal, the signal for which the localization or the pitch has been changed, and the signal after the expansion or contraction of the acoustic image) (S401). For the values of each frequency f, localization w[f], and maximum level ML[f], the values that have been calculated in the DSP 12 (refer to FIG. 1) may be acquired. In addition, for these values, the target signals in the processing by the DSP 12 may be acquired and the calculation in the CPU 14 done from the frequencies and levels of the target signals that have been acquired.

Next, the pixel location of the display screen is calculated as discussed above for each frequency f based on the frequency f and the localization w[f] (S402). Then, based on the pixel location of each frequency and the maximum level ML[f] of that frequency f, the level distributions of each frequency f on the localization-frequency plane are combined for all of the frequencies in accordance with the formula (1) (S403). In S403, in those cases where there is a plurality of areas for the calculation of the level distributions of each frequency f on the localization-frequency plane, the calculation of the applicable level distributions is carried out in each of the areas.

After the processing of S403, the setting of the images in conformance with the level distributions that have been combined for all of the frequencies is carried out (S404). Then, the images that have been set are displayed on the display screen of the display device 121 (S405) and the display control processing ends. Incidentally, in the processing of S404, in those cases where the signal that is the object of the processing is the input musical tone signal of the frequency domain, a relationship between the level and the display color such as that shown in FIG. 12(*b*) is used and the image is set so that the display details become those shown in FIG. 12(*a*).

In addition, in those cases where the signal that is the object of the processing is the extraction signal that has been extracted from retrieving area, as is shown in FIG. 12(*c*), the image is set so that the display color of each of the retrieving areas is different and the higher the level, the brighter the color. In addition, the images of the level distributions of the signals in the area other than the retrieving area form the lowest image layer. In other words, the image is set such that level distributions of the extraction signals that have been extracted from the retrieving area are displayed preferentially.

Next, an explanation will be given regarding the area setting processing that is carried out by the UI device while referring to FIG. 15(*b*). FIG. 15(*b*) is a flowchart that shows the area setting processing that is executed by the CPU 14 of the UI device. Incidentally, the area setting processing is executed by the control program 15*a* that is stored in the ROM 15 (refer to FIG. 1).

The area setting processing is executed periodically and monitors whether a retrieving area setting has been received, a retrieving area shift setting has been received, or a retrieving area expansion or contraction setting in the localization direction has been received. First, a judgment is made as to whether said setting has been received by the input device 112 (refer to FIG. 1) in accordance with the setting of the retrieving area (S411). Then, in those cases where the judgment is affirmative (S411: yes), the retrieving area is set in the effector (S412) and the area setting processing ends. When the retrieving area is set in S412, the effector extracts the input musical tone signal in the retrieving area that has been set.

If the judgment of S411 is negative (S411: no), a judgment is made as to whether the setting of the shifting or the expansion or contraction of the retrieving area is confirmed and the setting of the shifting or the expansion or contraction of the retrieving area has been received by the input device 112

(S413). In those cases where the judgment of S413 is negative (S413: no), the area setting processing ends.

On the other hand, in those cases where the judgment of S413 is affirmative (S413: yes), the shifting or the expansion or contraction of the retrieving area is set in the effector (S414) and the area setting processing ends. When the shifting or the expansion or contraction of the retrieving area is set in S414, the effector executes the signal processing for the extraction signals in the target retrieving area in conformance with the setting. Then, the change of the localizations (shifting) or the pitch of the extraction signals in said retrieving area, or the expansion or contraction of the acoustic image that is formed from the extraction signals in said retrieving area is carried out.

As discussed above, in various embodiments, the UI displays the level distributions, which are obtained using the formula (1) described above from the musical tone signal that has been input to the effector, on the display screen of the display device 121 in a manner in which the three-dimensional coordinates that are configured by the localization axis, the frequency axis, and the level axis are viewed from the level axis direction. The level distribution is obtained using the formula (1) described above. In other words, the level distribution of each frequency f in the input musical tone signal (in which the levels of each frequency have been expanded as a normal distribution) is combined for all of the frequencies.

Therefore, the user can visually ascertain the signals that are near a certain frequency and near a certain localization (i.e., by the state in which the signal groups of the vocal or instrumental units have been grouped). As a result, it is possible to easily identify the areas in which the vocal or instrumental units are present from the contents of the display of the display screen. Therefore, the operation that extracts these as the objects of the signal processing and that sets the processing details after that (e.g., the shifting of the localization, or the expansion or contraction of the acoustic image, the changing of the pitch, and the like) can be easily carried out.

In addition, according to various embodiments, the results of each signal processing that is carried out for each retrieving area (the shifting of the localization, or the expansion or contraction of the acoustic image, the changing of the pitch, and the like) are also represented on the localization-frequency plane. Therefore, the user can visually perceive said processing results prior to the synthesizing of the signals and can process the sounds of the vocal and instrumental units according to the user's image.

Next, an explanation will be given regarding additional embodiments while referring to FIG. 16. Incidentally, the same reference numbers have been assigned to those portions that are the same as other embodiments and their explanation will be omitted. Furthermore, the UI device of these embodiments is configured the same as the UI device discussed with respect to FIGS. 12(*a*)-15(*b*).

The UI device of these embodiments is designed to make the musical tone signal visible by displaying specified graphics in the locations that conform to the frequencies f and the localizations w[f] of the musical tone signal on the localization-frequency plane in a state that conforms to the levels of the musical tone signal.

Figure 16A:
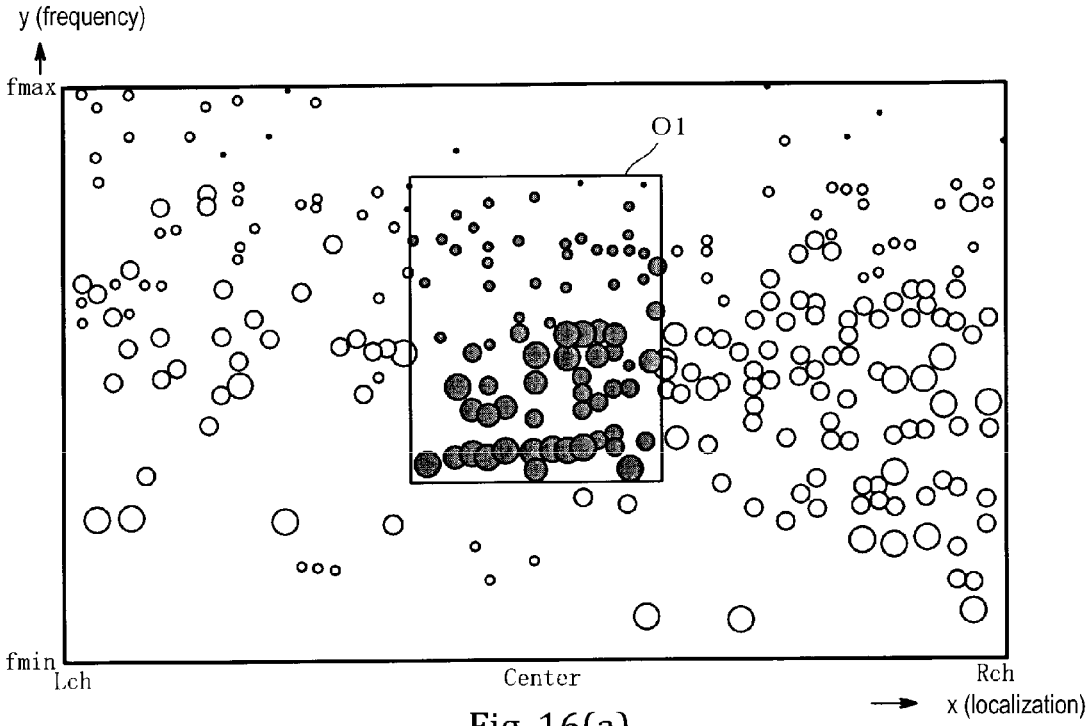
FIGS. 16(*a*) and 16(*b*) are schematic diagrams of display contents that are displayed on a display device by a user interface apparatus according to an embodiment of the present invention.
Figure 16B:
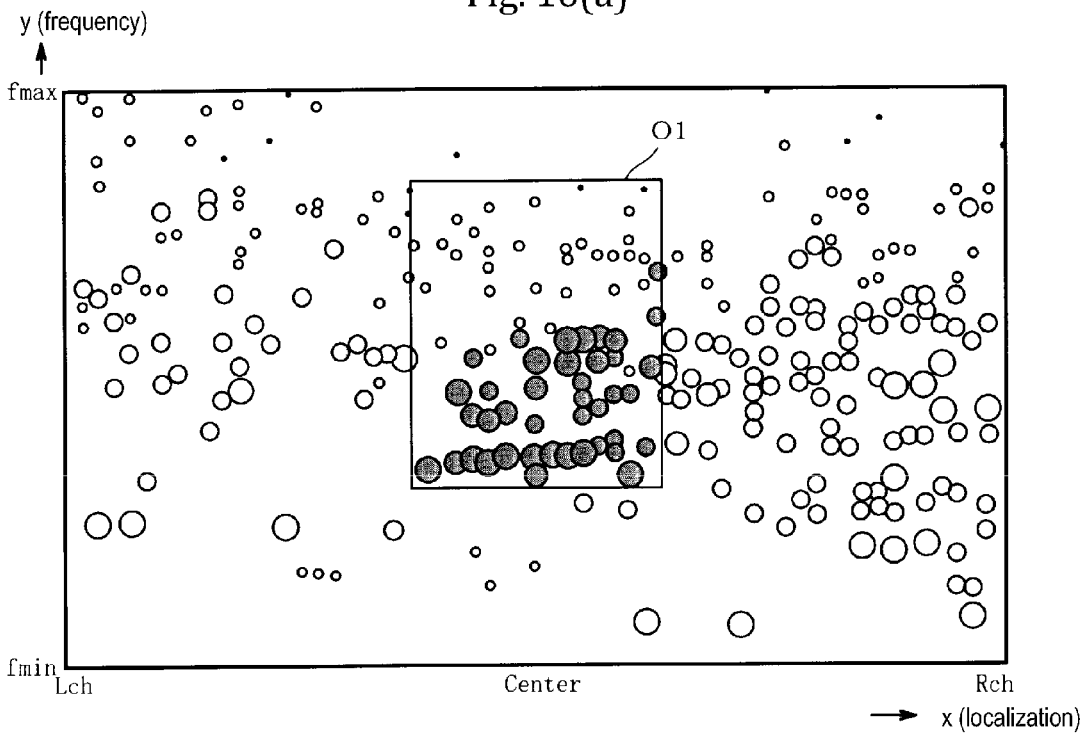

FIG. 16(*a*) is a schematic diagram that shows the display details that the UI device of this preferred embodiment displays on the display device 121 (refer to FIG. 1) in those cases where the retrieving area has been set.

The UI displays the input musical tone signal in circles in locations on the localization-frequency plane that are determined by the frequencies f and the localizations w[f]. The diameters of the circles differ in conformance with the levels of the signal (the maximum level ML[f]) for the signals of each frequency band that configure the input musical tone signal.

In those cases, here, where the retrieving areas have not been set, the signals of each frequency f that configure the input musical tone signal are displayed with sizes (the diameters of the circles) that differ in conformance with the levels, but have the same color. In other words, in those cases where the retrieving areas have not been set, in contrast to the screen that is shown in FIG. 16(*a*), the retrieving area O1 is not displayed and all of the circles of different sizes in the localization-frequency plane are displayed in the same default display color (e.g., yellow). Incidentally, in FIG. 16(*a*) and FIG. 16(*b*), which are monaural drawings, the circles that have been displayed in the default color are shown as white circles.

Incidentally, in the example that is shown in FIG. 16(*a*), the graphics that display the locations that conform to the frequencies f and the localizations w[f] of the musical tone signal on the localization-frequency plane have been made circles. However, the shape of the graphics is not limited to circles and it is possible to utilize any of various kinds of graphics such as triangles, squares, star shapes, and the like. In addition, in the example that is shown in FIG. 16(*a*), the setup has been made such that the diameters (the sizes) of the circles are changed in conformance with the level of the signal. However, the change in the state of the display that conforms to the level of the signal is not limited to a difference in the size of the graphics, and the setup may also be made such that all of the graphics that are displayed are the same size and the fill color (the hue) is changed in conformance with the level of the signal. Alternatively, the fill color is the same, but the shade or brightness may be changed in conformance with the level of the signal. In other embodiments, the level of the signal may be represented by changing a combination of a plurality of factors such the size and the fill color of the graphics.

When the retrieving area O1 is set using the input device 122, the display color of the circles, which correspond to the extraction signals that have been extracted from the retrieving area by the retrieving processing discussed above, is changed from among all of the circles that are displayed in the localization-frequency plane, as shown in FIG. 16(*a*). The retrieving processing here is, for example, the first retrieving processing (S100) that is executed in the main processing section S30 (refer to FIG. 4). In the example shown in FIG. 16(*a*), the display color that has been changed is represented by the hatching to the circles that correspond to the signals that have been extracted from the retrieving area O1.

Incidentally, in the example that is shown in FIG. 16(*a*), in those cases where the extraction signals have been extracted from the retrieving area, the display color of the graphics that correspond to the extracted signals is changed from the default display color (e.g., yellow). As a result, the extraction signals and the other signals (i.e., the input musical tone signals in the areas other than the retrieving area) are differentiated. However, this is not limited to a change in the display color. For instance, the extraction signals and the other signals may have the same color and default color, but may be differentiated in conformance with shade or brightness.

In addition, the display may be configured to differentiate the extraction signals from other signals. For example, the extraction signals may be displayed as other graphics such as triangles, stars, or the like.

In the example shown in FIG. 16(*a*), there is only one retrieving area that has been set (i.e., only the retrieving area O1). However, in those cases where multiple retrieving areas are set, the display color of the circles that correspond to the extraction signals from each retrieving area is changed from the default display color (i.e., the display color that is used for the input musical tone signals that are not in the retrieving areas that have been set). For example, in the case where the retrieving area O1 and one more retrieving area have been set, the display color of the circles that correspond to the extraction signals from the retrieving area O1 is made blue, which is different from the default color. In addition, the display color of the circles that correspond to the extraction signals from the other retrieving area is made red, which is different from the default color.

In this manner, it is possible for the signals that have been extracted from one or a plurality of retrieving areas (in the case of FIG. 16(*a*), it is the retrieving area O1) and the signals that have not been extracted (i.e., the signals that have not been extracted from the retrieving area O1) to be easily identified by the user. Therefore, the user can be made aware of the state of the clustering of the signals at a certain localization by the coloring condition of the graphics (in the case of FIG. 16(*a*), circles) that correspond to the signals that have been extracted from the retrieving areas that have been set. As a result, the user can easily distinguish the areas where vocalization or instrumentation is present.

Incidentally, in the case where there are a plurality of retrieving areas, the display colors of the circles that correspond to the extraction signals are changed for each retrieving area. As a result, it is possible to differentiate the extraction signals in each of the retrieving areas. In this case, the display color of the circles that correspond to the extraction signals from each retrieving area is made a color in which the color of the frame that draws the retrieving area on the localization-frequency plane and the color inside said retrieving area are the same. As a result, it is possible for the user to easily comprehend the correspondence between the retrieving area and the extraction signals.

FIG. 16(*b*) is a schematic diagram that shows the display details displayed on the display device 121 (refer to FIG. 1) in the case in which, from among the conditions for the extraction of the signals from the retrieving area, the lower limit threshold of the maximum level has been raised. In those cases where the lower limit threshold of the maximum level, which is one of the conditions for the extraction of the signals from the retrieving area O1, has been raised, the signals for which the maximum level ML[f] is lower than said threshold are excluded from being objects of the extraction and are not extracted. In that case, as is shown in FIG. 16(*b*), the display color of the circles that are smaller than a specified diameter from among the circles that are displayed in the retrieving area O1 is not changed and the default display color for those circles is unchanged.

Therefore, only the display color of the larger diameter circles that correspond to the signals for which the maximum level ML[f] is comparatively high is changed from the default display color. Therefore, it is possible to visually distinguish low-level signals, such as noise and the like, and comparatively high-level signals based on instrumental and vocal musical tones. For that reason, the user is easily made aware of the state of the clustering of the signals of the instrumental and vocal musical tones that are contained in the input musical tone signal. As a result, the areas where vocalization or instrumentation is present are also easily distinguished.

Figure 17:
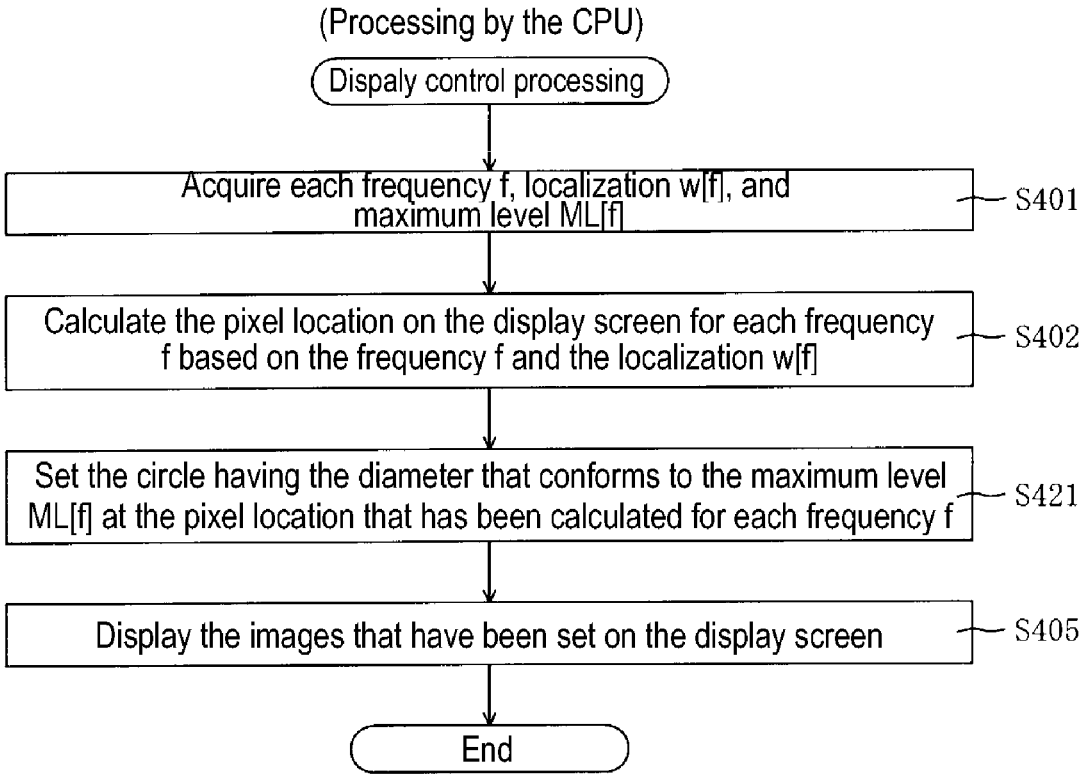
FIG. 17 is a flowchart of a display control process according to an embodiment of the present invention.

Next, an explanation will be given regarding the display control processing that is carried out by the UI device while referring to FIG. 17. FIG. 17 is a flowchart that shows the display control processing that is executed by the CPU 14 (refer to FIG. 1) of the UI device according to various embodiments. Incidentally, this display control processing is executed by the control program 15*a* that is stored in the ROM 15.

The display control processing is launched under the same conditions as the conditions that launch the display control processing of the UI device as previously discussed (e.g., with respect to FIGS. 12(*a*)-15(*b*)). First, as above, each frequency f, localization w[f], and maximum level ML[f] is acquired for the signals that are the object of the processing (S401). Then, the pixel location of the display screen is calculated for each frequency f based on the frequency f and the localization w[f] (S402). Next, the circles having diameters that conform to the maximum level ML[f] are set in the pixel locations that have been calculated for each frequency f in S402 (S421). Then, the images that have been set are displayed on the display screen of the display device 121 (S405). Then, the display control processing ends.

As discussed above, the signals of each frequency fin the musical tone that has been input (the input musical tone signal) as the objects of the processing in the effector are displayed as graphics (e.g., circles) having a specified size (e.g., the diameter of the circle) that conform to the maximum level ML[f] of the signals that correspond to each frequency fin the corresponding locations on the localization-frequency plane (the frequency f and the localization w[f]).

When retrieving area is set, the display aspect (e.g., the color) of the figure that corresponds to the extraction signal that has been extracted from said retrieving area is changed from the default. Therefore, the user can visually recognize the extraction signals that have been extracted from the retrieving area that has been set by the display aspect that differs from that prior to the extraction. Because of this, the user can easily judge whether appropriate signals have been extracted as vocal or instrumental unit signal groups. Therefore, it is possible for the user to easily identify the locations at which the desired vocal or instrumental unit signal groups are present based on the display aspects for the extraction signals that have been extracted from each retrieving area. As a result, the user can appropriately extract the desired vocal or instrumental unit signal groups.

In addition, in various embodiments, the results of each signal processing (e.g., the shifting of the localization, the expansion or contracting of the acoustic image, a pitch change, and the like) that is carried out for each retrieving area are represented on the localization-frequency plane. Therefore, the user can visually perceive said processing results prior to the synthesis of the signal. Accordingly, it is possible to process the sounds of the vocal and instrumental units according to the user's image.

In various embodiments, such as those relating to FIGS. 1-7(*b*) and FIGS. 8-9, the condition in which the frequency, the localization, and the maximum level were made a set was used in the extraction of the extraction signals in the first retrieving processing (S100) and the second retrieving processing (S200). In other embodiments, one or more of the frequency, the localization, and the maximum level may be used as the condition that extracts the extraction signals.

For example, in those cases where only the frequency is used as the condition that extracts the extraction signals, the judgment details of S101 in the first retrieving processing (S100) may be changed to "whether or not the frequency [f] is within the first frequency range that has been set in advance." In addition, for example, in those cases where only the localization is used as the condition that extracts the extraction signals, the judgment details of S101 in the first retrieving processing (S100) may be changed to "whether or not the localization w[f] is within the first setting range that has been set in advance." In addition, for example, in those cases where only the maximum level is used as the condition that extracts the extraction signals, the judgment details of S101 in the first retrieving processing (S100) may be changed to "whether or not the maximum level ML[f] is within the first setting range that has been set in advance." In those cases where the judgment details of S201 are changed in the second retrieving processing (S200) together with the change in judgment details of S101, here, the changes may be carried out in the same manner as the changes in the judgment details of S101.

Incidentally, in various embodiments, such as those relating to FIGS. 1-7(*b*) and FIGS. 8-9, the condition in which the frequency, the localization, and the maximum level have been made a set is used as the condition that extracts the extraction signals. Therefore, it is possible to suppress the effects of noise that has a center frequency outside the condition, noise that has a level that exceeds the condition, or noise that has a level that is below the condition. As a result, it is possible to accurately extract the extraction signals.

In S101 and S201 of various embodiments, such as those relating to FIGS. 1-7(*b*) and FIGS. 8-9, a judgment has been made as to whether or not the frequency f, the localization w[f], and the maximum level ML[f] are within the respective ranges that have been set in advance. In other embodiments, the setup may be such that any function in which at least two from among the frequency f, the localization w[f], and the maximum level ML[f] are made the variables may be used and a judgment made as to whether or not the value that is obtained using that function is within a range that has been set in advance. As a result, it is possible to set a more complicated range.

In each of the finishing processes (S112, S113, S115, S116, S212, S213, S215, S216, S312, S313, S315, and S316) that are executed in each of the embodiments described above, a pitch change, a level change, or the imparting of reverb has been carried out. In other embodiments, these changes and the imparting of reverb may be set to the same details in all of the finishing processing or the details for each finishing process may be different. For example, the finishing processing in the first signal processing (S112, S113, S115, and S116), the finishing processing in the second signal processing (S212, S213, S215, and S216), and the finishing processing in the processing of unspecified signals (S312, S313, S315, and S316) may be set to details that are respectively different. Incidentally, in those cases where the details of each finishing process are different in the first signal processing, the second signal processing, and the unspecified signals processing, it is possible to perform different signal processing for each extraction signal that has been extracted under each of the conditions, In various embodiments, such as those relating to FIGS. 1-7(*b*) and FIGS. 8-9, the configuration was such that the musical tone signals of the two left and right channels are input to the effector as the objects for the performance of the signal processing. However, this is not limited to the left and right, and the configuration may be such that a musical tone signal of two channels that are localized up and down, or front and back, or any two directions is input to the effector as the object for the performance of the signal processing.

In addition, the musical tone signal that is input to the effector may be a musical tone signal having three channels or more. In those cases where a musical tone signal having three channels or more is input to the effector, the localizations w[f] that correspond to the localizations of the three channels (the localization information) may be calculated and a judgment made as to whether or not each of the localizations w[f] that has been calculated falls within the setting range. For example, the up and down and/or the front and back localizations are calculated in addition to the left and right localizations w[f], and a judgment is made as to whether or not the left and right localizations w[f] and the up and down and/or the front and back localizations that have been calculated fall within the setting range. If a left and right, front and back four channel musical tone signal is given as an example, the localizations of the musical tone signals of the two sets of the respective pairs (left and right and front and back) are calculated and a judgment is made as to whether or not the localizations of the left and right and the localizations of the front and back fall within the setting range.

In each of the embodiments described above, in the retrieving processing (S100 and S200) the amplitude of the musical tone signal is used as the level of each signal for which a comparison with the setting range is carried out. In other embodiments, the configuration may also be such that the power of the musical tone signal is used. For example, in various embodiments, such as those relating to FIGS. 1-7(*b*) and FIGS. 8-9 described above in order to derive INL_Lv[f], the value in which the real part of the complex expression of the IN_L[f] signal has been squared and the value in which the imaginary part of the complex expression of the IN_L[f] signal has been squared are added together and the square root of the added value is calculated. However, INL_Lv[f] may also be derived by the addition of the value in which the real part of the complex expression of the IN_L[f] signal has been squared and the value in which the imaginary part of the complex expression of the IN_L[f] signal has been squared.

In various embodiments, such as those relating to FIGS. 1-7(*b*) and FIGS. 8-9 described above, the localization w[f] is calculated based on the ratio of the levels of the left and right channel signals. In other embodiments, the localization w[f] is calculated based on the difference between the levels of the left and right channel signals.

In various embodiments, such as those relating to FIGS. 1-7(*b*) and FIGS. 8-9, the localizations w[f] are derived uniquely for each frequency band from the two channel musical tone signal. In other embodiments, a plurality of frequency bands that are consecutive may be grouped, the level distribution of the localizations in the group derived based on the localizations that have been derived for each respective frequency band, and the level distribution of the localizations used as the localization information (the localization w[f]). In that case, for example, the desired musical tone signal can be extracted by making a judgment whether or not the range in which the localization is at or above a specified level falls within the setting range (the range that has been set as the direction range).

In various embodiments, such as those relating to FIGS. 1-7(*b*) and FIGS. 8-9 described above, in S111, S114, S211, S214, S311, and S314, the localizations that are formed by the extraction signals are adjusted based on the localizations w[f] that are derived from the left and right musical tone signals (i.e., the extraction signals) that have been extracted by each retrieving processing (S100, S200, and S300) and on the localization that is the target. In other embodiments, a monaural musical tone signal is synthesized from the left and right musical tone signals that have been extracted by, for example, simply adding together those signals and the like, and the localizations that are formed by the extraction signals are adjusted based on the localization of the target with respect to the monaural musical tone signal that has been synthesized.

In addition, in various embodiments, such as those relating to FIGS. 8-9, the coefficients ll, lr, rl, and rr and the coefficients ll', lr', rl', and rr' have been calculated for the shifting destination of the localization for the expansion (or contraction) of the acoustic image to be made the localization that is the target. In other embodiments, the shifting destination in which the shifting destination of the localization for the expansion (or contraction) of the acoustic image and the shifting destination due to the shifting of the acoustic image itself (the shifting of the retrieving area) have been combined may be made the localization that is the target.

In each of the embodiments described above, first, the extraction signals and the unspecified signals were respectively retrieved by the retrieving processing (S100, S200, and S300). After that, each signal processing (S110, S210, and S310) was performed on the extraction signals and the unspecified signals. After that, the signals that were obtained (i.e., the extraction signals and the unspecified signals following processing) were synthesized for each output channel and the post synthesized signals (OUT_L1[f], OUT_R1[f], OUT_L2[f], and OUT_R2[f]) were obtained. After that, by performing inverse FFT processing respectively for each of these post synthesized signals (S61, S71, S81, and S91), the signals of the time domain are obtained for each output channel.

In other embodiments, first, the extraction signals and the signals other than those specified are respectively retrieved by the retrieving processing (S100, S200, and S300). After that, each signal processing (processing that is equivalent to S110 and the like) is performed on the extraction signals and the unspecified signals. After that, by performing inverse FFT processing (processing that is equivalent to S61 and the like) respectively for each of the signals that have been obtained (i.e., the extraction signals and the unspecified signals following the processing), the extraction signals and the unspecified signals are transformed into time domain signals. After that, by synthesizing each of the signals that have been obtained (i.e., the extraction signals and the unspecified signals following processing that have been expressed in the time domain) for each of the output channels, time domain signals are obtained for each output channel. In that case also, as above, signal processing on the frequency axis is possible.

In other embodiments, first, the extraction signals and the signals other than those specified are respectively retrieved by the retrieving processing (S100, S200, and S300). After that, by performing inverse FFT processing (processing that is equivalent to S61 and the like) respectively for the extraction signals and the unspecified signals, these are transformed into time domain signals. After that, each signal processing (processing that is equivalent to S110 and the like) is performed on each of the signals that have been obtained (i.e., the extraction signals and the unspecified signals that have been expressed in the time domain). After that, by synthesizing each of the signals that have been obtained (i.e., the extraction signals and the unspecified signals following processing that have been expressed in the time domain) for each of the output channels, time domain signals are obtained for each output channel.

In various embodiments, such as those relating to FIGS. 1-7(*b*) and FIGS. 8-9 described above, the maximum level ML[f] is used as one of the conditions for the extraction of the extraction signals from the left and right channel signals. In other embodiments, the configuration may be such that instead of the maximum level ML[f], the sum or the average of the levels of each of the frequency bands of the signals of a plurality of channels and the like is used as the extraction condition.

In each of the embodiments described above, two retrieving processing (the first retrieving processing (S100) and the second retrieving processing (S200)) for the retrieving of the extraction signals are set. In other embodiments, three or more retrieving processes may be set. In other words, the extraction conditions (e.g., the condition in which the frequency, the localization, and the maximum level have become one set) are made three or more rather than two. In addition, in those cases where there are three or more retrieving process for the retrieving of the extraction signals, the signal processing is increased in conformance with that number.

In the embodiments described above, the other retrieving processing (S300) retrieves signals other than the extraction signals of the input musical tone signal such as the left and right channel signals and monaural signals. In other embodiments, the other retrieving processing (S300) is not disposed. In other words, the signals other than the extraction signals are not retrieved. In those cases where the other retrieving processing (S300) is not carried out, the unspecified signal processing (S310) may also not be carried out.

In each of the embodiments described above, the one set of left and right output terminals has been set up as two groups (i.e., the set of the OUT1_L terminal and the OUT1_R terminal and the set of the OUT2_L terminal and the OUT2_R terminal). In other embodiments, the groups of output terminals may be one set or may be three or more sets. For example, it may be a 5.1 channel system and the like. In those cases where the groups of output terminals are one set, the distribution of each channel signal is not carried out in each signal processing. In addition, in that case, a graph in which the range of 0.25 to 0.75 of the graph in FIGS. 7(*a*) and (*b*) has been extended to 0.0 to 1.0 (i.e., doubled) is used and the computations of S111, S211, and S311 are carried out.

In each signal processing of each embodiment described above (S110, S210, and S310), the finishing processing that comprises changing the localization of, changing the pitch of, changing the level of, and imparting reverb to the musical tone that has been extracted (the extraction signal) is carried out. In other embodiments, the signal processing that is carried out for the musical tone that has been extracted does not have to always be the same processing. In other words, the execution contents of the signal processing may be options that are appropriately selected for each extraction condition and the execution contents of the signal processing may be different for each extraction condition. In addition, in addition to changing the localization, changing the pitch, changing the level, and imparting reverb, other publicly known signal processing may be carried out as the contents of the signal processing.

In each of the embodiments described above, the coefficients ll, lr, rl, rr, ll', lr', rl', and rr' are, as shown in FIG. 7(*a*) and (*b*), changed linearly with respect to the horizontal axis. However, with regard to the portion that increases or decreases, rather than a linear increase or a linear decrease, a curved (e.g., a sine curve) increase or decrease may be implemented.

In each of the preferred embodiments described above, the Hanning window has been used as the window function. In other embodiments, a Blackman window, a hamming window, or the like may be used.

In various embodiments, such as those relating to FIGS. 8-9 and FIGS. 10-11 described above, the acoustic image expansion function YL(f) and the acoustic image expansion function YR(f) have been made functions for which the expansion condition or the contraction condition differ depending on the frequency f (i.e., functions in which the values of the acoustic image expansion function YL(f) and acoustic image expansion function YR(f) change in conformance with the frequency f). In other embodiments, they may be functions in which the values of the acoustic image expansion function YL(f) and acoustic image expansion function YR(f) are uniform and are not dependent on the changes in the frequency f. In other words, if BtmL=TopL and BtmR=TopR, the acoustic image expansion functions YL(f) and YR(f) will become functions in which the expansion or contraction conditions do not depend on the frequency f. Therefore, this kind of function may also be used.

In addition, in various embodiments, such as those relating to FIGS. 8-9 described above, the acoustic image expansion functions have been made YL(f) and YR(f) (i.e., functions of the frequency f). In other embodiments, the acoustic image expansion function may be made a function in which the expansion condition (or the contraction condition) is determined in conformance with the amount of difference from the reference localization of the localization of the extraction signal (i.e., the extraction signal's separation condition from panC). For example, the acoustic image expansion function may be a function in which the closer to the center, the larger the expansion condition. In that case, by making the horizontal axis of the drawing that is shown in FIG. 8 into the amount of difference from panC (i.e., the reference localization) of the localization of the extraction signal instead of the frequency f, the computation in the same manner as the computation that has been carried out as described above can be done. In addition, a function may also be used in which the frequency f and the amount of difference from the reference localization (panC) of the localization of the extraction signal are combined and the expansion condition (or the contraction condition) is determined in conformance with the frequency f and the amount of difference from the reference localization (panC) of the localization of the extraction signal.

Incidentally, in various embodiments, such as those relating to FIGS. 8-9 and FIGS. 10-11 described above, the acoustic image expansion functions have been made YL(f) and YR(f), in other words, functions of the frequency f. In other embodiments, in those cases where the object of the processing (i.e., the extraction signal) is a signal of the time domain, instead of being a function of the frequency f, an acoustic image expansion function that is dependent on the time t may be used.

In addition, in various embodiments, such as those relating to FIGS. 10-11 described above, an explanation was given regarding the acoustic image scaling processing for a monaural input musical tone signal that is carried out after preparatory processing in which distribution is made for a time alternately in each consecutive frequency range that has been stipulated in advance. In other embodiments, for example, the process may include synthesizing a monaural musical tone signal by simply adding together the musical tone signals of the two left and right channels and the like and carrying out the same type of preparatory processing as above for the monaural musical tone signal that has been synthesized. The image scaling processing may be carried out after this.

In addition, in various embodiments, such as those relating to FIGS. 10-11 described above, the localization range of the first retrieving area O1 and the localization range of the second retrieving area O2 have been made equal. In other embodiments, the localization ranges may also be different for each retrieving area. In addition, the boundary in the left direction (panL) and the boundary in the right direction (panR) of the retrieving area may be asymmetrical with respect to the center (panC).

In addition, in various embodiments, such as those relating to FIGS. 12(*a*)-15(*b*) and FIGS. 16(*a*)-17 described above, the control section that controls the UI device is disposed in the effector. In other embodiments, the control section may be disposed in a computer (e.g., PC or the like) separate from the effector. In that case, together with connecting the computer to the effector as the control section, the display device 121 and the input device 122 (refer to FIG. 1) are connected to said computer. Alternatively, a computer that has a display screen that corresponds to the display device 121 and an input section that corresponds to the input device 122 may be connected to the effector as the UI device.

In addition, in various embodiments, such as those relating to FIGS. 12(*a*)-15(*b*) and FIGS. 16(*a*)-17 described above, the display device 121 and the input device 122 have been made separate from the effector. In other embodiments, the effector may also have a display screen and an input section. In this case, the details displayed on the display device 121 are displayed on the display screen in the effector and the input information that has been received from the input device 122 is received from the input section of the effector.

In addition, in various embodiments, such as those relating to FIGS. 12(*a*)-15(*b*) described above, the example has been shown in which the display of the level distributions S1 and S4 is switched to the display of the level distributions S1' and S4' of the extraction signals of the shifting destination in the case where the retrieving area O1 and the retrieving area O4 have been shifted (refer to FIG. 14(*b*)). In other embodiments, the level distributions S1' and S4' of the extraction signals of the shifting destination are displayed while the level distributions S1 and S4 that are displayed in the source areas (i.e., the retrieving areas O1 and O4) remain. In the same manner, the example has been shown in which in the case where the retrieving area O1 and the retrieving area O4 have been expanded or contracted, the display of the level distributions S1 and S4 are switched to the display of the level distributions S1" and S4" of the extraction signals of the mapping destination (refer to FIG. 14(*c*)). In other embodiments, the level distributions S1" and S4" of the extraction signals of the mapping destination are displayed while the level distributions S1 and S4 of the source remain.

In that case, the display of the level distributions of the shifting source/mapping source and the display of the level distributions of the shifting destination/mapping destination may be associated by, for example, making each of the mutual display colors the same hue and the like. At that time, mutual identification of the display of the level distributions of the shifting source/mapping source and the display of the level distributions of the shifting destination/mapping destination may be made possible by the depth of the color or the presence of hatching and the like. For example, the display color of the level distribution S1' is made deeper than the display color of the level distribution S1 while the display colors of the level distribution S1 and the level distribution S1' are made the same hue. While the level distribution S1 and the level distribution S1' are associated, it is possible to distinguish whether it is the level distribution of the shifting source or mapping source or the level distribution of the shifting destination or mapping destination.

In addition, in various embodiments, such as those relating to FIGS. 12(*a*)-15(*b*) described above, the level in which the normal distribution is used is expanded as the probability distribution. In other embodiments, the expansion of the level may be carried out using various kinds of probability distribution such as at distribution or a Gaussian distribution and the like or any distribution such as a conical type or a bell-shaped type and the like.

In addition, in various embodiments, such as those relating to FIGS. 12(*a*)-15(*b*) described above, the level distribution, in which the level distributions of each frequency f of the input musical tone signal that have been combined and calculated (i.e., calculated using the formula (1)), is displayed on the localization-frequency plane. In other embodiments, the level distribution of each frequency f is displayed.

In addition, in various embodiments, such as those relating to FIGS. 12(*a*)-15(*b*) described above, a display that corresponds to the level distribution is implemented. In various embodiments, such as those relating to FIGS. 16(*a*)-17 described above, a shape is displayed in which the size of the shape differs in conformance with level. In other embodiments, any display method can be applied. For example, a display such as one in which a contour line connects comparable levels may be implemented.

In addition, in various embodiments, such as those relating to FIGS. 12(*a*)-15(*b*) and FIGS. 16(*a*)-17 described above, the levels of the input musical tone signal are displayed by the display on the display screen of a two-dimensional plane comprising the localization axis and the frequency axis. In other embodiments, a three-dimensional coordinate system comprising the localization axis, the frequency axis, and the level axis is displayed on the display screen. In that case, it is possible to represent the level distribution or the levels of the input musical tone as, for example, the height direction (the z-axis direction) in the three-dimensional coordinate system.

In addition, in various embodiments, such as those relating to FIGS. 12(*a*)-15(*b*) and FIGS. 16(*a*)-17 described above, in those cases where the extraction of the signals is carried out by the retrieving area, or the shifting of the extraction signals is done by the shifting of the retrieving area, or the mapping of the extraction signals is done in accordance with the expansion or contraction of the retrieving area, the level distribution or the shapes that correspond to the levels of the signals after the processing are displayed. In other embodiments, only the boundary lines of each area (the retrieving area, the area of the shifting destination, and the area that has been expanded or contracted) may be displayed and the display of the level distribution or the shapes that correspond to the levels of the signals after the processing omitted.

Incidentally, in those cases where the shifting of the retrieving area has been carried out, the boundary lines of the area prior to the shifting (i.e., the original retrieving area) and the boundary lines of the area after shifting may be displayed at the same time. In the same manner, in those cases where expansion or contraction of the retrieving area has been carried out, the boundary lines of the area prior to the expansion or contraction (i.e., the original retrieving area) and the boundary lines of the area after the expansion or contraction may be displayed at the same time. In this case, the display may be configured to differentiate the boundary lines of the original retrieving area and the boundary lines after the shifting/after the expansion or contraction.

The embodiments disclosed herein are to be considered in all respects as illustrative, and not restrictive of the invention. The present invention is in no way limited to the embodiments described above. Various modifications and changes may be made to the embodiments without departing from the spirit and scope of the invention. The scope of the invention is indicated by the attached claims, rather than the embodiments. Various modifications and changes that come within the meaning and range of equivalency of the claims are intended to be within the scope of the invention.

What is claimed is:

1. A musical tone signal processing apparatus, the apparatus comprising:

input means for inputting a musical tone signal, the musical tone signal comprising a signal for each of a plurality of input channels;

dividing means for dividing the signals into a plurality of frequency bands;

level calculation means for calculating a level for each of the input channels for each of the frequency bands;

localization information calculation means for calculating localization information, which indicates an output direction of the musical tone signal with respect to a first reference localization that has been set in advance, for each of the frequency bands based on the level;

first setting means for setting at least one direction range of the output direction;

judgment means for judging whether the output direction of the musical tone signal is within the direction range;

extraction means for extracting an extraction signal, the extraction signal comprising the signal of each of the input channels in the frequency band corresponding to the localization information having the output direction that is judged to be within the direction range;

output signal generation means for generating an output signal in the time domain for each output channel that has been set in advance, the output signal in the time domain generated by signal processing and converting the extraction signal;

output means for outputting the output signal in the time domain to each of the output channels;

second setting means for setting for the direction range: a second reference localization, a first function that stipulates the degree of expansion of a boundary of a first end of the direction range, and a second function that stipulates the degree of expansion of a boundary of a second end of the direction range; and acoustic image scaling means for expanding or contracting an acoustic image by shifting the output direction of an extraction signal, that has localization information located closer to the boundary of the first end of the direction range than the second reference localization, based on mapping of the first function, and shifting the output direction of an extraction signal, that has localization information located closer to the boundary of the second end of the direction range than the second reference localization, based on mapping of the second function.

2. The apparatus of claim 1, wherein the first setting means is configured to set a plurality of direction ranges for the output direction;

wherein the judgment means judges whether the output direction of the musical tone signal is within each of the direction ranges;

wherein the extraction means extracts the extraction signal, the extraction signal comprising the signal of each of the input channels in the frequency band corresponding to the localization information having the output direction that is judged to be in each of the direction ranges; and wherein the second setting means is configured to set for each of the direction ranges: a second reference localization, a first function that stipulates the degree of expansion of a boundary of a first end of each direction range, and a second function that stipulates the degree of expansion of a boundary of a second end of each direction range;

the output signal generation means comprising:

signal processing means for processing the extraction signal into a post-processed extraction signal for each of the direction ranges;

synthesis means for synthesizing the post-processed extraction signal into a synthesized signal for each output channel that has been set in advance for each of the direction ranges, each output channel corresponding to one of the plurality of input channels; and conversion means for converting each of the synthesized signals into a respective one of the output signal in the time domain.

3. The apparatus of claim 2, wherein the second setting means is configured to set the second reference localization, the first function, and the second function to be the same for at least some of the direction ranges.

4. The apparatus of claim 2, wherein the signal processing means distributes the signal of each input channel in conformance with the output channels;

wherein the signal processing means processes each of the distributed signals;

wherein the output means comprises a plurality of output means each of which corresponds to one of the distributed signals;

wherein the second setting means sets for the direction range of the distributed signals: a second reference localization, a first function that stipulates the degree of expansion of a boundary of a first end of the direction range, and a second function that stipulates the degree of expansion of a boundary of a second end of the direction range; and wherein the acoustic image scaling means shifts the output direction for each of the distributed signals.

5. The apparatus of claim 1, wherein the first setting means is configured to set a plurality of direction ranges for the output direction;

wherein the judgment means judges whether the output direction of the musical tone signal is within each of the direction ranges;

wherein the extraction means extracts the extraction signal, the extraction signal comprising the signal of each of the input channels in the frequency band corresponding to the localization information having the output direction that is judged to be in each of the direction ranges; and wherein the second setting means is configured to set for each of the direction ranges: a second reference localization, a first function that stipulates the degree of expansion of a boundary of a first end of each direction range, and a second function that stipulates the degree of expansion of a boundary of a second end of each direction range;

the output signal generation means comprising:

signal processing means for processing the extraction signal into a post-processed extraction signal for each of the direction ranges;

conversion means for converting the post-processed extraction signal into a time domain extraction signal for each of the direction ranges; and synthesis means for synthesizing each of the time domain extraction signal for each output channel that has been set in advance for each of the direction ranges into a respective one of the output signal in the time domain, each output channel corresponding to one of the plurality of input channels.

6. The apparatus of claim 5, wherein the second setting means is configured to set the second reference localization, the first function, and the second function to be the same for at least some of the direction ranges.

7. The apparatus of claim 5, wherein the signal processing means distributes the signal of each input channel in conformance with the output channels;

wherein the signal processing means processes each of the distributed signals;

wherein the output means comprises a plurality of output means each of which corresponds to one of the distributed signals;

wherein the second setting means sets for the direction range of the distributed signals: a second reference localization, a first function that stipulates the degree of expansion of a boundary of a first end of the direction range, and a second function that stipulates the degree of expansion of a boundary of a second end of the direction range; and wherein the acoustic image scaling means shifts the output direction for each of the distributed signals.

8. The apparatus of claim 1, wherein the first setting means is configured to set a plurality of direction ranges for the output direction;

wherein the judgment means judges whether the output direction of the musical tone signal is within each of the direction ranges;

wherein the extraction means extracts the extraction signal, the extraction signal comprising the signal of each of the input channels in the frequency band corresponding to the localization information having the output direction that is judged to be in each of the direction ranges; and wherein the second setting means is configured to set for each of the direction ranges: a second reference localization, a first function that stipulates the degree of expansion of a boundary of a first end of each direction range, and a second function that stipulates the degree of expansion of a boundary of a second end of each direction range;

the output signal generation means comprising:

conversion means for converting the extraction signal into a time domain extraction signal for each of the direction ranges;

signal processing means for processing each of the time domain extraction signals into a respective time domain post-processed extraction signal; and synthesis means for synthesizing the time domain post-processed extraction signals for each output channel that has been set in advance for each of the direction ranges into a respective one of the output signal in the time domain, each output channel corresponding to one of the plurality of input channels.

9. The apparatus of claim 8, wherein the second setting means is configured to set the second reference localization, the first function, and the second function to be the same for at least some of the direction ranges.

10. The apparatus of claim 8, wherein the signal processing means distributes the signal of each input channel in conformance with the output channels;

wherein the signal processing means processes each of the distributed signals;

wherein the output means comprises a plurality of output means each of which corresponds to one of the distributed signals;

wherein the second setting means sets for the direction range of the distributed signals: a second reference localization, a first function that stipulates the degree of expansion of a boundary of a first end of the direction range, and a second function that stipulates the degree of expansion of a boundary of a second end of the direction range; and wherein the acoustic image scaling means shifts the output direction for each of the distributed signals.

11. The apparatus of claim 1, the acoustic image scaling means comprising sorting means for sorting the output directions such that the output directions alternate in each of the consecutive frequency ranges to the first end and the second end of the direction range.

12. A musical tone signal processing apparatus, the apparatus comprising:

input means for inputting a monaural musical tone signal;

dividing means for dividing the monaural musical tone signal into a plurality of frequency bands;

level calculation means for calculating a level for each of the frequency bands;

first setting means for setting at least one set of a direction range that includes the output direction of the monaural musical tone signal and a bandwidth of the frequency bands, the output direction being equal to a first reference localization that has been stipulated in advance;

extraction means for extracting, for the at least one set, the monaural signal of the frequency bands that are within each bandwidth;

output signal generation means for generating an output signal in the time domain for each output channel that has been set in advance;

output means for outputting the output signal to each of the output channels;

second setting means for setting, for each of the at least one set, a second reference localization, a first function that stipulates the degree of expansion of a boundary of a first end of the direction range, and a second function that stipulates the degree of expansion of a boundary of a second end of the direction range;

sorting means for sorting the output directions such that the output directions alternate in each of the consecutive frequency ranges to the first end and the second end of the direction range; and acoustic image scaling means for expanding or contracting an acoustic image by shifting the output direction of an extraction signal, that has localization information located closer to the boundary of the first end of the direction range than the second reference localization, based on mapping of the first function, and shifting the output direction of an extraction signal, that has localization information located closer to the boundary of the second end of the direction range than the second reference localization, based on mapping of the second function.

13. A signal processing system, the system comprising:

an input terminal configured to input an audio signal, the audio signal comprising a signal for each of a plurality of input channels, each of the signals having a plurality of frequency bands;

an first operator device configured to set at least one direction range of the output direction;

a second operator device configured to set for the direction range: a second reference point, a first function establishing expansion of a boundary of a first end of the direction range, and a second function establishing expansion of a boundary of a second end of the direction range;

a processor configured to calculate a signal level for each of the input channels for each of the frequency bands;

the processor configured to calculate localization information, which indicates an output direction of the audio signal with respect to a predefined first reference point, for each of the frequency bands based on the signal level;

the processor configured to determine whether the output direction of the audio signal is within the direction range;

the processor configured to extract as an extraction signal, the signal of each of input channel in the frequency band corresponding to the localization information having the output direction that is determined to be within the direction range; and the processor configured to expand or contract an acoustic image by shifting the output direction of an extraction signal, that has localization information located closer to the boundary of the first end of the direction range than the second reference point, based on mapping of the first function, and shifting the output direction of an extraction signal, that has localization information located closer to the boundary of the second end of the direction range than the second reference point, based on mapping of the second function;

an output signal generator configured to generate an output time domain signal for each preset output channel, the output time domain signal generated by signal processing and converting the extraction signal; and an output terminal configured to output the output time domain signal to each of the output channels.

14. The system of claim 13, wherein the first operator device is configured to set a plurality of direction ranges for the output direction;

wherein the processor is configured to determine whether the output direction of the audio signal is within each of the direction ranges;

wherein the processor is configured to extract the extraction signal, the extraction signal comprising the signal of each of the input channels in the frequency band corresponding to the localization information having the output direction that is judged to be in each of the direction ranges; and wherein the second operator device is configured to set for each of the direction ranges: a second reference point for each direction range, a first function establishing expansion of a boundary of a first end of each direction range, and a second function establishing expansion of a boundary of a second end of each direction range;

the output signal generator comprising:

a signal processor configured to process the extraction signal into a post-processed extraction signal for each of the direction ranges;

a synthesizer configured to synthesize the post-processed extraction signal into a synthesized signal for each predefined output channel for each of the direction ranges; and a converter configured to convert the each of the synthesized signals into a respective one of the output time domain signal.

15. The system of claim 14, wherein the second operator device is configured to set the second reference point, the first function, and the second function to be the same for at least some of the direction ranges.

16. The system of claim 14, wherein the signal processor is configured to distribute the signal of each input channel in conformance with the output channels;

wherein the signal processor is configured to process each of the distributed signals;

wherein the output terminal comprises a plurality of output terminals each of which corresponds to one of the distributed signals;

wherein the second operator device is configured to set for the direction range of the distributed signals: a second reference point, a first function establishing expansion of a boundary of a first end of the direction range, and a second function establishing expansion of a boundary of a second end of the direction range; and wherein the processor is configured to shift the output direction for each of the distributed signals.

17. The system of claim 13, wherein the first operator device is configured to set a plurality of direction ranges for the output direction;

wherein the processor is configured to determine whether the output direction of the audio signal is within each of the direction ranges;

wherein the processor is configured to extract the extraction signal, the extraction signal comprising the signal of each of the input channels in the frequency band corresponding to the localization information having the output direction that is judged to be in each of the direction ranges; and wherein the second operator device is configured to set for each of the direction ranges: a second reference point for each direction range, a first function establishing expansion of a boundary of a first end of each direction range, and a second function establishing expansion of a boundary of a second end of each direction range;

the output signal generator comprising:

a signal processor configured to process the extraction signal into a post-processed extraction signal for each of the direction ranges;

a converter configured to convert the post-processed extraction signal into a time domain extraction signal for each of the direction ranges; and a synthesizer configured to synthesize each of the time domain extraction signal for each predefined output channel for each of the direction ranges into a respective one of the output time domain signal.

18. The system of claim 17, wherein the second operator device is configured to set the second reference point, the first function, and the second function to be the same for at least some of the direction ranges.

19. The system of claim 17, wherein the signal processor is configured to distribute the signal of each input channel in conformance with the output channels;

wherein the signal processor is configured to process each of the distributed signals;

wherein the output terminal comprises a plurality of output terminals each of which corresponds to one of the distributed signals;

wherein the second operator device is configured to set for the direction range of the distributed signals: a second reference point, a first function establishing expansion of a boundary of a first end of the direction range, and a second function establishing expansion of a boundary of a second end of the direction range; and wherein the processor is configured to shift the output direction for each of the distributed signals.

20. The system of claim 13, wherein the first operator device is configured to set a plurality of direction ranges for the output direction;

wherein the processor is configured to determine whether the output direction of the audio signal is within each of the direction ranges;

wherein the processor is configured to extract the extraction signal, the extraction signal comprising the signal of each of the input channels in the frequency band corresponding to the localization information having the output direction that is judged to be in each of the direction ranges; and wherein the second operator device is configured to set for each of the direction ranges: a second reference point for each direction range, a first function establishing expansion of a boundary of a first end of each direction range, and a second function establishing expansion of a boundary of a second end of each direction range;

the output signal generator comprising:

a converter configured to convert the post-processed extraction signal into a time domain extraction signal for each of the direction ranges;

a signal processor configured to process the time domain extraction signal into a respective time domain post-processed extraction signal; and a synthesizer configured to synthesize the time domain post-processed extraction signal for each predefined output channel for each of the direction ranges into a respective one of the output time domain signal.

21. The system of claim 20, wherein the second operator device is configured to set the second reference point, the first function, and the second function to be the same for at least some of the direction ranges.

22. The system of claim 20, wherein the signal processor is configured to distribute the signal of each input channel in conformance with the output channels;

wherein the signal processor is configured to process each of the distributed signals;

wherein the output terminal comprises a plurality of output terminals each of which corresponds to one of the distributed signals;

wherein the second operator device is configured to set for the direction range of the distributed signals: a second reference point, a first function establishing expansion of a boundary of a first end of the direction range, and a second function establishing expansion of a boundary of a second end of the direction range; and wherein the processor is configured to shift the output direction for each of the distributed signals.

23. The system of claim 13, wherein the processor is configured to sort the output directions of consecutive frequency ranges to alternate between the first end and the second end of the direction range.

24. A musical tone signal processing system, the system comprising:

an input terminal configured to input a monaural audio signal, the monaural audio signal having a plurality of frequency bands;

a first operator device configured to set at least one of a set of a direction range that includes an output direction of the monaural audio signal and a bandwidth of the frequency bands, the output direction being equal to a first reference point that is preset;

a second operator device configured to set, for each of the at least one set, a second reference point, a first function establishing expansion of a boundary of a first end of the direction range, and a second function establishing expansion of a boundary of a second end of the direction range;

a processor configured to calculate a signal level for each of the frequency bands;

the processor configured to extract, for the at least one set, the monaural audio signal of the frequency bands that are within each bandwidth;

the processor configured to sort the output directions such that the output directions alternate in each of the consecutive frequency ranges to the first end and the second end of the direction range; and the processor configured to expand or contract an acoustic image by shifting the output direction of an extraction signal, that has localization information located closer to the boundary of the first end of the direction range than the second reference point, based on mapping of the first function, and shifting the output direction of an extraction signal, that has localization information located closer to the boundary of the second end of the direction range than the second reference point, based on mapping of the second function;

an output signal generator configured to generate an output time domain signal for each preset output channel; and an output terminal configured to output the output time domain signal to each of the output channels.

25. The system of claim 24, wherein the monaural audio signal comprises a signal of a single input channel.

26. The system of claim 24, wherein the monaural audio signal is provided by a signal of a plurality of input channels that are synthesized into the monaural audio signal.

* * * * *